US011472176B2

(12) United States Patent
Matsumoto

(10) Patent No.: US 11,472,176 B2
(45) Date of Patent: Oct. 18, 2022

(54) LIQUID DISCHARGE APPARATUS AND HEAD UNIT

(71) Applicant: SEIKO EPSON CORPORATION, Tokyo (JP)

(72) Inventor: Yusuke Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/131,874

(22) Filed: Dec. 23, 2020

(65) Prior Publication Data

US 2021/0197548 A1 Jul. 1, 2021

(30) Foreign Application Priority Data

Dec. 25, 2019 (JP) ..... JP2019-235062

(51) Int. Cl.
*B41J 2/045* (2006.01)

(52) U.S. Cl.
CPC ..... *B41J 2/0451* (2013.01); *B41J 2/04541* (2013.01); *B41J 2/04581* (2013.01)

(58) Field of Classification Search
CPC ..... B41J 2/1433; B41J 2/14209; B41J 2002/14491
See application file for complete search history.

(56) References Cited

U.S. PATENT DOCUMENTS 9,254,656 B2 * 2/2016 Okui ..... B41J 2/17526
2009/0207211 A1 * 8/2009 Ito ..... B41J 2/14233 347/68
2012/0182354 A1 * 7/2012 Akahane ..... B41J 2/14274 347/54
2016/0121609 A1 * 5/2016 Owaki ..... B41J 2/14233 347/50
2016/0167382 A1 6/2016 Date
2019/0009531 A1 1/2019 Furukawa

FOREIGN PATENT DOCUMENTS

EP 2835261 A1 2/2015
JP 2016-112694 A 6/2016
JP 2017-114020 A 6/2017

* cited by examiner

*Primary Examiner* — Lam S Nguyen

(74) *Attorney, Agent, or Firm* — Global IP Counselors, LLP

(57) ABSTRACT

In a liquid discharge apparatus, a head unit includes a plurality of print heads, and a housing that houses the print heads, in which a first print head in the plurality of print heads includes a substrate that includes a first side, a second side, a first surface, and a second surface, a first nozzle plate, a first integrated circuit that is provided on the first surface, that outputs an abnormality signal indicating presence or absence of abnormality of the first print head, a first flexible wiring substrate that is electrically coupled to the substrate, and a second integrated circuit that is provided on the first flexible wiring substrate, the second integrated circuit is located between the first nozzle plate and the substrate, and the substrate is provided so that the first surface faces downward and the second surface faces upward in a direction along a vertical direction.

20 Claims, 36 Drawing Sheets

| [SIH, SIL] | | [1, 1] LARGE DOT | [1, 0] MIDDLE DOT | [0, 1] SMALL DOT | [0, 0] NON-RECORDING |
|---|---|---|---|---|---|
| S | T1 | H | H | L | L |
| | T2 | H | L | H | L |
| | T3 | L | L | L | H |

FIG. 15

| TERMINAL NUMBER | INPUT SIGNAL |
|---|---|
| 353-1 | GND |
| 353-2 | TH |
| 353-3 | GND |
| 353-4 | LAT |
| 353-5 | GND |
| 353-6 | SCK |
| 353-7 | GND |
| 353-8 | CH |
| 353-9 | GND |
| 353-10 | SI1 |
| 353-11 | GND |
| 353-12 | XHOT |
| 353-13 | CGND-1 |
| 353-14 | COM-1 |
| 353-15 | CGND-2 |
| 353-16 | COM-2 |
| 353-17 | CGND-3 |
| 353-18 | COM-3 |
| 353-19 | CGND-4 |
| 353-20 | COM-4 |
| 353-21 | CGND-5 |
| 353-22 | COM-5 |
| 353-23 | CGND-6 |
| 353-24 | COM-6 |

FIG. 16

| TERMINAL NUMBER | INPUT SIGNAL |
|---|---|
| 363-1 | CGND-6 |
| 363-2 | COM-6 |
| 363-3 | CGND-5 |
| 363-4 | COM-5 |
| 363-5 | CGND-4 |
| 363-6 | COM-4 |
| 363-7 | CGND-3 |
| 363-8 | COM-3 |
| 363-9 | CGND-2 |
| 363-10 | COM-2 |
| 363-11 | CGND-1 |
| 363-12 | COM-1 |
| 363-13 | GND |
| 363-14 | VHV |
| 363-15 | GND |
| 363-16 | SI6 |
| 363-17 | GND |
| 363-18 | SI5 |
| 363-19 | GND |
| 363-20 | SI4 |
| 363-21 | GND |
| 363-22 | SI3 |
| 363-23 | VDD |
| 363-24 | SI2 |

FIG. 29

| TERMINAL NUMBER | INPUT SIGNAL |
|---|---|
| 353-1 | GND |
| 353-2 | TH |
| 353-3 | GND |
| 353-4 | LATa |
| 353-5 | GND |
| 353-6 | SCKa |
| 353-7 | GND |
| 353-8 | CHa |
| 353-9 | GND |
| 353-10 | SI1 |
| 353-11 | CGND-1 |
| 353-12 | COM-1 |
| 353-13 | CGND-2 |
| 353-14 | COM-2 |
| 353-15 | CGND-3 |
| 353-16 | COM-3 |
| 353-17 | CGND-4 |
| 353-18 | COM-4 |
| 353-19 | CGND-5 |
| 353-20 | COM-5 |

FIG. 30

| TERMINAL NUMBER | INPUT SIGNAL |
|---|---|
| 363-1 | CGND-5 |
| 363-2 | COM-5 |
| 363-3 | CGND-4 |
| 363-4 | COM-4 |
| 363-5 | CGND-3 |
| 363-6 | COM-3 |
| 363-7 | CGND-2 |
| 363-8 | COM-2 |
| 363-9 | CGND-1 |
| 363-10 | COM-1 |
| 363-11 | GND |
| 363-12 | SI5 |
| 363-13 | GND |
| 363-14 | SI4 |
| 363-15 | GND |
| 363-16 | SI3 |
| 363-17 | GND |
| 363-18 | SI2 |
| 363-19 | GND |
| 363-20 | VDD |

FIG. 31

| TERMINAL NUMBER | INPUT SIGNAL |
|---|---|
| 373-1 | CGND-6 |
| 373-2 | COM-6 |
| 373-3 | CGND-7 |
| 373-4 | COM-7 |
| 373-5 | CGND-8 |
| 373-6 | COM-8 |
| 373-7 | CGND-9 |
| 373-8 | COM-9 |
| 373-9 | CGND-10 |
| 373-10 | COM-10 |
| 373-11 | GND |
| 373-12 | XHOT |
| 373-13 | GND |
| 373-14 | LATb |
| 373-15 | GND |
| 373-16 | SCKb |
| 373-17 | GND |
| 373-18 | CHb |
| 373-19 | GND |
| 373-20 | SI10 |

FIG. 32

| TERMINAL NUMBER | INPUT SIGNAL |
|---|---|
| 383-1 | GND |
| 383-2 | SI9 |
| 383-3 | GND |
| 383-4 | SI8 |
| 383-5 | VDD |
| 383-6 | SI7 |
| 383-7 | GND |
| 383-8 | SI6 |
| 383-9 | GND |
| 383-10 | VHV |
| 383-11 | CGND-10 |
| 383-12 | COM-10 |
| 383-13 | CGND-9 |
| 383-14 | COM-9 |
| 383-15 | CGND-8 |
| 383-16 | COM-8 |
| 383-17 | CGND-7 |
| 383-18 | COM-7 |
| 383-19 | CGND-6 |
| 383-20 | COM-6 |

LIQUID DISCHARGE APPARATUS AND HEAD UNIT

The present application is based on, and claims priority from JP Application Serial Number 2019-235062, filed Dec. 25, 2019, the disclosure of which is hereby incorporated by reference herein in its entirety.

BACKGROUND

1. Technical Field

The present disclosure relates to a liquid discharge apparatus and a head unit.

2. Related Art

A liquid discharge apparatus, such as an ink jet printer, discharges liquid, such as ink, with which a cavity is filled, from nozzles by driving piezoelectric elements provided in a print head included a head unit using a driving signal, and forms text and an image on a medium. In the liquid discharge apparatus, when malfunction occurs in the print head, there is a problem in that discharge abnormality occurs in which it is not possible to normally discharge the liquid from the nozzles. Further, when the discharge abnormality occurs, discharge accuracy of the liquid discharged from the nozzles decreases, and dots that satisfy normal print quality are not formed on the medium, and, as a result, a quality of the image formed on the medium deteriorates. A print head is known which has a self-diagnosis function of diagnosing whether or not the quality of the image formed on the medium deteriorates by the print head itself based on the discharge accuracy of the liquid discharged from the print head.

For example, JP-A-2017-114020 discloses a technology for diagnosing, by a print head itself, whether or not it is possible to form dots which satisfy a normal print quality based on a plurality of signals which are input to the print head.

In addition, JP-A-2016-112694 discloses a head unit, which includes an integrated circuit chip for controlling drive of print heads, and a plurality of print heads for discharging liquid when a driving signal controlled by the integrated circuit chip is supplied and in which the plurality of print heads are housed in a case, and a line head type liquid discharge apparatus which includes the head unit.

However, when a self-diagnosis function, which is disclosed in JP-A-2017-114020 and is performed by a print head itself in order to diagnose whether or not it is possible to form dots which satisfy a normal print quality, is applied to a head unit which is disclosed in JP-A-2016-112694 and in which the print head is housed in a case, heat is generated in an integrated circuit chip or the like for controlling drive of the print head, and thus internal temperature of the case rises. Further, in accordance with the rise of the internal temperature, temperature of a component, such as an integrated circuit, for performing the self-diagnosis function of the print head also rises. As a result, there is a problem in that the configuration, such as the integrated circuit, for executing the self-diagnosis function of the print head does not operate normally.

In particular, in a head unit used in a line head type liquid discharge apparatus in which a plurality of print heads are housed as disclosed in JP-A-2017-114020, the plurality of print heads are housed in the case. Therefore, the amount of generated heat increases in the entire head unit, and, as a result, the rise of the internal temperature of the case further increases. Further, in the line head type liquid discharge apparatus as disclosed in JP-A-2017-114020, the print heads discharge ink to the medium in a state in which the head unit is fixed to a housing of the liquid discharge apparatus. Therefore, it is difficult to cool the head unit, and, as a result, the rise of the internal temperature further increases.

As described above, when the self-diagnosis function of the print head is applied to the print head housed in the case, there is room for improvement from a viewpoint of reducing the rise of the temperature of the component, such as the integrated circuit, for executing the self-diagnosis function. In particular, when the self-diagnosis function of the print head is applied to the print head included in the head unit used for the line head type liquid discharge apparatus, a problem becomes more remarkable to reduce the rise of the temperature of the component, such as the integrated circuit, for executing the self-diagnosis function.

SUMMARY

According to an aspect of the present disclosure, there is provided a liquid discharge apparatus including a head unit that discharges liquid, and a digital signal output circuit that outputs a digital signal to the head unit, in which the head unit includes a plurality of print heads that discharge the liquid, and a housing that houses the plurality of print heads, a first print head in the plurality of print heads includes a substrate that includes a first side, a second side which intersects with the first side, a first surface which has the first side and the second side, and a second surface which is different from the first surface, a first nozzle plate that includes a first nozzle row in which a plurality of first nozzles for discharging the liquid are provided in line in a direction along the first side, a connector that is provided in the first surface and to which the digital signal is input, a first integrated circuit that is provided on the first surface, that is electrically coupled to the connector, to which the digital signal is input via the connector, and that outputs an abnormality signal indicating presence or absence of abnormality of the first print head, a first flexible wiring substrate that is electrically coupled to the substrate, and a second integrated circuit that is provided on the first flexible wiring substrate, the second integrated circuit is located between the first nozzle plate and the substrate, and the substrate is provided so that the first surface faces downward and the second surface faces upward in a direction along a vertical direction.

According to another aspect of the present disclosure, there is provided a head unit including a plurality of print heads that discharge liquid, and a housing that houses the plurality of print heads, in which a first print head in the plurality of print heads includes a substrate that includes a first side, a second side which intersects with the first side, a first surface which has the first side and the second side, and a second surface which is different from the first surface, a first nozzle plate that includes a first nozzle row in which a plurality of first nozzles for discharging the liquid are provided in line in a direction along the first side, a connector that is provided in the first surface and to which a digital signal is input, a first integrated circuit that is provided in the first surface, that is electrically coupled to the connector, to which the digital signal is input via the connector, and that outputs an abnormality signal indicating presence or absence of abnormality of the first print head, a first flexible wiring substrate that is electrically coupled to the substrate, and a second integrated circuit that is provided on the first flexible wiring substrate, the second integrated circuit is located between the first nozzle plate and the substrate, and the substrate is provided so that the first surface faces downward and the second surface faces upward in a direction along a vertical direction.

BRIEF DESCRIPTION OF THE DRAWINGS

FIG. 15 is a diagram illustrating examples of signals respectively input to a plurality of terminals.

FIG. 16 is a diagram illustrating examples of signals respectively input to a plurality of terminals.

FIG. 29 is a diagram illustrating examples of signals respectively input to a plurality of terminals according to the third embodiment.

FIG. 30 is a diagram illustrating examples of signals respectively input to a plurality of terminals according to the third embodiment.

FIG. 31 is a diagram illustrating examples of signals respectively input to a plurality of terminals according to the third embodiment.

FIG. 32 is a diagram illustrating examples of signals respectively input to a plurality of terminals according to the third embodiment.

DESCRIPTION OF EXEMPLARY EMBODIMENTS

Hereinafter, preferable embodiments of the present disclosure will be described with reference to the accompanying drawings. The accompanying drawings are used for convenience of description. Note that, the embodiments which will be described below do not unreasonably limit content of the present disclosure disclosed in aspects. In addition, all configurations which will be described below are not limited to essential components of the present disclosure.

Hereinafter, an ink jet printer, which forms an image by discharging ink as liquid on a medium, will be described as an example of a liquid discharge apparatus. Note that, the liquid discharge apparatus is not limited to the ink jet printer, and it is possible to exemplify, for example, a color material discharge apparatus used to manufacture a color filter of a liquid crystal display or the like, an electrode material discharge apparatus used to form an electrode of an organic EL display or a Field Emission Display (FED), a living organism discharge apparatus used to manufacture a biochip, a solid forming apparatus (a so-called 3D printer), a textile printing apparatus, or the like. In such a case, the liquid discharged from the liquid discharge apparatus is not limited to the ink, and may be, for example, liquid containing an electrode material or a liquid containing a biological organic substance.

1. First Embodiment

1.1 Outline of Liquid Discharge Apparatus

Figure 1:
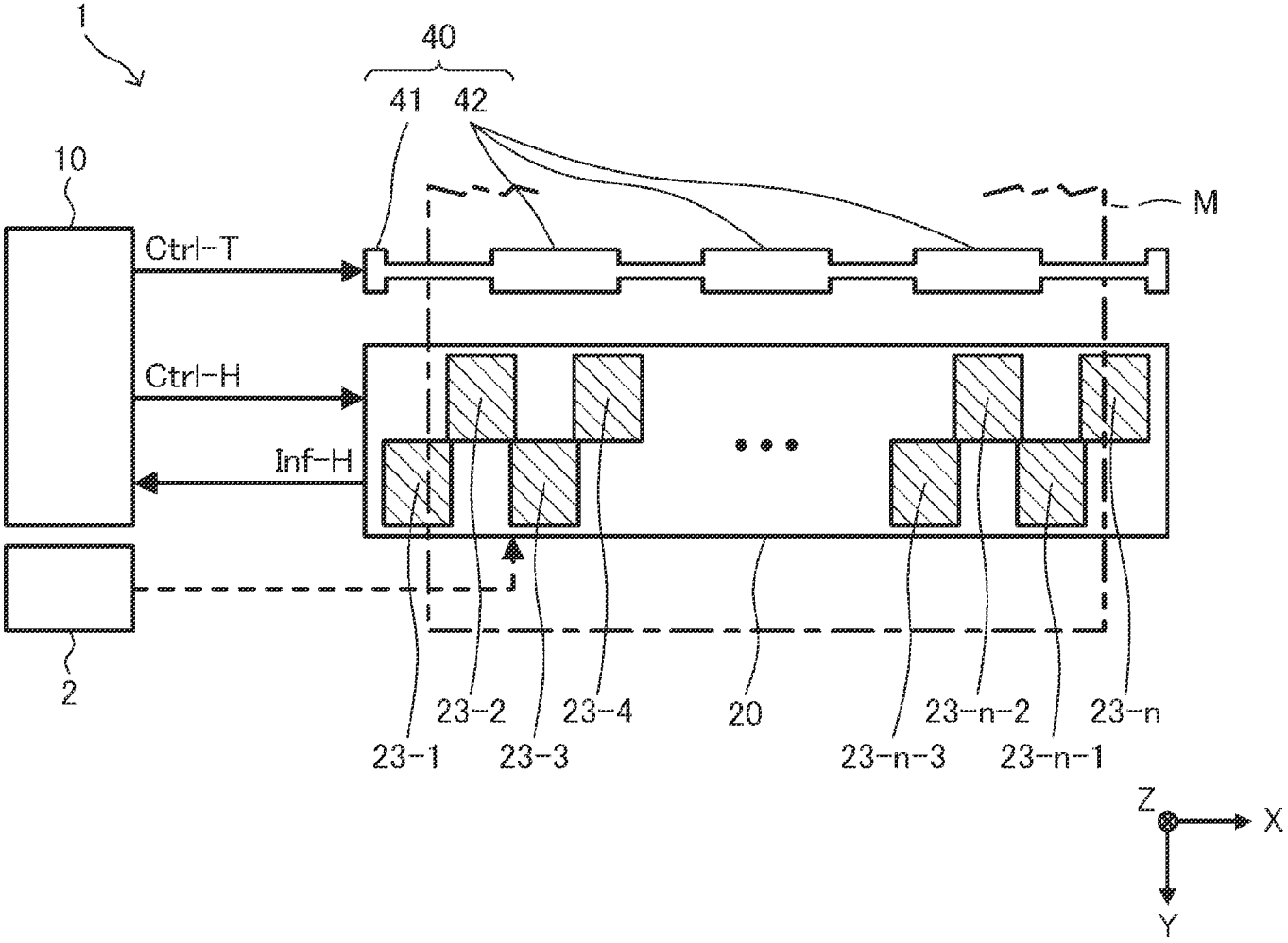
FIG. 1 is a diagram illustrating a schematic configuration of a liquid discharge apparatus.

FIG. 1 is a diagram illustrating a schematic configuration of a liquid discharge apparatus 1. As illustrated in FIG. 1, the liquid discharge apparatus 1 according to the present embodiment is a so-called line head type ink jet printer that forms a desired image on a medium M in such a way that ink discharged from a head unit 20 provided to be equal to or larger than a width of the medium M lands on the medium M transported by a transport mechanism 40. Here, in the following description, description will be performed while it is assumed that a width direction of the medium M is an X direction, a direction in which the medium M is transported is a Y direction, and a direction in which the ink is discharged from the head unit 20 is a Z direction. In addition, in the following description, there is a case where a starting point side of an arrow indicating the X direction illustrated in the drawing is referred to as a −X side, and a tip end side is referred to as an +X side, a starting point side of an arrow indicating the Y direction in the drawing is referred to as a −Y side and a tip end side is referred to as a +Y side, and a starting point side of an arrow indicating the Z direction in the drawing is referred to as a −Z side and a tip end side is referred to as a +Z side.

Not that, in the following description, description will be performed while it is assumed that the X direction, the Y direction, and the Z direction are directions orthogonal to each other, but configurations of the liquid discharge apparatus 1 are not limited to being disposed to be orthogonal to each other. In addition, a random printing target, such as printing paper, a resin film, or a fabric, may be used as the medium M. Here, the Z direction is an example of a vertical direction according to the embodiment.

Here, the vertical direction of the liquid discharge apparatus 1 means, in a narrow sense, a direction of gravity in a state in which the liquid discharge apparatus 1 is installed, but, in a broader sense, includes a direction orthogonal to an installation surface of the liquid discharge apparatus 1 in a state in which the liquid discharge apparatus 1 may be installed. For example, when the liquid discharge apparatus 1 includes a housing and the liquid discharge apparatus 1 is installed while one surface of the housing is used as a bottom surface, the bottom surface corresponds to the installation surface, and a direction orthogonal to the bottom surface corresponds to the vertical direction in a broad sense. In addition, for example, when the liquid discharge apparatus 1 includes the housing and a plurality of legs attached to the housing, and the liquid discharge apparatus 1 is installed in a state of being supported by the plurality of legs, a direction orthogonal to a straight line, which connects at least two of the plurality of legs, corresponds to the vertical direction in a broad sense.

Similarly, a vertical direction of the head unit 20 means, in the narrow sense, the direction of gravity in a state in which the head unit 20 is installed, but, in a broader sense, includes a direction orthogonal to an installation surface of the head unit 20 in a state in which the head unit 20 may be installed and, for example, a direction in which the ink is discharged from the head unit 20.

As illustrated in FIG. 1, the liquid discharge apparatus 1 includes a liquid container 2, a control mechanism 10, a head unit 20, and a transport mechanism 40.

The liquid container 2 stores the ink as an example of liquid to be supplied to the head unit 20. Specifically, a plurality of types of ink discharged to the medium M are stored in the liquid container 2. A color of black, a color of cyan, a color of magenta, a color of yellow, a color of red, a color of gray, and the like are exemplified as colors of the ink stored in the liquid container 2. An ink cartridge, a bursiform ink pack formed of a flexible film, an ink tank capable of supplying the ink, or the like is used as the liquid container 2 which stores the ink. The liquid container 2 that supplies ink to the head unit 20 is an example of a liquid storage.

The control mechanism 10 includes, for example, a processing circuit, such as a Central Processing Unit (CPU) or a Field Programmable Gate Array (FPGA), and a storage circuit, such as a semiconductor memory, and controls respective components of the liquid discharge apparatus 1.

The head unit 20 includes print heads 23-1 to **23-*n*. In the head unit 20, the print heads 23-1 to 23-*n* are provided in line to be equal to or larger than the width of the medium M in the X direction which is the width direction of the medium M. Specifically, the print heads 23-1 to 23-*n* are disposed in a zigzag pattern along the X direction. A length formed by the print heads 23-1 to 23-*n* disposed in the zigzag pattern in the X direction is equal to or larger than the width of the medium M. Here, a fact that the print heads 23-1 to 23-*n* are disposed in the zigzag pattern along the X direction means that the print heads 23-1 to 23-*n*** provided in line in the X direction are disposed to be alternately shifted in the Y direction.

A control signal Ctrl-H for controlling each of the print heads 23-1 to **23-*n* is input to the head unit 20 from the control mechanism 10. Each of the print heads 23-1 to 23-*n* discharges the ink to be supplied from the liquid container 2** based on the input control signal Ctrl-H.

In addition, the head unit 20 also generates a state information signal Inf-H indicating a state of the head unit 20, and outputs the state information signal Inf-H to the control mechanism 10. The control mechanism 10 recognizes an operating state of the head unit 20 based on the state information signal Inf-H. Further, the control mechanism 10 controls an operation of the head unit 20 by executing various processes, such as a correction process of the control signal Ctrl-H, according to the operating state of the head unit 20.

The transport mechanism 40 includes a transport motor 41 and a transport roller 42. The transport motor 41 operates based on a control signal Ctrl-T input from the control mechanism 10. Further, the transport roller 42 rotates according to an operation of the transport motor 41. The medium M is transported in the Y direction in accordance with rotation of the transport roller 42.

As described above, in a case where the ink is discharged from the head unit 20 in association with the transport of the medium M by the transport mechanism 40, the liquid discharge apparatus 1 causes the ink to be landed at a desired location on a surface of the medium M so that a desired image is formed on the medium M.

Figure 2:
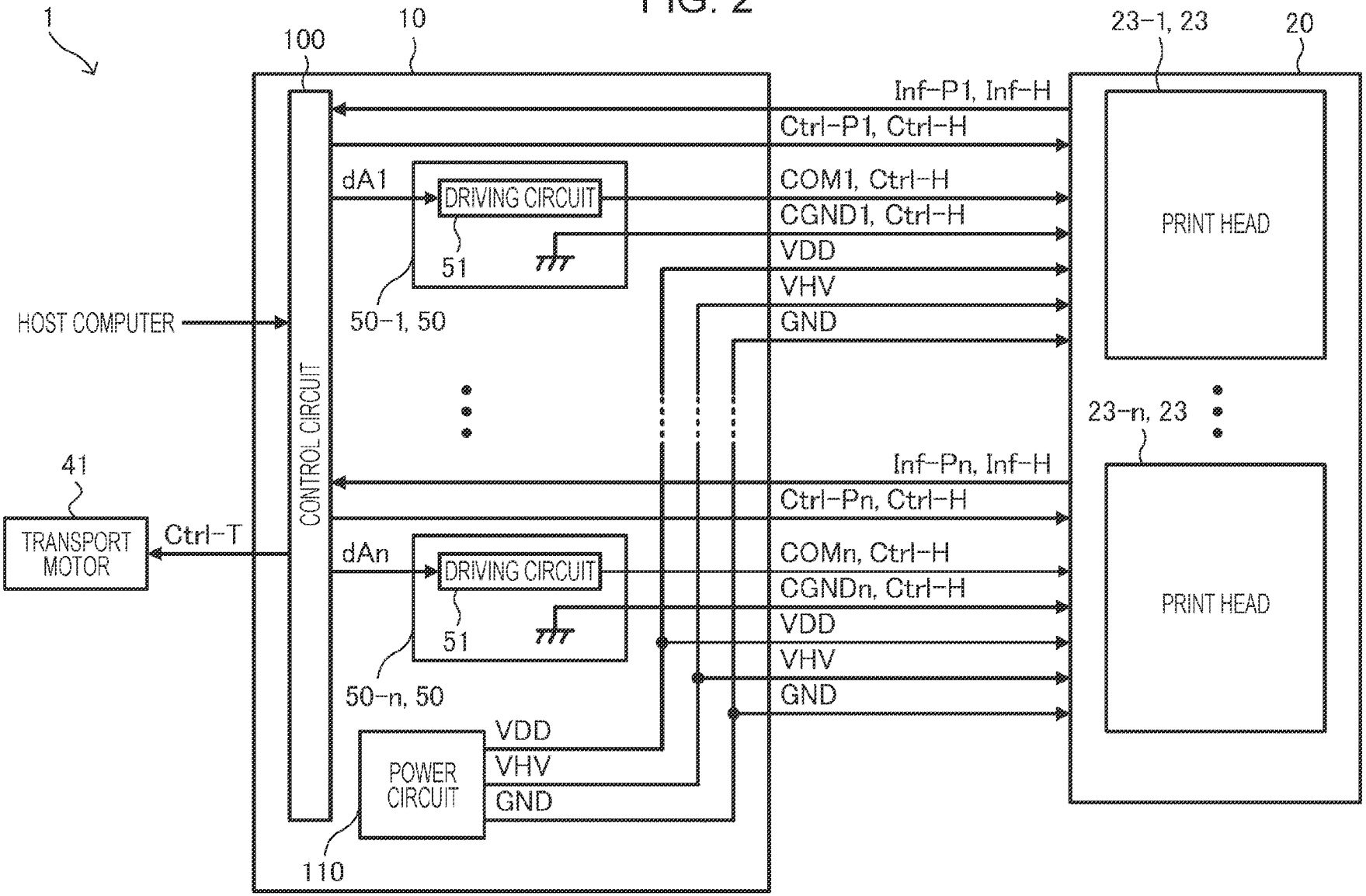
FIG. 2 is a block diagram illustrating an electrical configuration of the liquid discharge apparatus.

1.2 Electrical Configuration of Liquid Discharge Apparatus 1.2.1 Electrical Configuration of Liquid Discharge Apparatus FIG. 2 is a block diagram illustrating an electrical configuration of the liquid discharge apparatus 1. The liquid discharge apparatus 1 includes the control mechanism 10, the head unit 20, and the transport motor 41. In addition, the control mechanism 10 includes driving signal output circuits 50-1 to **50-*n*, a control circuit 100, and a power circuit 110, and the head unit 20 includes the print heads 23-1 to 23-*n***.

The control circuit 100 includes an integrated circuit having, for example, a processor such as a microcontroller. Further, the control circuit 100 generates and outputs data and various signals for controlling the liquid discharge apparatus 1 based on various signals such as image data input from a host computer.

The control circuit 100 outputs the control signal Ctrl-T to the transport motor 41. Therefore, the transport of the medium M is controlled. Note that, the control signal Ctrl-T may be input to the transport motor 41 after signal conversion is performed through a not-shown transport motor driver.

In addition, the control circuit 100 generates the control signal Ctrl-H based on the various signals such as the image data input from the host computer, and outputs the control signal Ctrl-H to the head unit 20. Specifically, the control circuit 100 generates control signals Ctrl-P1 to Ctrl-Pn corresponding to the respective print heads 23-1 to **23-*n* included in the head unit 20 as the control signal Ctrl-H, and outputs the control signals Ctrl-P1 to Ctrl-Pn to the relevant print heads 23-1 to 23-*n*. That is, the control circuit 100 generates the control signal Ctrl-P1 as the control signal Ctrl-H based on the various signals such as the image data input from the host computer, and outputs the control signal Ctrl-P1 to the relevant print head 23-1. Similarly, the control circuit 100 generates a control signal Ctrl-Pi Ci is any of 1 to n) as the control signal Ctrl-H based on the various signals such as the image data input from the host computer, and outputs the control signal Ctrl-Pi to a relevant print head 23-*i***.

In addition, the control circuit 100 generates drive control signals dA1 to dAn corresponding to the respective driving signal output circuits 50-1 to **50-*n*, and outputs the drive control signals dA1 to dAn to the relevant driving signal output circuits 50-1 to 50-*n*. Each of the driving signal output circuits 50-1 to 50-*n* includes a driving circuit 51. Further, the driving signal output circuits 50-1 to 50-*n* respectively generate driving signals COM1 to COMn corresponding to the input drive control signals dA1 to dAn, and output the driving signals COM1 to COMn to the relevant print heads 23-1 to 23-*n*** as the control signal Ctrl-H.

That is, the control circuit 100 generates the drive control signal dA1, and outputs the drive control signal dA1 to the relevant driving signal output circuit 50-1. After the driving circuit 51 included in the driving signal output circuit 50-1 performs digital/analog conversion on the input drive control signal dA1, the driving circuit 51 generates the driving signal COM1 as the control signal Ctrl-H by performing class D amplification on an analog signal acquired through the conversion, and outputs the driving signal COM1 to the relevant print head 23-1. Similarly, the control circuit 100 generates the drive control signal dAi, and outputs the drive control signal dAi to the relevant driving signal output circuit **50-*i*. After the driving circuit 51 included in the driving signal output circuit 50-*i* performs the digital/analog conversion on the input drive control signal dAi which is input from the control circuit 100, the driving circuit 51 generates the driving signal COMi as the control signal Ctrl-H by performing the class D amplification on an analog signal acquired through the conversion, and outputs the driving signal COMi to the relevant print head 23-*i***.

Here, the driving circuit 51 included in each of the driving signal output circuits 50-1 generates the driving signals COM1 to COMn by performing the class D amplification on waveforms prescribed by the respective drive control signals dA1 to dAn. Therefore, the respective drive control signals dA1 to dAn may be signals that can prescribe the waveforms of the relevant driving signals COM1 to COMn, and, for example, may be analog signals. In addition, the driving circuit 51 may generate the driving signals COM1 to COMn by amplifying the waveforms prescribed by the respective drive control signals dA1 to dAn, and may include circuits for class A amplification, class B amplification, class AB amplification, and the like.

In addition, the respective driving signal output circuits 50-1 to **50-*n* generate, for example, reference voltage signals CGND1 to CGNDn of ground potentials (0V) indicating reference potentials of the respective driving signals COM1 to COMn, and output the reference voltage signals CGND1 to CGNDn to the relevant print heads 23-1 to 23-*n* as the control signal Ctrl-H. That is, the driving signal output circuit 50-1 generates the reference voltage signal CGND1 as the control signal Ctrl-H indicating the reference potential of the driving signal COM1, and outputs the reference voltage signal CGND1 to the relevant print head 23-1. Similarly, the driving signal output circuit 50-*i* generates the reference voltage signal CGNDi as the control signal Ctrl-H indicating the reference potential of the driving signal COMi, and outputs the reference voltage signal CGNDi to the relevant print head 23-*i***.

Note that, voltage values of the reference voltage signals CGND1 to CGNDn output by the driving signal output circuits 50-1 to **50-*n*** are not limited to the signals having the ground potential, and may be signals having DC voltages such as DC 6 V and DC 5.5 V.

The power circuit 110 generates and outputs a high voltage signal VHV, a low voltage signal VDD, and a ground signal GND. The high voltage signal VHV is, for example, a signal having a voltage value of DC 42 V. In addition, the low voltage signal VDD is, for example, a signal having a voltage value of 3.3 V. In addition, the ground signal GND is a signal indicating reference potentials of the high voltage signal VHV and the low voltage signal VDD, and, for example, is a signal having a voltage value of ground potential (0 V). The high voltage signal VHV is used as a voltage for amplification in each of the driving signal output circuits 50-1 to **50-*n*. In addition, each of the low voltage signal VDD and the ground signal GND is used for power voltages or the like of various components in the control mechanism 10**.

In addition, the high voltage signal VHV, the low voltage signal VDD, and the ground signal GND are output to each of the print heads 23-1 to **23-*n* included in the head unit 20. Note that, the respective voltage values of the high voltage signal VHV, the low voltage signal VDD, and the ground signal GND, which are generated by the power circuit 110, are not limited to the above-described DC 42 V, DC 3.3 V, and 0 V. In addition, the power circuit 110** may generate and output voltage signals having a plurality of voltage values, other than the high voltage signal VHV, the low voltage signal VDD, and the ground signal GND.

As described above, the control mechanism 10 supplies the relevant control signals Ctrl-P1 to Ctrl-Pn, the relevant driving signals COM1 to COMn, and the relevant reference voltage signals CGND1 to CGNDn as the control signal Ctrl-H with respect to the respective print heads 23-1 to **23-*n* included in the head unit 20, and supplies the high voltage signal VHV, the low voltage signal VDD, and the ground signal GND, which are used for the voltage power of the print heads 23-1 to 23-*n* included in the head unit 20**.

Here, although the liquid discharge apparatus 1 illustrated in FIG. 2 is illustrated as the control mechanism 10 includes one control circuit 100, and one control circuit 100 outputs the control signals Ctrl-P1 to Ctrl-Pn, the driving signals COM1 to COMn, and the reference voltage signals CGND1 to CGNDn, which correspond to the respective print heads 23-1 to **23-*n*, the control circuit 100 may be configured to include a plurality of integrated circuits. For example, the control mechanism 10 may include a plurality of integrated circuits including a processor, such as a microcontroller, that generates the control signals Ctrl-P1 to Ctrl-Pn corresponding to the respective print heads 23-1 to 23-*n* as the control circuit 100. In addition, the control mechanism 10 may be configured to include a plurality of circuit substrates and a plurality of circuits. Further, the control mechanism 10** may include a plurality of circuits, such as a filter circuit, a buffer circuit, and a relay circuit, in addition to the processor such as the microcontroller.

The head unit 20 includes the print heads 23-1 to **23-*n*. Among the control signals Ctrl-P1 to Ctrl-Pn, the driving signals COM1 to COMn, the reference voltage signals CGND1 to CGNDn, the high voltage signal VHV, the low voltage signal VDD, and the ground signal GND, which are output by the control mechanism 10, a relevant signal is input to each of the print heads 23-1 to 23-*n***.

In addition, the respective print heads 23-1 to **32-*n* generate state information signals Inf-P1 to Inf-Pn as the state information signal Inf-H indicating the state of each of the print heads 23-1 to 32-*n*, and outputs the state information signals Inf-P1 to Inf-Pn to the control circuit 100. Specifically, the print head 23-1 generates the state information signal Inf-P1 as the state information signal Inf-H indicating the state of the print head 23-1, and outputs the state information signal Inf-P1 to the control circuit 100. Similarly, the print head 23-*i* generates the state information signal Inf-Pi as the state information signal Inf-H indicating the state of the print head 23-*i* and outputs the state information signal Inf-Pi to the control circuit 100**.

The control circuit 100 can individually recognize the operating states of the respective print heads 23-1 to **23-*n* based on the input state information signals Inf-P1 to Inf-Pn. Further, the control circuit 100 performs the correction process or the like on each of the control signals Ctrl-P1 to Ctrl-Pn, the driving signals COM1 to COMn, and the reference voltage signals CGND1 to CGNDn according to the operating states of the respective print heads 23-1 to 23-*n*, and outputs each of the control signals Ctrl-P1 to Ctrl-Pn, the driving signals COM1 to COMn, and the reference voltage signals CGND1 to CGNDn, on which the correction process is performed, to the relevant print heads 23-1 to 23-*n***.

Here, the correction process executed by the control circuit 100 based on the state information signals Inf-P1 to Inf-Pn includes output stop of the control signals Ctrl-P1 to Ctrl-Pn, the driving signals COM1 to COMn, and the reference voltage signals CGND1 to CGNDn, and output of the control signals Ctrl-P1 to Ctrl-Pn for stopping the respective print heads 23-1 to **23-*n***, in addition to the correction of the voltage values, frequencies, pulse widths, and the like of the control signals Ctrl-P1 to Ctrl-Pn, the driving signals COM1 to COMn, and the reference voltage signals CGND1 to CGNDn.

Next, a specific electrical configuration of the print heads 23-1 to **23-*n* included in the head unit 20 will be described with reference to FIGS. 3A and 3B. Note that, in the embodiment, all the print heads 23-1 to 23-*n* have the same configuration. Therefore, in the following description, when it is not necessary to distinguish the print heads 23-1 to 23-*n*, there is a case where the print heads 23-1 to 23-*n* are simply referred to as a print head 23. Further, there is a case where the control signals Ctrl-P1 to Ctrl-Pn, which are input to the print head 23, are referred to as a control signal Ctrl-P, the driving signals COM1 to COMn, which are input to the print head 23, are referred to as a driving signal COM, the reference voltage signals CGND1 to CGNDn, which are input to the print head 23, are referred to as a reference voltage signal CGND, and the state information signals Inf-P1 to Inf-Pn, which are output from the print head 23, are referred to as state information signal Inf-P. In addition, there is a case where the driving signal output circuits 50-1 to 50-*n*, which output the driving signal COM, are referred to as a driving signal output circuit 50, and the drive control signals dA1 to dAn, which are input to the driving signal output circuit 50**, are referred to as a drive control signal dA.

Figure 3A:
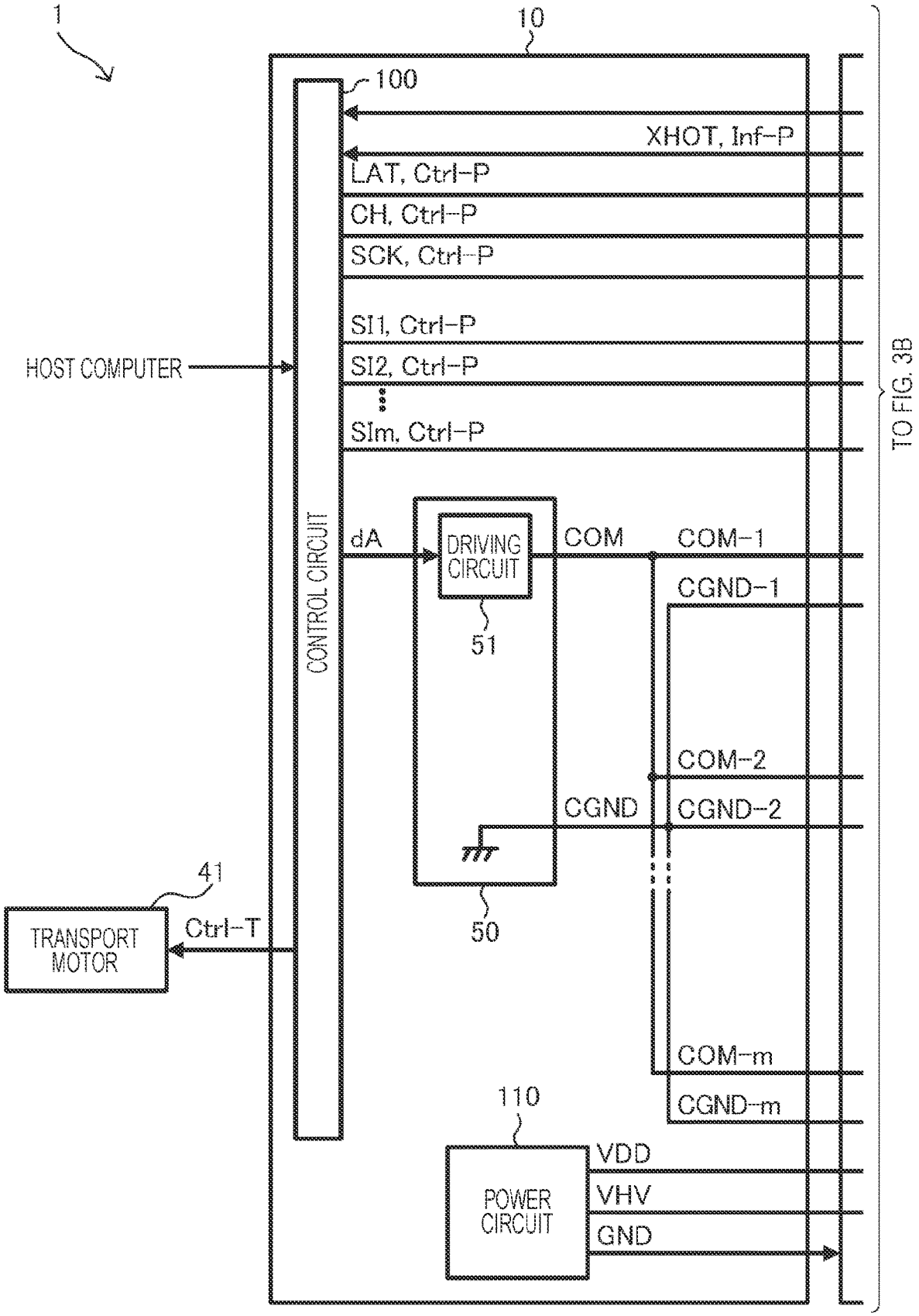
FIG. 3A is a first half of a block diagram illustrating an electrical configuration of a print head.
Figure 3B:
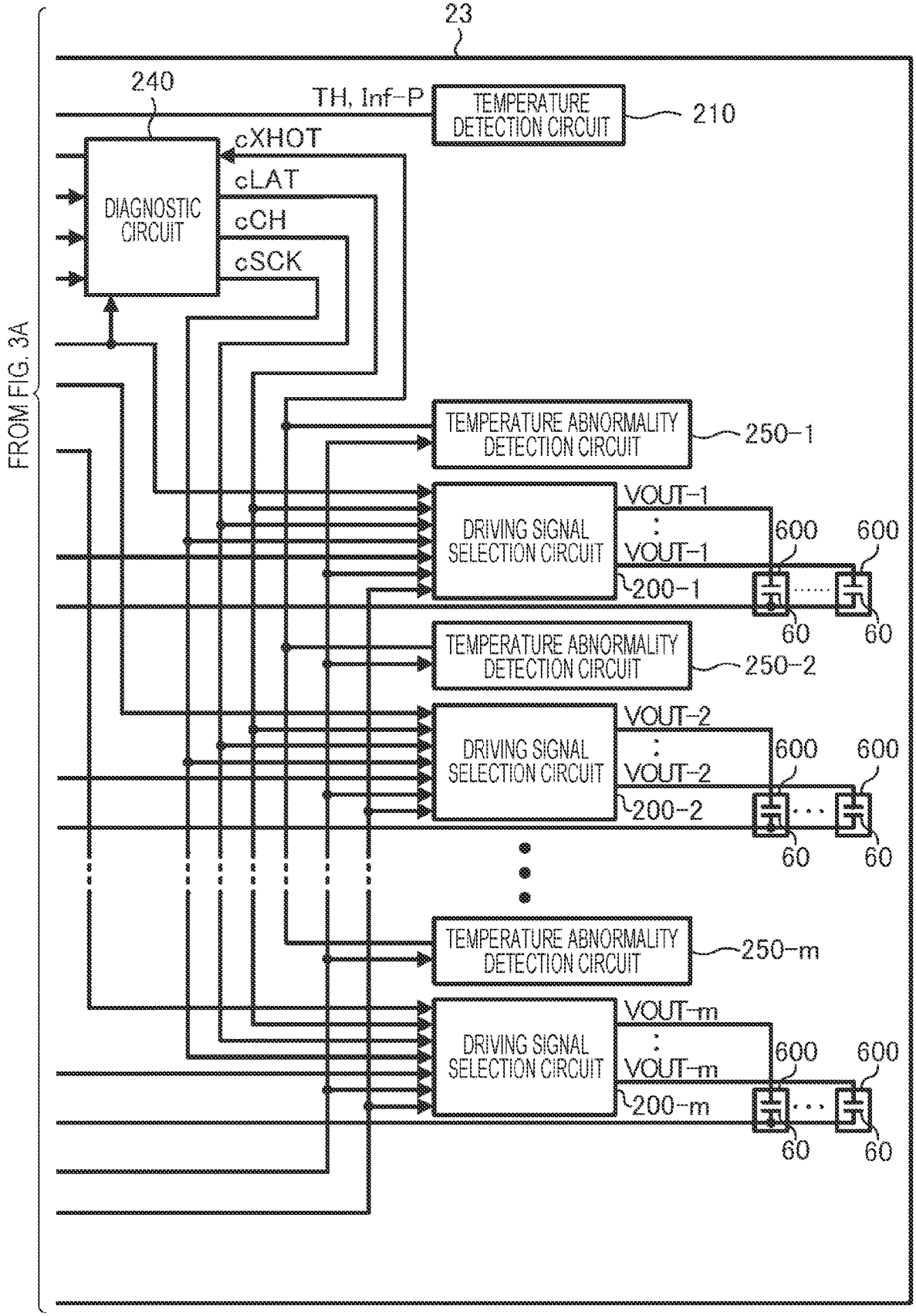
FIG. 3B is a second half of the block diagram illustrating the electrical configuration of the print head.

FIGS. 3A and 3B are block diagrams illustrating the electrical configuration of the print head 23. As illustrated in FIGS. 3A and 3B, the control circuit 100 generates print data signals SI1 to SIm, a change signal CH, a latch signal LAT, and a clock signal SCK, which are the digital signals, as the control signal Ctrl-P for controlling the print head 23 based on various signals, such as the image data, which are input from the host computer, and outputs the generated signals to the print head 23.

Here, the control circuit 100, which outputs at least any of the print data signals SI1 to SIm, the change signal CH, the latch signal LAT, and the clock signal SCK, which are the digital signals, with respect to the head unit 20 including the print head 23 and discharging the ink, is an example of a digital signal output circuit, and at least any of the print data signals SI1 to SIm, the change signal CH, the latch signal LAT, and the clock signal SCK is an example of the digital signal.

In addition, the driving signal COM and the reference voltage signal CGND, which are output to the print head 23 from the driving signal output circuit 50 included in the control mechanism 10, are output to the print head 23 after being branched in the control mechanism 10. Specifically, the driving signal COM is output to the print head 23 after branching off to m number of driving signals COM-1 to COM-m, which respectively correspond to driving signal selection circuits 200-1 to **200-*m*, which will be described later, in the control mechanism 10. Similarly, the reference voltage signal CGND is output to the print head 23 after branching off to m number of reference voltage signals CGND-1 to CGND-m in the control mechanism 10. Note that, in the following description, although the driving signals COM-1 to COM-m are described as signals having the same waveform output from one driving circuit 51, the driving signals COM-1 to COM-m may be different waveforms. In this case, the driving signal output circuit 50 may include a plurality of driving circuits 51**.

The print head 23 includes m number of driving signal selection circuits 200-1 to **200-*m*, a temperature detection circuit 210, m number of temperature abnormality detection circuits 250-1 to 250-*m*, a plurality of discharge sections 600, and a diagnostic circuit 240**.

The print data signal SI1, the change signal CH, the latch signal LAT, and the clock signal SCK are input to the diagnostic circuit 240. The diagnostic circuit 240 diagnoses whether or not it is possible to normally discharge the ink in the print head 23 based on the print data signal SI1, the change signal CH, the latch signal LAT, and the clock signal SCK. In other words, the diagnostic circuit 240 diagnoses presence or absence of abnormality of the print head 23. Further, the diagnostic circuit 240 outputs an abnormality signal XHOT indicating the presence or absence of the abnormality of the print head 23 as the state information signal Inf-P. That is, the print head 23 has a function of performing self-diagnosis based on the print data signal SI1, the change signal CH, the latch signal LAT, and the clock signal SCK.

For example, the diagnostic circuit 240 may detect the respective voltage values of the print data signal SI1, the change signal CH, the latch signal LAT, and the clock signal SCK, which are input, and may diagnose whether or not electrical coupling between the control mechanism 10 and the print head 23 is normal based on the detected voltage values. In addition, for example, the diagnostic circuit 240 may detect a timing at which the print data signal SI1, the change signal CH, the latch signal LAT, and the clock signal SCK are input, and may diagnose whether or not the waveforms of the print data signal SI1, the change signal CH, the latch signal LAT, and the clock signal SCK, which are input to the print head 23, are normal based on the detected timing of the signals.

As above, the diagnostic circuit 240 detects whether or not the print data signal SI1, the change signal CH, the latch signal LAT, and the clock signal SCK, which are input, are normal, and diagnoses whether or not it is possible to normally discharge the ink in the print head 23 based on a result of the detection. That is, the diagnostic circuit 240 diagnoses whether or not it is possible to normally discharge the ink as the self-diagnosis of the print head 23. Further, when the abnormality does not occur in the print head 23, the diagnostic circuit 240 outputs the abnormality signal XHOT at a logical level of one side of a high level and a low level. When the abnormality occurs in the print head 23, the diagnostic circuit 240 outputs the abnormality signal XHOT at a logical level of the other side of the high level and the low level.

In addition, when the diagnostic circuit 240 diagnoses that the print data signal SI1, the change signal CH, the latch signal LAT, and the clock signal SCK are normal, the diagnostic circuit 240 outputs a change signal cCH, a latch signal cLAT, and a clock signal cSCK. Here, the change signal cCH, the latch signal cLAT, and the clock signal cSCK may be signals having waveforms which are the same as those of the change signal CH, the latch signal LAT, and the clock signal SCK which are input to the diagnostic circuit 240. In addition, the change signal cCH, the latch signal cLAT, and the clock signal cSCK may be signals having waveforms acquired by performing the correction process on the change signal CH, the latch signal LAT, and the clock signal SCK. In addition, the change signal cCH, the latch signal cLAT, and the clock signal cSCK may be signals having waveforms which are different from those of the change signal CH, the latch signal LAT, and the clock signal SCK acquired through conversion based on the change signal CH, the latch signal LAT, and the clock signal SCK. The diagnostic circuit 240 as described above includes, for example, one or a plurality of Integrated Circuit (IC) devices.

In addition, after the print data signal SI1 in the signals, which are input to the diagnostic circuit 240, branches off in the print head 23, one of the branching signals is input to the diagnostic circuit 240, and the other signal is input to the driving signal selection circuit 200-1 which will be described later. The print data signal SI1 is a signal having a high transmission rate, compared to the latch signal LAT and the change signal CH. After the print data signal SI1 branches off in the print head 23, only one of the branching signals is input to the diagnostic circuit 240, and thus it is possible to reduce a possibility that distortion occurs in the waveform of the print data signal SI1 which is input to the driving signal selection circuit 200-1 due to an operation of the diagnostic circuit 240. That is, it is possible to improve accuracy of diagnosis of whether or not the ink can be normally discharged from the print head 23 in the diagnostic circuit 240.

The respective driving signal selection circuits 200-1 to **200-*m* generate driving signals VOUT-1 to VOUT-m by performing selection or non-selection on the waveforms of the driving signals COM-1 to COM-m based on the print data signals SI1 to SIm, the clock signal cSCK, the latch signal cLAT, and the change signal cCH, which are input. Further, the respective driving signal selection circuits 200-1 to 200-*m* supply the generated driving signals VOUT-1 to VOUT-m to piezoelectric elements 60 included in relevant discharge sections 600. The piezoelectric elements 60 are displaced when the driving signals VOUT-1 to VOUT-m are supplied. Further, an amount of ink according to the displacement is discharged from the discharge sections 600**.

Specifically, the driving signal COM-1, the print data signal SI1, the latch signal cLAT, the change signal cCH, and the clock signal cSCK are input to the driving signal selection circuit 200-1 included in the print head 23. Further, the driving signal selection circuit 200-1 generates the driving signal VOUT-1 by performing selection or non-selection on the waveform of the driving signal COM-1 based on the print data signal SI1, the latch signal cLAT, the change signal cCH, and the clock signal cSCK. The driving signal VOUT-1 is supplied to one end of the piezoelectric element 60 of the relevantly provided discharge section 600. In addition, the reference voltage signal CGND-1 is supplied to the other end of the piezoelectric element 60. Further, the piezoelectric element 60 displaces according to a potential difference between the driving signal VOUT-1 and the reference voltage signal CGND-1.

Similarly, a driving signal COMj, a print data signal SIj, the latch signal cLAT, the change signal cCH, and the clock signal cSCK are input to a driving signal selection circuit **200-*j* (j is any one of 1 to m) included in the print head 23. Further, a driving signal selection circuit 200-*i* generates and outputs a driving signal VOUT-j by performing selection or non-selection on a waveform of the driving signal COM-j based on a print data signal SIj, the latch signal cLAT, the change signal cCH, and the clock signal cSCK. The driving signal VOUT-j is supplied to one end of the piezoelectric element 60 of the relevantly provided discharge section 600. In addition, the reference voltage signal CGND-j is supplied to the other end of the piezoelectric element 60. Further, the piezoelectric element 60 displaces according to a potential difference between the driving signal VOUT-j and the reference voltage signal CGND-j. Each of the driving signal selection circuits 200-1 to 200-*i* included in the print head 23** described above is configured as, for example, an integrated circuit device.

The temperature detection circuit 210 includes a not-shown temperature sensor such as a thermistor. The temperature sensor detects a temperature of the print head 23. Further, the temperature detection circuit 210 generates a temperature signal TH which is an analog signal including temperature information of the print head 23, and outputs the temperature signal TH to the control circuit 100 as the state information signal Inf-P.

The temperature abnormality detection circuits 250-1 to **250-*m* are provided to correspond to the respective driving signal selection circuits 200-1 to 200-*m*. Further, each of the temperature abnormality detection circuits 250-1 to 250-*m* diagnoses presence or absence of temperature abnormality of each of the relevant driving signal selection circuits 200-1 to 200-*m*, and outputs digital abnormality signal cXHOT indicating whether or not temperature of each of the relevant driving signal selection circuits 200-1 to 200-*m* is abnormal. Specifically, each of the temperature abnormality detection circuits 250-1 to 250-*m* diagnoses whether or not the temperature of each of the relevant driving signal selection circuits 200-1 to 200-*m* is abnormal. Further, when it is determined that the temperature of each of the relevant driving signal selection circuits 200-1 to 200-*m* is normal, each of the temperature abnormality detection circuits 250-1 to 250-*m* generates the abnormality signal cXHOT at an H level and outputs the abnormality signal cXHOT to the diagnostic circuit 240. In addition, when it is determined that the temperature of each of the relevant driving signal selection circuits 200-1 to 200-*m* is abnormal, each of the temperature abnormality detection circuits 250-1 to 250-*m*** generates the abnormality signal XHOT at an L level and outputs the abnormality signal XHOT to the diagnostic circuit 240. Note that, the logical level of the abnormality signal cXHOT is an example. When it is determined that the temperature of the print head 23 is normal, the temperature abnormality detection circuits 250-1 to **250-*m* may generate the abnormality signal cXHOT at the L level. When it is determined that the temperature of the print head 23 is abnormal, the temperature abnormality detection circuits 250-1 to 250-*m*** may generate the abnormality signal cXHOT at the H level.

The diagnostic circuit 240 diagnoses whether or not the temperatures of the driving signal selection circuits 200-1 to **200-*m* are normal according to the logical level of the input abnormality signal cXHOT. Further, when the temperatures of the driving signal selection circuits 200-1 to 200-*m* are normal, the diagnostic circuit 240 outputs the abnormality signal XHOT at a logical level of any one of the high level or the low level to the control circuit 100, and, when the temperatures of the driving signal selection circuits 200-1 to 200-*m* are not normal, the diagnostic circuit 240 outputs the abnormality signal XHOT at a logical level of the other one of the high level and the low level to the control circuit 100. That is, the diagnostic circuit 240 determines the abnormality of the print head 23 based on the logical level of the input abnormality signal cXHOT, and outputs the abnormality signal XHOT according to a result of the determination as the state information signal Inf-P. Note that, the diagnostic circuit 240** may output the abnormality signal cXHOT, which is input, as the abnormality signal XHOT.

The control circuit 100 performs various processes, such as stop of the operation of the liquid discharge apparatus 1 and correction of the waveform of the driving signal COM, according to the temperature signal TH and the abnormality signal XHOT, which are input. That is, the abnormality signal XHOT is an example of an abnormality signal indicating presence or absence of the abnormality of the print head 23 and the driving signal selection circuits 200-1 to **200-*m*. Therefore, it is possible to increase a discharge accuracy of the ink from the discharge section 600, and it is possible to prevent, in a print state, the operation abnormality, a failure, and the like of the print head 23 and the driving signal selection circuits 200-1 to 200-*m* from occurring in advance. That is, the diagnosis, which performed by the temperature abnormality detection circuits 250-1 to 250-*m*, of whether or not the temperatures of the print head 23 and the driving signal selection circuits 200-1 to 200-*m* are abnormal, is one of the self-diagnoses of the print head 23. Note that, each of the temperature abnormality detection circuits 250-1 to 250-*m* may be configured as an integrated circuit device. In addition, as described above, the respective temperature abnormality detection circuits 250-1 to 250-*m* are provided to correspond to the respective driving signal selection circuits 200-1 to 200-*m*. Therefore, each of the driving signal selection circuits 200-1 to 200-*m* and the relevant temperature abnormality detection circuits 250-1 to 250-*m*** may be configured as one integrated circuit device.

As described above, the liquid discharge apparatus 1 according to the embodiment includes the control mechanism 10 and the head unit 20 having the print heads 23-1 to **23-*n*. The control mechanism 10 outputs, as the control signal Ctrl-P1, the print data signals SI1 to SIm, the change signal CH, the latch signal LAT, the clock signal SCK, the driving signal COM1 including the driving signals COM-1 to COM-m, and the reference voltage signal CGND1 including the reference voltage signals CGND-1 to CGND-m with respect to the print head 23-1. The print head 23-1 discharges the ink to the medium M based on the control signal Ctrl-P1, the driving signal COM1, and the reference voltage signal CGND1**, which are input.

Similarly, the control mechanism 10 outputs, as the control signal Ctrl-Pi, the print data signals SI1 to SIm, the change signal CH, the latch signal LAT, the clock signal SCK, the driving signal COMi including the driving signals COM-1 to COM-m, and the reference voltage signal CGNDi including the reference voltage signals CGND-1 to CGND-m, with respect to the print head **23-*i*. The print head 23-*i* discharges the ink to the medium M based on the control signal Ctrl-Pi, the driving signal COMi, and the reference voltage signal CGNDi, which are input. As a result, the ink lands on a desired location of the medium M transported by the transport mechanism 40**, and a desired image is formed on the medium M.

Here, the driving signal selection circuits 200-1 to **200-*n* have the same circuit configuration. Therefore, in the description below, when it is not necessary to distinguish between the driving signal selection circuits 200-1 to 200-*n*, there is a case where the driving signal selection circuits 200-1 to 200-*n* are referred to as a driving signal selection circuit 200. In this case, description will be performed while it is assumed that the driving signal selection circuit 200 selects the waveform of the driving signal COM based on the print data signal SI to generate the driving signal VOUT to be supplied to the relevant piezoelectric element 60**.

1.2.2 Electrical Configuration of Driving Signal Selection Circuit

Next, an electrical configuration of the driving signal selection circuit 200 will be described. When the electrical configuration of the driving signal selection circuit 200 is described, an example of the waveform of the driving signal COM input to the driving signal selection circuit 200 and an example of the waveform of the driving signal VOUT generated based on the driving signal COM will be described first.

Figure 4:
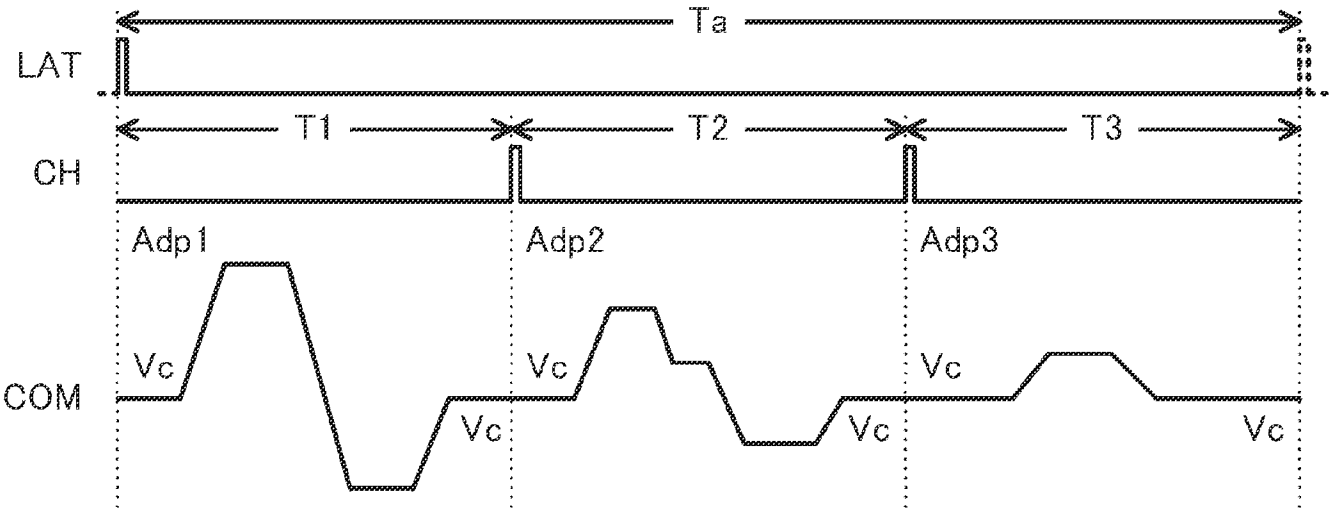
FIG. 4 is a diagram illustrating an example of a waveform of a driving signal.

FIG. 4 is a diagram illustrating the example of the waveform of the driving signal COM. As illustrated in FIG. 4, the driving signal COM is a waveform acquired by succeeding a trapezoid waveform Adp1 disposed in a period T1 from when the latch signal LAT rises to when the change signal CH rises, a trapezoid waveform Adp2 disposed in a period T2 until the change signal CH subsequently rises after the period T1, and a trapezoid waveform Adp3 disposed in a period T3 until the latch signal LAT subsequently rises after the period T2. Further, when the trapezoid waveform Adp1 is supplied to one end of the piezoelectric element 60, an intermediate amount of ink is discharged from the discharge section 600 corresponding to the piezoelectric element 60. In addition, when the trapezoid waveform Adp2 is supplied to one end of the piezoelectric element 60, a small amount, which is less than the intermediate amount, of ink is discharged from the discharge section 600 corresponding to the piezoelectric element 60. In addition, when the trapezoid waveform Adp3 is supplied to one end of the piezoelectric element 60, the ink is not discharged from the discharge section 600 corresponding to the piezoelectric element 60. Here, the trapezoid waveform Adp3 is a waveform for preventing ink viscosity from increasing by slightly vibrating the ink in a vicinity of a nozzle opening section of the discharge section 600.

Here, a cycle Ta, from when the latch signal LAT illustrated in FIG. 4 rises to when the latch signal LAT subsequently rises, corresponds to a print cycle at which a new dot is formed on the medium M. That is, the latch signal LAT is also a signal for prescribing an ink discharge timing. In other words, the latch signal LAT serves both as a signal for performing the self-diagnosis of the print head 23 and a signal for prescribing the ink discharge timing. In addition, the change signal CH is also a signal for prescribing a waveform switching timing of the trapezoid waveforms Adp1, Adp2, and Adp3 included in the driving signal COM. In other words, the change signal CH serves both as the signal for performing the self-diagnosis of the print head 23 and a signal for prescribing a waveform switching timing of the driving signal COM.

Note that, all voltages at timings, at which the respective trapezoid waveforms Adp1, Adp2, and Adp3 start and end, are common to a voltage Vc. That is, the respective trapezoid waveforms Adp1, Adp2, and Adp3 are waveforms which start with the voltage Vc and end with the voltage Vc. Note that, the driving signal COM may be, at the cycle Ta, a signal having a waveform acquired by succeeding one or two trapezoid waveforms or may be a signal having a waveform acquired by succeeding four or more trapezoid waveforms.

Figure 5:
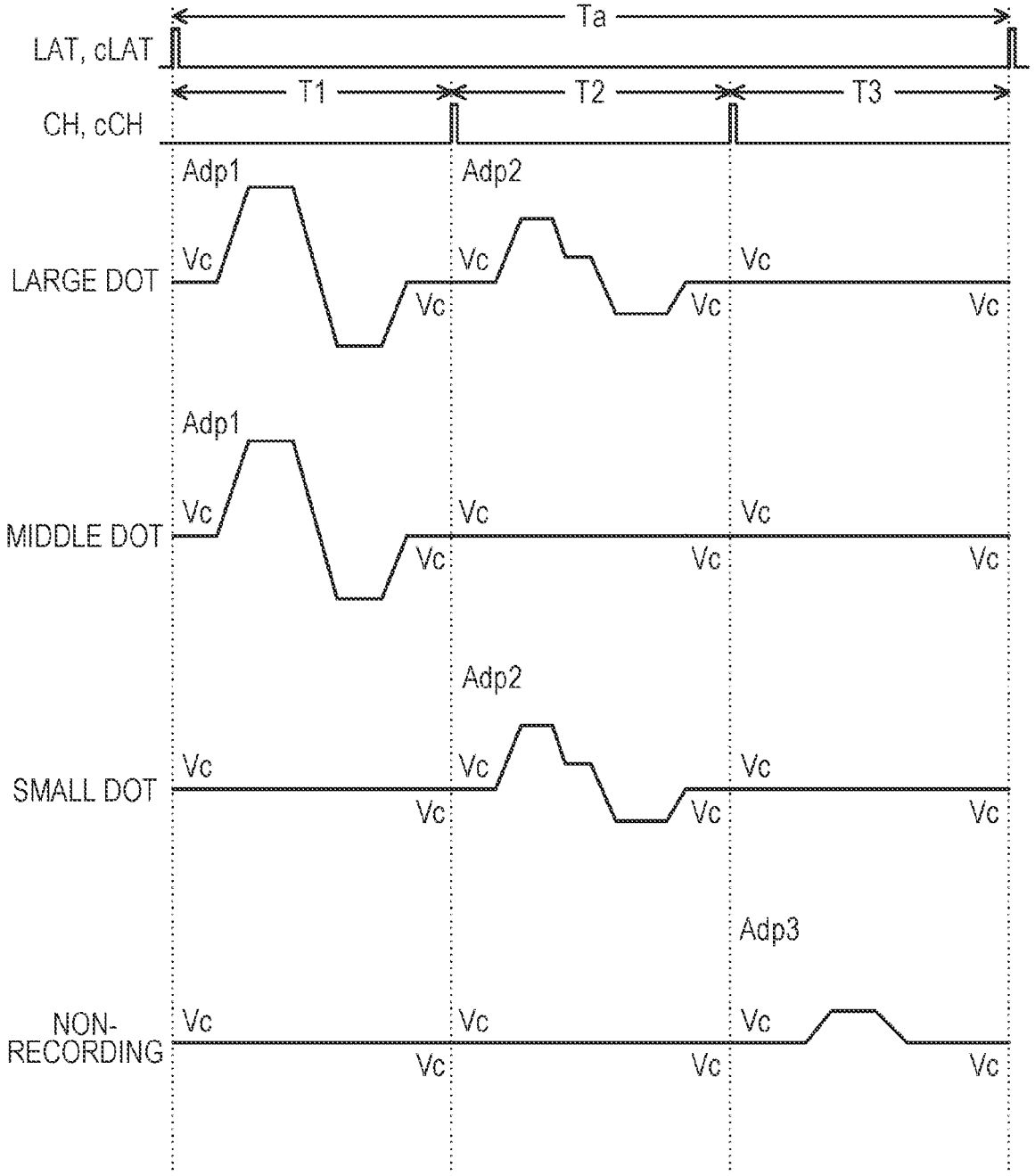
FIG. 5 is a diagram illustrating an example of a waveform of a driving signal.

FIG. 5 is a diagram illustrating an example of a waveform of the driving signal VOUT corresponding to each of a "large dot", a "middle dot", a "small dot", and a "non-recording".

As illustrated in FIG. 5, the driving signal VOUT corresponding to the "large dot" has a waveform acquired by succeeding, at the cycle Ta, the trapezoid waveform Adp1 disposed in the period T1, the trapezoid waveform Adp2 disposed in the period T2, and a voltage waveform disposed in the period T3 to be fixed at the voltage Vc. When the driving signal VOUT is supplied to one end of the piezoelectric element 60, an intermediate amount of ink and a small amount of ink are discharged from the discharge section 600 corresponding to the piezoelectric element 60 at the cycle Ta. Therefore, the ink lands and coalesces on the medium M, and thus the large dot is formed.

The driving signal VOUT corresponding to the "middle dot" is a waveform acquired by succeeding, at the cycle Ta, the trapezoid waveform Adp1 disposed in the period T1 and a voltage waveform disposed in the periods T2 and T3 to be fixed at the voltage Vc. When the driving signal VOUT is supplied to one end of the piezoelectric element 60, an intermediate amount of ink is discharged from the discharge section 600 corresponding to the piezoelectric element 60 at the cycle Ta. Therefore, the ink lands on the medium M, and thus the middle dot is formed.

The driving signal VOUT corresponding to the "small dot" is a waveform acquired by succeeding, at the cycle Ta, the voltage waveforms disposed in the periods T1 and T3 to be fixed at the voltage Vc and the trapezoid waveform Adp2 disposed in the period T2. When the driving signal VOUT is supplied to one end of the piezoelectric element 60, a small amount of ink is discharged from the discharge section 600 corresponding to the piezoelectric element 60 at the cycle Ta. Therefore, the ink lands on the medium M, and thus the small dot is formed.

The driving signal VOUT corresponding to the "non-recording" is a waveform acquired by succeeding, at the cycle Ta, the voltage waveforms disposed in the periods T1 and T2 to be fixed at the voltage Vc and the trapezoid waveform Adp3 disposed in the period T3. When the driving signal VOUT is supplied to one end of the piezoelectric element 60, the ink in the vicinity of the nozzle opening section of the discharge section 600 corresponding to the piezoelectric element 60 only slightly vibrates at the cycle Ta, and thus the ink is not discharged. Therefore, the ink does not land on the medium M, and thus the dot is not formed.

Here, the voltage waveform fixed at the voltage Vc is a waveform having a voltage, in which an immediately before voltage Vc is maintained by a capacity component of the piezoelectric element 60, when none of the trapezoid waveforms Adp1, Adp2, and Adp3 is selected as the driving signal VOUT. Therefore, when none of the trapezoid waveforms Adp1, Adp2, and Adp3 is selected as the driving signal VOUT, the voltage waveform fixed at the voltage Vc is supplied, as the driving signal VOUT, to the piezoelectric element 60.

Note that, the driving signal COM and the driving signal VOUT, which are illustrated in FIGS. 4 and 5, are only examples, and a combination of various waveforms may be used according to a physical property of the ink to be supplied to the print head 23, a material of the medium M, a transport speed, and the like.

Figure 6:
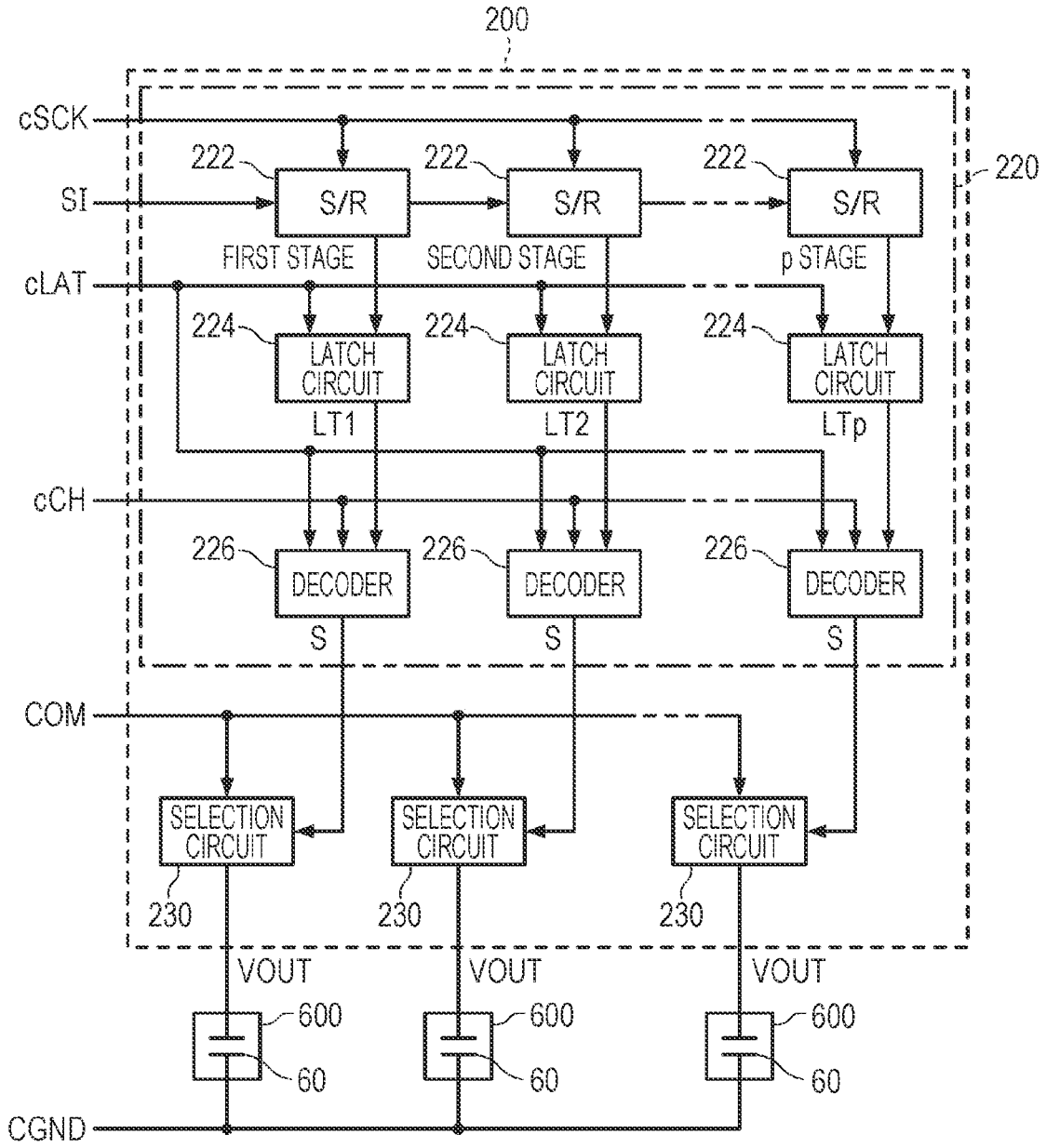
FIG. 6 is a diagram illustrating a configuration of a driving signal selection circuit.

Next, a configuration and an operation of the driving signal selection circuit 200 will be described with reference to FIGS. 6 to 9. FIG. 6 is a diagram illustrating a configuration of the driving signal selection circuit 200. As illustrate in FIG. 6, the driving signal selection circuit 200 includes a selection control circuit 220 and a plurality of selection circuits 230.

The print data signal SI, the latch signal cLAT, the change signal cCH, and the clock signal cSCK are input to the selection control circuit 220. In addition, in the selection control circuit 220, a set of a shift register (SIR) 222, a latch circuit 224, and a decoder 226 is provided to correspond to p number of discharge sections 600. That is, the driving signal selection circuit 200 includes p number of sets of the shift register 222, the latch circuit 224, and the decoder 226, the number of sets being the same as a total number of the relevant discharge sections 600. Here, the print data signal SI is also a signal for prescribing waveform selection of the trapezoid waveforms Adp1, Adp2, and Adp3 included in the driving signal COM. That is, the print data signal SI1 in the print data signal SI serves both as the signal for performing the self-diagnosis of the print head 23 and the signal for prescribing the waveform selection of the driving signal COM. In addition, the clock signal SCK and the clock signal cSCK prescribe timing at which the print data signal SI is input to the selection control circuit 220. That is, the clock signal SCK serves both as the signal for performing the self-diagnosis of the print head 23 and a clock signal SCK for inputting the print data signal SI.

Specifically, the print data signal SI is a signal synchronized with the clock signal SCK, and is a total 2p-bit signal including 2-bit print data [SIH, SIL] for selecting any of the "large dot", the "middle dot", the "small dot", and the "non-recording" with respect to each of the p number of discharge sections 600. The print data signal SI is maintained in the shift register 222 for each 2-bit print data [SIH, SIL] included in the print data signal SI to be correspond to the discharge section 600. Specifically, the stage shift registers 222 in p stages corresponding to the discharge sections 600 are cascade coupled to each other, and the serially-input print data signal SI is sequentially transmitted to a subsequent stage according to the clock signal cSCK. Note that, in FIG. 6, in order to distinguish the shift registers 222, a first stage, a second stage, . . . , a p-th stage are sequentially described from upstream to which the print data signal SI is input. Here, the print data signal SI may be a signal which includes, in the 2-bit print data [SIH, SIL], the print data [SIH] corresponding to each of the p number of discharge sections 600 in serial and which includes, subsequent to the print data [SIH] corresponding to each of the p number of discharge sections 600, the print data [SIL] corresponding to each of the m number of discharge sections 600 in serial.

Each of the p number of latch circuits 224 latches the 2-bit print data [SIH, SIL] maintained in each of the p number of shift registers 222 when the latch signal cLAT rises.

Each of the p number of decoders 226 decodes the 2-bit print data [SIH, SIL] latched by each of the p number of latch circuits 224. Further, the decoder 226 outputs a selection signal S for each of the periods T1, T2, and T3 prescribed by the latch signal cLAT and the change signal cCH.

Figures 7, 8:
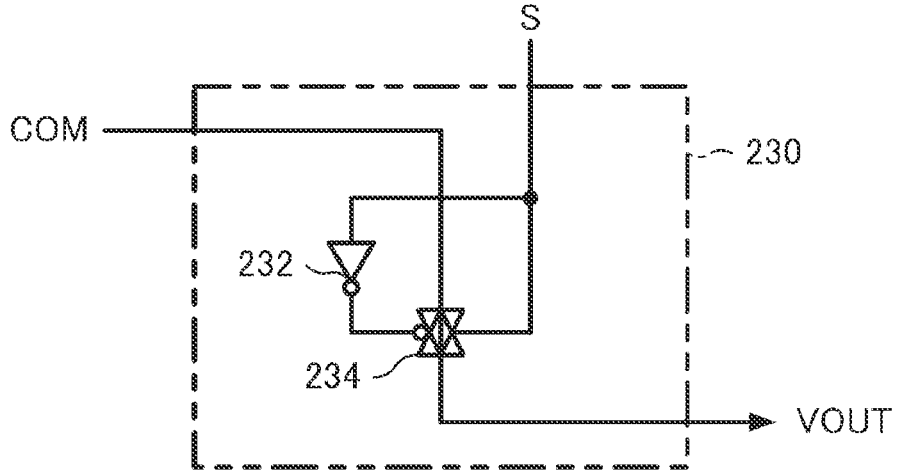
FIG. 7 is a table illustrating decoding content of a decoder.
FIG. 8 is a diagram illustrating a configuration of a selection circuit corresponding to one discharge section.

FIG. 7 is a table illustrating decoding content of the decoder 226. The decoder 226 outputs the selection signal S according to the latched 2-bit print data (SIH, SIM. For example, when the 2-bit print data [SIH, SIL] is [1, 0], the decoder 226 outputs the selection signal S while setting the logical level of the selection signal to H, H, and L levels in the respective periods T1, T2, and T3.

The selection circuits 230 are provided to correspond to the respective discharge sections 600. That is, the number of selection circuits 230 included in the driving signal selection circuit 200 is the same as the total number p of the relevant discharge sections 600. FIG. 8 is a diagram illustrating a configuration of the selection circuit 230 corresponding to one discharge section 600. As illustrated in FIG. 8, the selection circuit 230 includes an inverter 232 which is a NOT circuit and a transfer gate 234.

The selection signal S is input to a positive control end, to which a round mark is not attached, in the transfer gate 234, and is input to a negative control end, to which the round mark is attached, in the transfer gate 234 by being logically inverted by the inverter 232. In addition, the driving signal COM is supplied to an input end of the transfer gate 234. Specifically, when the selection signal S is at the H level, the transfer gate 234 conducts (on) between the input end and the output end. When the selection signal S is at the L level, the transfer gate 234 does not conduct (off) between the input end and the output end. Further, the driving signal VOUT is output from the output end of the transfer gate 234.

Figure 9:
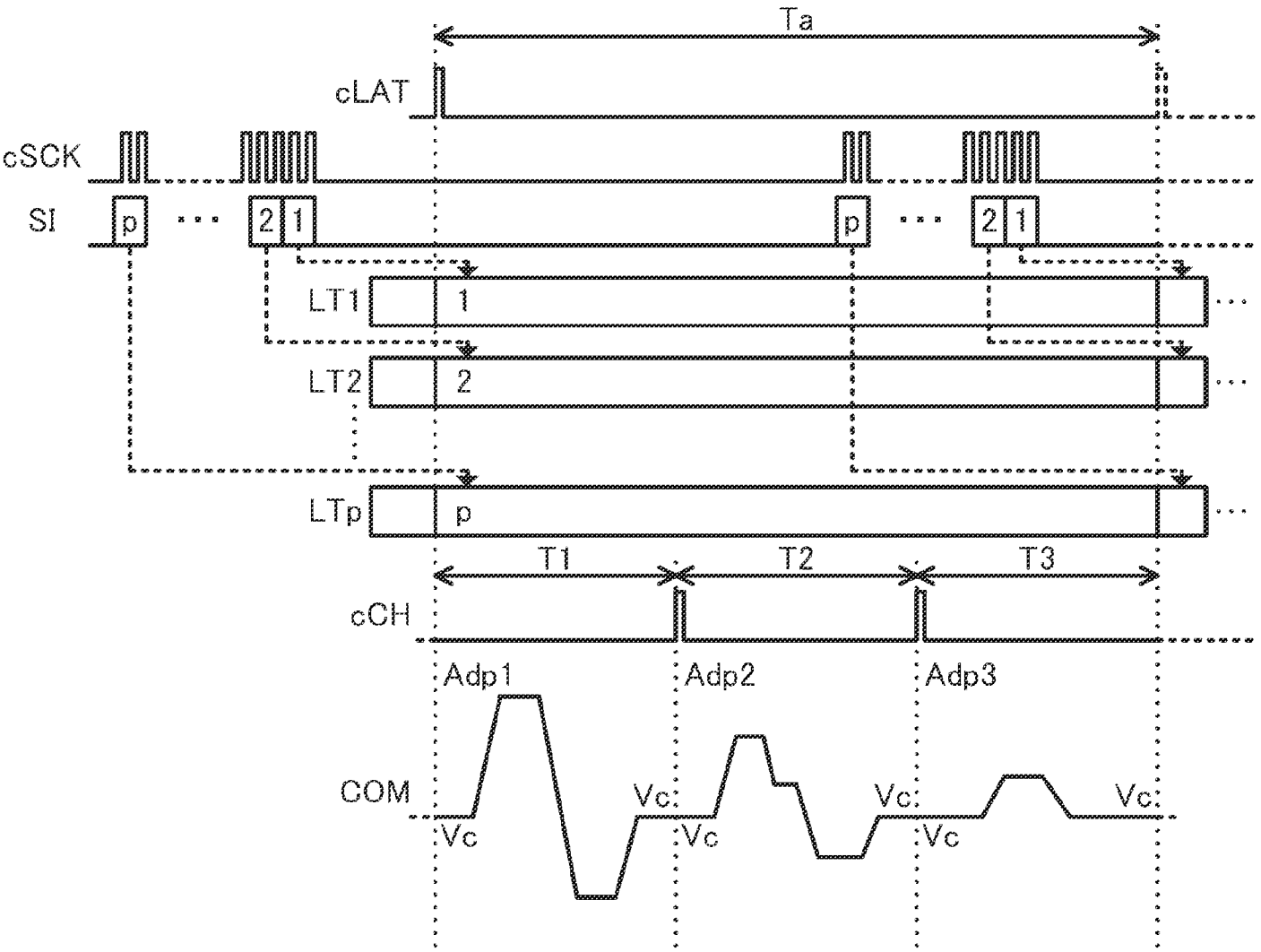
FIG. 9 is a diagram illustrating an operation of the driving signal selection circuit.

Here, an operation of the driving signal selection circuit 200 will be described with reference to FIG. 9. FIG. 9 is a diagram illustrating the operation of the driving signal selection circuit 200. The print data signal SI is serially input in synchronization with the clock signal cSCK, and is sequentially transmitted in the shift registers 222 corresponding to the discharge sections 600. Further, when the input of the clock signal cSCK stops, the 2-bit print data [SIH, SIL] corresponding to each of the discharge sections 600 is maintained in each of the shift registers 222. Note that, the print data signal SI is input in order which corresponds to the discharge sections 600 at the p-th stage, . . . , the second stage, and the first stage of the shift registers 222.

Further, when the latch signal cLAT rises, the respective latch circuits 224 simultaneously latch the 2-bit print data [SIH, SIL] maintained in the shift registers 222. Note that, in FIG. 9, LT1, LT2, . . . , LTp indicate the 2-bit print data [SIH, SIL] latched by the latch circuits 224 corresponding to the first stage, the second stage, . . . , the p-th stage shift registers 222.

The decoder 226 outputs the logical levels of the selection signal S with the content illustrated in FIG. 7 in the respective periods T1, T2, T3 according to the size of the dot prescribed by the latched 2-bit print data [SIH, SIL].

Specifically, when the print data [SIH, SIL] is [1, 1], the decoder 226 sets the selection signal S to H, H, and L levels in the periods T1, T2, and T3. In this case, the selection circuit 230 selects the trapezoid waveform Adp1 in the period T1, selects the trapezoid waveform Adp2 in the period T2, and does not select the trapezoid waveform Adp3 in the period T3. As a result, the driving signal VOUT corresponding to the "large dot" illustrated in FIG. 5 is generated.

In addition, when the print data [SIH, SIL] is [1, 0], the decoder 226 sets the selection signal S to H, L, and L levels in the periods T1, T2, and T3. In this case, the selection circuit 230 selects the trapezoid waveform Adp1 in the period T1, does not selects the trapezoid waveform Adp2 in the period T2, and does not select the trapezoid waveform Adp3 in the period T3. As a result, the driving signal VOUT corresponding to the "middle dot" illustrated in FIG. 5 is generated.

In addition, when the print data [SIH, SIL] is [0, 1], the decoder 226 sets the selection signal S to L, H, and L levels in the periods T1, T2, and T3. In this case, the selection circuit 230 does not select the trapezoid waveform Adp1 in the period T1, selects the trapezoid waveform Adp2 in the period T2, and does not select the trapezoid waveform Adp3 in the period T3. As a result, the driving signal VOUT corresponding to the "small dot" illustrated in FIG. 5 is generated.

In addition, when the print data [SIH, SIL] is [0, 0], the decoder 226 sets the selection signal S to L, L, and H levels in the periods T1, T2, and T3. In this case, the selection circuit 230 does not select the trapezoid waveform Adp1 in the period T1, does not select the trapezoid waveform Adp2 in the period T2, and selects the trapezoid waveform Adp3 in the period T3. As a result, the driving signal VOUT corresponding to the "non-recording" illustrated in FIG. 5 is generated.

As above, the driving signal selection circuit 200 selects the waveform of the driving signal COM based on the print data signal SI, the latch signal cLAT, the change signal cCH, and the clock signal cSCK, and outputs the driving signal VOUT. That is, in the driving signal selection circuit 200, the driving signal VOUT is generated through the selection or non-selection of the waveform of the driving signal COM.

1.2.3 Electrical Configuration of Temperature Abnormality Detection Circuit

Figure 10:
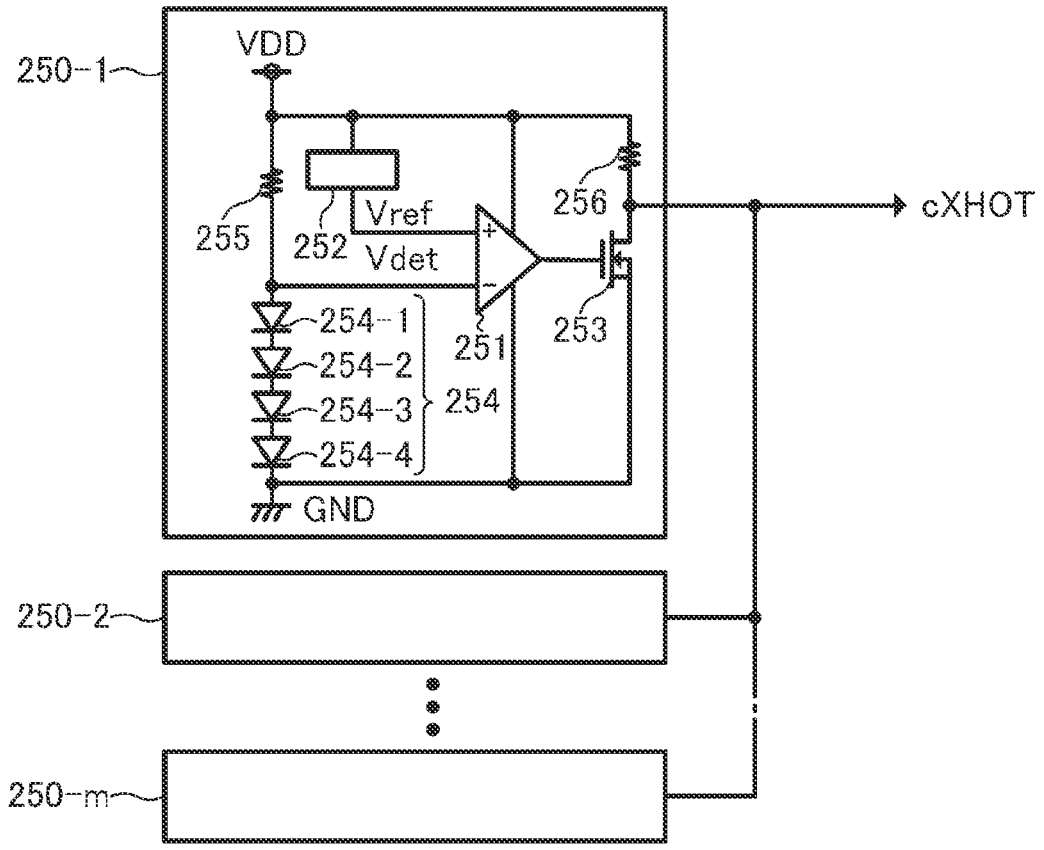
FIG. 10 is a diagram illustrating a configuration of a temperature abnormality detection circuit.

Next, the electrical configurations and the operations of the temperature abnormality detection circuits 250-1 to **250-*m* will be described with reference to FIG. 10. FIG. 10 is a diagram illustrating the configurations of the temperature abnormality detection circuits 250-1 to 250-*m*. As illustrated in FIG. 10, the temperature abnormality detection circuit 250-1 includes a comparator 251, a reference voltage output circuit 252, a transistor 253, a plurality of diodes 254, and resistors 255 and 256. Note that, all the temperature abnormality detection circuits 250-1 to 250-*m* have the same configuration. Therefore, in FIG. 10, only the detailed configuration of the temperature abnormality detection circuit 250-1 is illustrated, and detailed configurations of the temperature abnormality detection circuits 250-2 to 250-*m*** are not illustrated.

The low voltage signal VDD is input to the reference voltage output circuit 252. The reference voltage output circuit 252 generates a voltage Vref by transforming the low voltage signal VDD, and supplies the voltage Vref to a + side input terminal of the comparator 251. The reference voltage output circuit 252 is configured with, for example, a voltage regulator circuit or the like. Note that, the voltage Vref may be generated based on a Band Gap Reference (BGR) of the integrated circuit device included in the temperature abnormality detection circuit 250-1.

The plurality of diodes 254 are coupled to each other in series. Further, the low voltage signal VDD is supplied to an anode terminal of the diode 254, which is located on a highest potential side of the plurality of diodes 254 which are coupled in series, through the resistor 255, and the ground signal GND is supplied to a cathode terminal of the diode 254 which is located on a lowest potential side. Specifically, the temperature abnormality detection circuit 250-1 includes diodes 254-1, 254-2, 254-3, and 254-4 as the plurality of diodes 254. The low voltage signal VDD is supplied to an anode terminal of the diode 254-1 through the resistor 255, and the anode terminal of the diode 254-1 is coupled to a − side input terminal of the comparator 251. A cathode terminal of the diode 254-1 is coupled to an anode terminal of the diode 254-2. A cathode terminal of the diode 254-2 is coupled to an anode terminal of the diode 254-3. A cathode terminal of the diode 254-3 is coupled to an anode terminal of the diode 254-4. The ground signal GND is supplied to a cathode terminal of the diode 254-4. A voltage Vdet, which is the sum of forward voltages of the plurality of respective diodes 254, is supplied to a − side input terminal of the comparator 251 by the resistor 255 and the plurality of diodes 254, which are configured as described above. Note that, the number of plurality of diodes 254 included in the temperature abnormality detection circuit 250-1 is not limited to four.

The comparator 251 operates due to potential difference between the low voltage signal VDD and the ground signal GND. Further, the comparator 251 compares the voltage Vref supplied to the + side input terminal with the voltage Vdet supplied to the − side input terminal, and outputs a signal, based on a result of the comparison, from the output terminal.

The low voltage signal VDD is supplied to a drain terminal of the transistor 253 through the resistors 256. In addition, the transistor 253 includes a gate terminal coupled to the output terminal of the comparator 251 and a source terminal to which the ground signal GND is supplied. A voltage supplied to the drain terminal, which is coupled as above, of the transistor 253 is output, as the abnormality signal cXHOT, from the temperature abnormality detection circuit 250-1.

A voltage value of the voltage Vref generated by the reference voltage output circuit 252 is lower than the voltage Vdet which is acquired when the temperatures of the plurality of diodes 254 are included in a prescribed range. In this case, the comparator 251 outputs a signal at the L level. Therefore, control is performed such that the transistor 253 is off, and, as a result, the temperature abnormality detection circuit 250-1 outputs the abnormality signal cXHOT at the H level.

The forward voltage of the diode 254 has a characteristic of being lowered when the temperature rises. Therefore, when the temperature abnormality occurs in the print head 23, the temperature of the diode 254 rises, and thus the voltage Vdet lowers in accordance the rise of the temperature. Further, when the voltage Vdet is lower than the voltage Vref because the temperature rises, the output signal of the comparator 251 changes from the L level to the H level. Therefore, control is performed such that the transistor 253 is on. As a result, the temperature abnormality detection circuit 250-1 outputs the abnormality signal cXHOT at the L level. That is, when the control is performed such that the transistor 253 is on or off based on the temperature of the driving signal selection circuit 200, the temperature abnormality detection circuit 250-1 outputs, as the abnormality signal cXHOT at the H level, the low voltage signal VDD supplied as a pull-up voltage of the transistor 253, and outputs, as the abnormality signal cXHOT at the L level, the ground signal GND.

Here, as illustrated in FIG. 10, wiring, through which the abnormality signal cXHOT is output from each of the temperature abnormality detection circuits 250-1 to **250-*m*, is commonly coupled. Therefore, the temperature abnormality detection circuits 250-1 to 250-*m* are wired-OR coupled with each other. Therefore, when the temperature abnormality occurs in any of the temperature abnormality detection circuits 250-1 to 250-*m*, the abnormality signal cXHOT, which indicates the temperature abnormality, is input to the diagnostic circuit 240**.

1.3 Configuration of Print Head

Next, a configuration of the print head 23 included in the head unit 20 will be described. Note that, in the description below, description is performed while it is assumed that the print head 23 includes 6 number of driving signal selection circuits 200-1 to 200-6. Therefore, in the print head 23 according to the first embodiment, the 6 number of print data signals SI1 to SI6, the 6 number of driving signals COM-1 to COM-6, and the 6 number of reference voltage signals CGND-11 to CGND-6, which correspond to the 6 number of driving signal selection circuits 200-1 to 200-6, respectively, are input. In addition, in the following description, X1, Y1, and Z1 directions that are independent of the above-described X, Y, and Z directions and are orthogonal to each other will be illustrated and described. In addition, a starting point side of an arrow indicating the X1 direction illustrated in the drawing is referred to as a −X1 side, a tip end side is referred to as a +X1 side, a starting point side of an arrow indicating the Y1 direction illustrated in the drawing is referred to as a −Y1 side, and a tip end side is referred to as a +Y1 side, a starting point side of an arrow indicating the Z1 direction illustrated in the drawing is referred to as a −Z1 side, and a tip end side is referred to as a +Z1 side.

Figure 11:
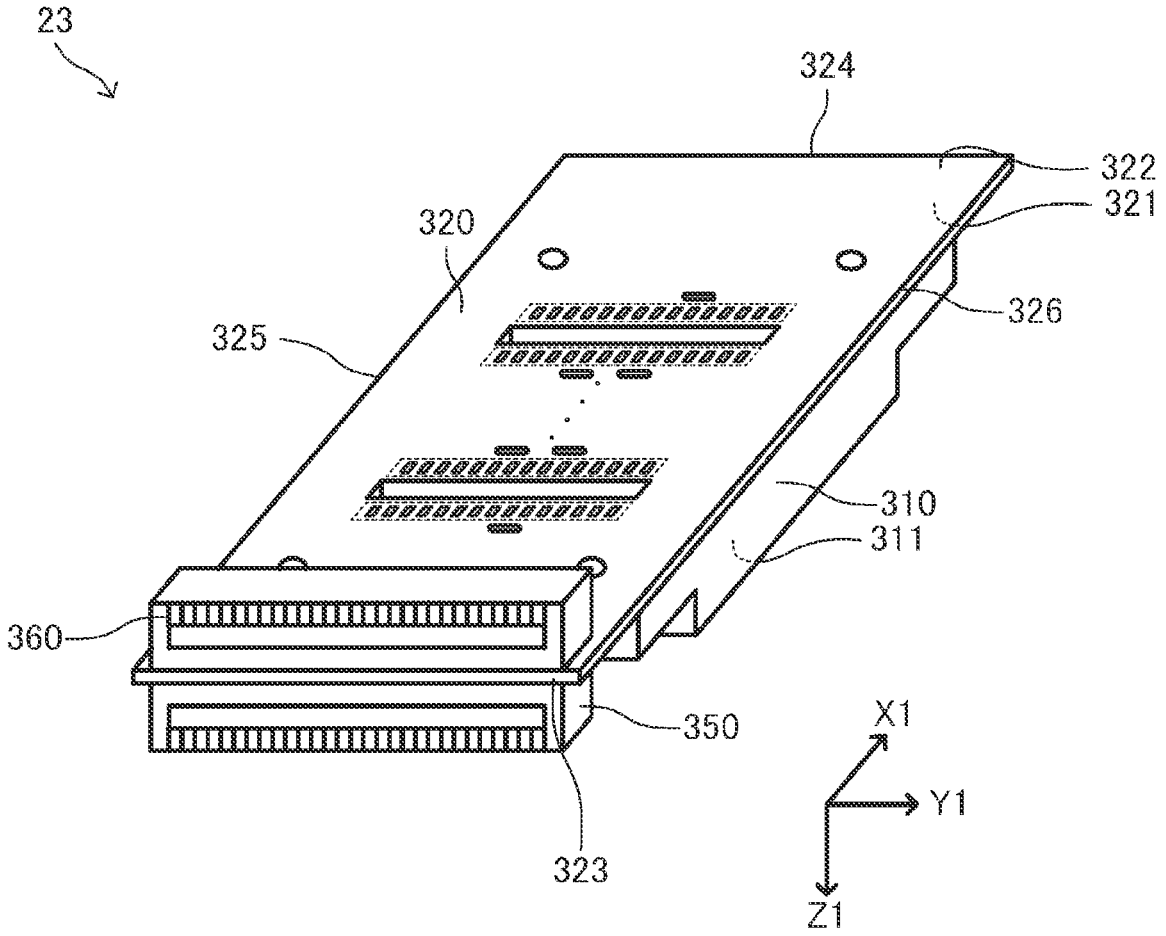
FIG. 11 is a perspective diagram illustrating a configuration of a print head.

FIG. 11 is a perspective view illustrating the configuration of the print head 23. As illustrated in FIG. 11, the print head 23 includes a head 310 and a substrate 320. In addition, an ink discharge surface 311, which is formed with the plurality of discharge sections 600, is located on a surface of the +Z1 side of the head 310. Further, the substrate 320 and the head 310 are fixed by an adhesive.

Figure 12:
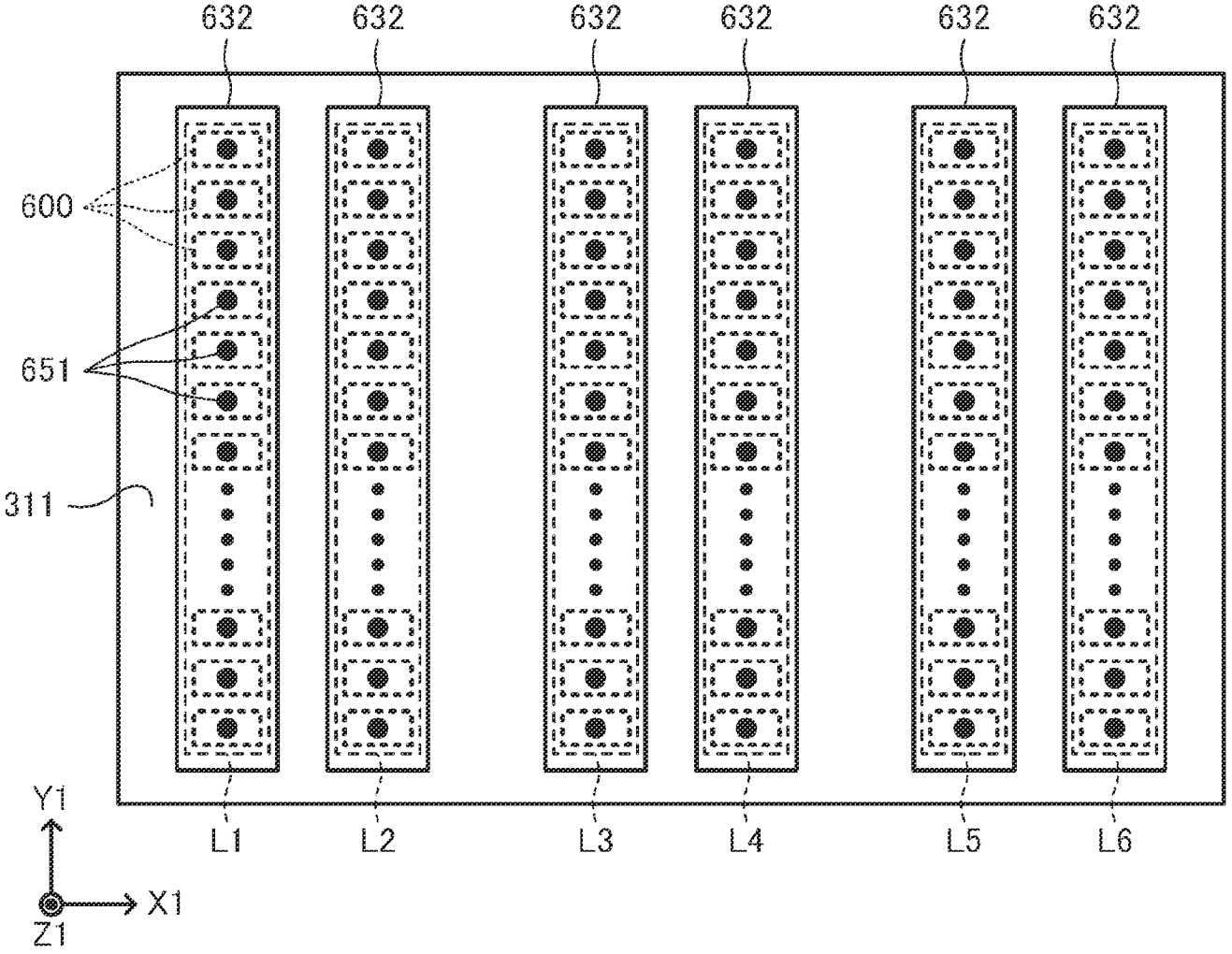
FIG. 12 is a plan diagram illustrating a configuration of an ink discharge surface.

FIG. 12 is a plan diagram illustrating a configuration of the ink discharge surface 311 located on the +Z1 side of the head 310. As illustrated in FIG. 12, in the ink discharge surface 311, six number of nozzle plates 632, which each include a plurality of nozzles 651 for discharging the ink, are provided in line along a X1 direction. In addition, the plurality of nozzles 651 are provided in line along the Y1 direction in each of the nozzle plates 632. 'That is, in the ink discharge surface 311, the six nozzle plates 632, in which the plurality of nozzles 651 for discharging the ink are provided in line in a direction along a side 323 of the substrate 320 extending along the Y1 direction, are provided in line in order of nozzle rows L1 to L6 along the X1 direction. Note that, in FIG. 12, in the nozzle rows L1 to L6 formed on the respective nozzle plates 632, the nozzles 651 are provided in one line along the Y1 direction. However, the nozzles 651 may be provided in two or more lines along the Y1 direction.

The nozzle rows L1 to L6 are provided to correspond to the respective driving signal selection circuits 200-1 to 200-6. Specifically, the driving signal VOUT-1, which is output by the driving signal selection circuit 200-1, is supplied to one ends of the piezoelectric elements 60 included in the plurality of discharge sections 600 provided in the nozzle row L1. In addition, the reference voltage signal CGND-1 is supplied to the other ends of the piezoelectric elements 60. Similarly, the driving signals VOUT-2 to VOUT-6 output by the respective driving signal selection circuits 200-2 to 200-6 are supplied to one ends of the piezoelectric elements 60 included in the plurality of respective discharge sections 600 provided in the relevant nozzle rows L2 to L6, and the relevant reference voltage signals CGND-2 to CGND-6 are supplied to the other ends of the piezoelectric elements 60.

Figure 13:
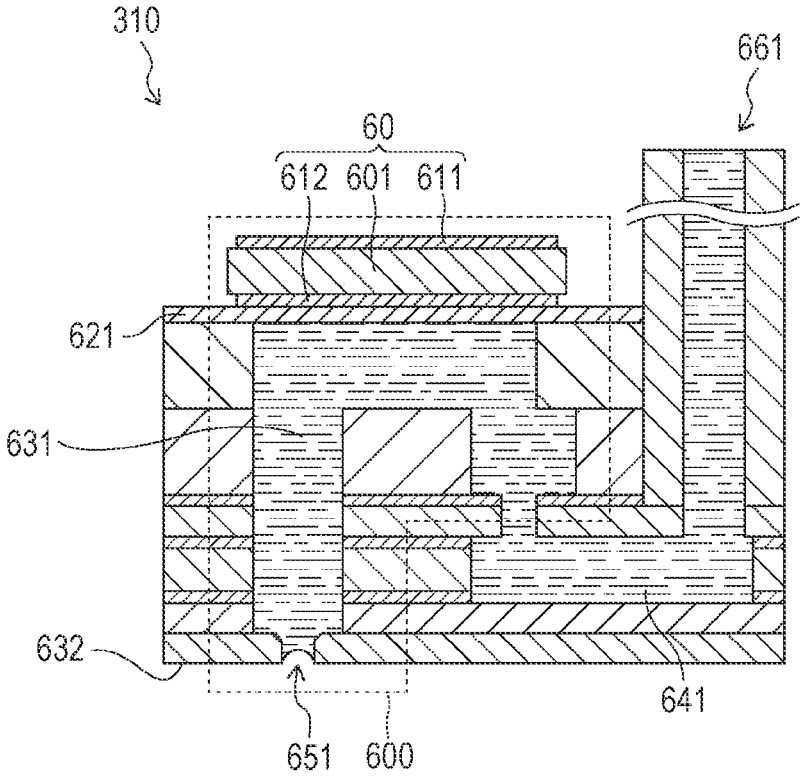
FIG. 13 is a diagram illustrating a schematic configuration of the discharge section.

Next, a configuration of the discharge section 600 included in the head 310 will be described with reference to FIG. 13. FIG. 13 is a diagram illustrating a schematic configuration of one of the plurality of discharge sections 600 included in the head 310. As illustrated in FIG. 13, the head 310 includes the discharge section 600 and a reservoir 641.

The reservoir 641 is provided in each of the nozzle rows L1 to L6. Further, the ink is introduced from an ink supply port 661 to the reservoir 641.

The discharge section 600 includes the piezoelectric element 60, a vibration plate 621, a cavity 631, and a nozzle 651. The vibration plate 621 varies in accordance with displacement of the piezoelectric element 60 provided on an upper surface in FIG. 13. Further, the vibration plate 621 functions as a diaphragm which enlarges/reduces an internal volume of the cavity 631. An inside of the cavity 631 is filled with the ink. Further, the cavity 631 functions as a pressure chamber in which the internal volume changes according to the displacement of the piezoelectric element 60. The nozzle 651 is an opening section which is formed on the nozzle plate 632 and which communicates with the cavity 631. Further, the nozzle 651 communicates with the cavity 631, and discharges the ink on the inside of the cavity 631 according to the change in the internal volume of the cavity 631.

The piezoelectric element 60 has a structure in which a piezoelectric substance 601 is interposed between a pair of electrodes 611 and 612. In the piezoelectric substance 601 of the structure, according to a voltage which is supplied to the electrodes 611 and 612, central parts of the electrodes 611 and 612 and the vibration plate 621 are bent in upper and lower directions with respect to both end parts in FIG. 13. Specifically, the driving signal VOUT is supplied to the electrode 611, and the reference voltage signal CGND is supplied to the electrode 612. Further, when the voltage of the driving signal VOUT becomes high, a central part of the piezoelectric element 60 is bent in an upper direction. When the voltage of the driving signal VOUT becomes low, the central part of the piezoelectric element 60 is bent in a lower direction. That is, when the piezoelectric element 60 is bent in the upper direction, the internal volume of the cavity 631 is enlarged. Therefore, the ink is drawn from the reservoir 641. In addition, when the piezoelectric element 60 is bent in the lower direction, the internal volume of the cavity 631 is reduced. Therefore, an amount of ink according to a degree of reduction in the internal volume of the cavity 631 is discharged from the nozzle 651. As above, the nozzle 651 discharges the ink based on the driving signal VOUT and the driving signal COM which is the basis of the driving signal VOUT.

Note that, the piezoelectric element 60 is not limited to the illustrated structure, and may be a type which is capable of discharging the ink in accordance with the displacement of the piezoelectric element 60. In addition, the piezoelectric element 60 is not limited to flexural vibration, and may have a configuration using longitudinal vibration. Here, the head 310, which includes the nozzle plate 632, the ink supply port 661, the reservoir 641, and the cavity 631, is an example of a discharge module.

Returning to FIG. 11, the substrate 320 includes a side 323 and a side 324, which are provided in parallel to each other, a side 325 and a side 326, which are provided in parallel to each other, a surface 321, and a surface 322 which is different from the surface 321. The substrate 320 has a shape in which the side 323 is orthogonal to the side 325 and the side 326, and in which the side 324 is orthogonal to the side 325 and the side 326. In other words, the substrate 320 has the side 323, the side 326 which intersects with the side 323, the surface 321 including the side 323 and the side 326, and the surface 322 different from the surface 321. Further, the substrate 320 includes the side 324 provided to be parallel to the side 323, and the side 325 provided to be parallel to the side 326, and the surface 321 has a rectangular shape which includes the side 323, the side 324, the side 325, and the side 326.

Here, the surface 321 and the surface 322 of the substrate 320 are surfaces which are located to face each other through a base material of the substrate 320, in other words, the surface 321 and the surface 322 are front and back surfaces of the substrate 320. Further, the substrate 320 is provided so that the surface 321 is on the +Z1 side and the surface 322 is on the −Z1 side in the print head 23. Here, the surface 321 of the substrate 320 is an example of a first surface, and the surface 322 which is different from the surface 321 is an example of a second surface. In addition, the side 323 is an example of a first side, the side 326 is an example of a second side, the side 324 is an example of a third side, and the side 325 is an example of a fourth side.

In addition, in the print head 23, the substrate 320 is provided on an opposite side of the ink discharge surface 311, from which the ink is discharged, with respect to the nozzle plate 632, that is, the substrate 320 is provided so that the surface 321 is on a side of the nozzle plate 632. In other words, in the print head 23, the substrate 320 is located on the −Z1 side of the head 310 which has the nozzle plates 632, and is provided so that the surface 321 is on the +Z side and the surface 322 is on the −Z1 side.

A first connector 350 and a second connector 360 are provided in the substrate 320. The first connector 350 is provided on a side of the surface 321 of the substrate 320 along the side 323. Further, at least any of the print data signals SI1 to SIn, the change signal CH, the latch signal LAT, and the clock signal SCK is input to the first connector 350. In addition, the second connector 360 is provided on a side of the surface 322 of the substrate 320 along the side 323. Further, at least any of the print data signals SI1 to SIn, the change signal CH, the latch signal LAT, and the clock signal SCK is input to the second connector 360. Note that, detailed examples of the signals, which are input to the print head 23 through the first connector 350 and the second connector 360, will be described later. Here, the first connector 350, which is provided in the surface 321 of the substrate 320 and to which at least one of the print data signals SI1 to SIn, the change signal CH, the latch signal LAT, and the clock signal SCK is input from the control circuit 100, is an example of a connector.

Figure 14:
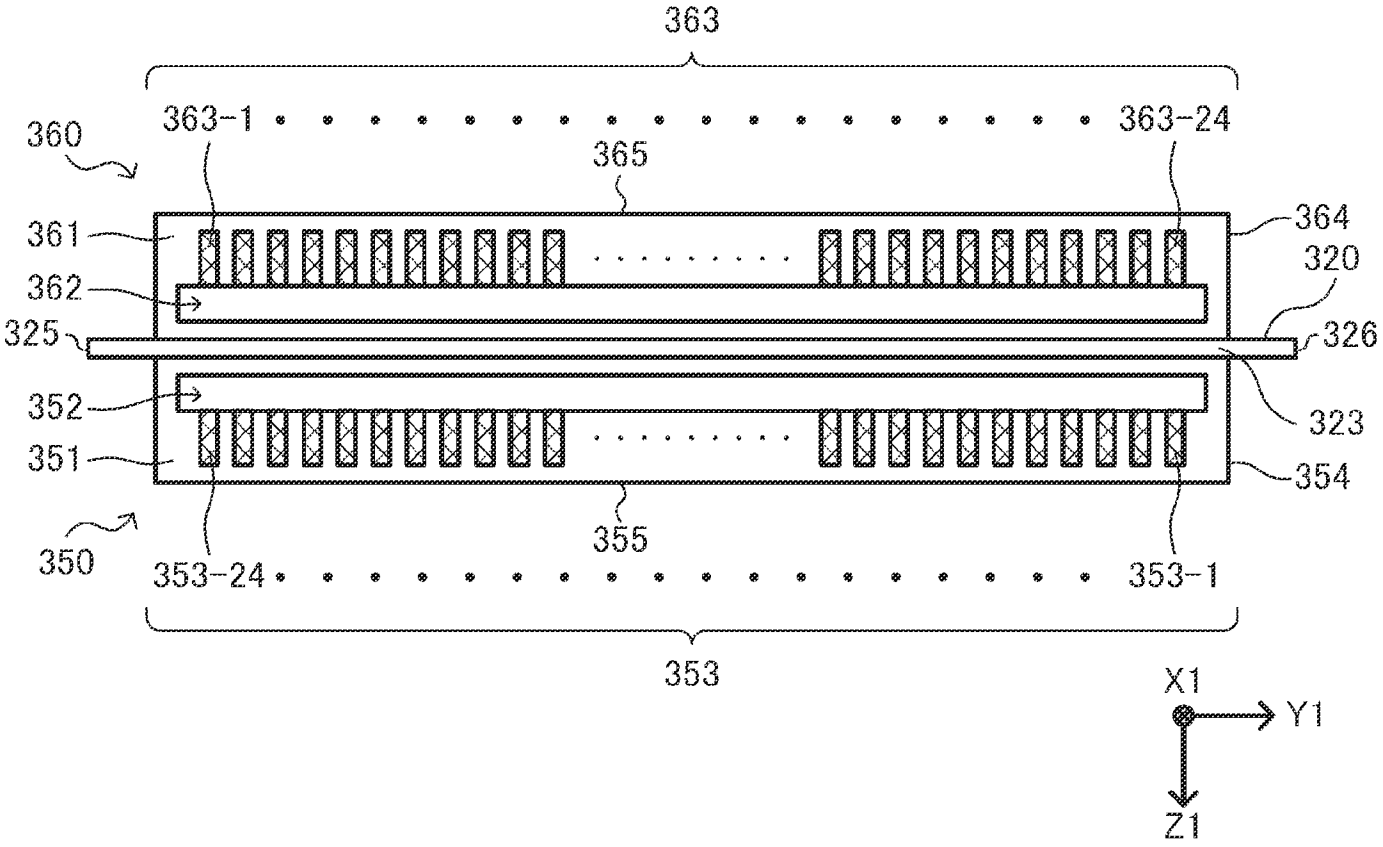
FIG. 14 is a diagram illustrating configurations of a first connector and a second connector.

Next, configurations of the first connector 350 and the second connector 360, which are provided in the substrate 320, will be described with reference to FIG. 14. FIG. 14 is a diagram illustrating the configurations of the first connector 350 and the second connector 360.

The first connector 350 has a substantially rectangular parallelepiped shape including a plurality of sides having a side 354 and a side 355, which is orthogonal to the side 354 and is longer than the side 354, and a plurality of surfaces which are formed by the plurality of sides. Further, the first connector 350 is provided so that the side 355 of the first connector 350 is parallel to the side 323 of the substrate 320. The first connector 350 includes a housing 351, a cable attachment section 352, and a plurality of terminals 353. The cable attachment section 352 is a long and narrow opening along the side 355. A not-shown cable, which electrically couples the control mechanism 10 to the print head 23 included in the head unit 20, is attached to the cable attachment section 352. In addition, the plurality of terminals 353 are provided in line in a direction along the side 355. That is, the plurality of terminals 353 are provided in line in the direction along the side 323 of the substrate 320.

Further, when the cable is attached to the cable attachment section 352, each of the plurality of terminals included in the cable is electrically coupled to each of the plurality of terminals 353 included in the first connector 350. Therefore, the various signals output from the control mechanism 10 are input to the print head 23. Note that, in the first embodiment, description is performed while it is assumed that 24 number of terminals 353 are provided in parallel along the side 323 in the first connector 350. In addition, in the following description, there is a case where 24 number of terminals 353 provided in parallel are sequentially referred to as terminals 353-1, 353-2, . . . , 353-24 toward the side 325 from a side of the side 326 in the direction along the side 323. Here, the side 354 is an example of a fifth side, and the side 355 is an example of a sixth side.

The second connector 360 has a substantially rectangular parallelepiped shape including a plurality of sides having a side 364 and a side 365, which is orthogonal to the side 364 and is longer than the side 364, and a plurality of surfaces which are formed by the plurality of sides. Further, the second connector 360 is provided in the substrate 320 such that the side 365 of the second connector 360 is parallel to the side 323 of the substrate 320. The second connector 360 includes a housing 361, a cable attachment section 362, and a plurality of terminals 363. The cable attachment section 362 is a long and narrow opening along the side 365. A not-shown cable, which electrically couples the control mechanism 10 to the print head 23 included in the head unit 20, is attached to the cable attachment section 362. The plurality of terminals 363 are provided in line in the direction along the side 323. Further, when the cable is attached to the cable attachment section 362, the plurality of respective terminals included in the cable are electrically coupled to the plurality of respective terminals 363 included in the second connector 360. Therefore, the various signals output by the control mechanism 10 are input to the print head 23. Note that, in the first embodiment, description is performed while it is assumed that 24 number of terminals 363 are provided in parallel along the side 323 in the second connector 360. In addition, in the following description, there is a case where the 24 number of terminals 363 are referred to as terminals 363-1, 363-2, . . . , 363-24 sequentially from the side of the side 325 toward the side of the side 326 in the direction along the side 323.

Next, examples of signals which are input to each of the first connector 350 and the second connector 360 will be described with reference to FIGS. 15 and 16. FIG. 15 is a diagram illustrating examples of the signals respectively input to the plurality of terminals 353 included in the first connector 350. In addition, FIG. 16 is a diagram illustrating examples of signals respectively input to the plurality of terminals 363 included in the second connector 360.

As illustrated in FIG. 15, the print data signal SI1, the change signal CH, the latch signal LAT, the clock signal SCK, the temperature signal TH, the abnormality signal XHOT, and the plurality of ground signals GND are input to the terminals 353-1 to 353-12 in order to control the discharge of the ink. In addition, the driving signals COM-1 to COM-6 and the reference voltage signals CGND-1 to CGND-6 are input to the terminals 353-13 to 353-24 in order to drive the piezoelectric elements 60. That is, a control signal of a low voltage and a signal, which indicates a reference potential of the control signal, are input to the plurality of terminals 353 provided on the side of the side 326 of the first connector 350, and a driving signal of the high voltage and a signal, which indicates a reference potential of the driving signal, are input to the plurality of terminals 353 provided on the side of the side 325 of the first connector 350. As above, the terminals, to which the signal of the high voltage is input, and the terminals, to which the signal of the low voltage is input, are separately provided in the first connector 350, and thus it is possible to reduce a problem in that the signal of the high voltage interferes in the control signal which is the signal of the low voltage.

Further, the terminals, to which the ground signal GND is input, are located between the terminals 353 to which the print data signal SI1, the change signal CH, the latch signal LAT, the clock signal SCK, the temperature signal TH, and the abnormality signal XHOT are respectively input. Specifically, the terminal 353-3, to which the ground signal GND is input, is located between the terminal 353-2, to which the temperature signal TH is input, and the terminal 353-4 to which the latch signal LAT is input. In addition, the terminal 353-5, to which the ground signal GND is input, is located between the terminal 353-4, to which the latch signal LAT is input, and the terminal 353-6 to which the clock signal SCK is input. In addition, the terminal 353-7, to which the ground signal GND is input, is located between the terminal 353-6, to which the clock signal SCK is input, and the terminal 353-8 to which the change signal CH is input. In addition, the terminal 353-9, to which the ground signal GND is input, is located between the terminal 353-8, to which the change signal CH is input, and the terminal 353-10 to which the print data signal SI1 is input. In addition, the terminal 353-11, to which the ground signal GND is input, is located between the terminal 353-10, to which the print data signal SI1 is input, and the terminal 353-12 to which the abnormality signal XHOT is input.

As described above, each of the print data signal SI1, the change signal CH, the latch signal LAT, and the clock signal SCK serves both as the signal for performing the self-diagnosis of the print head 23 in the diagnostic circuit 240 and a signal for controlling the discharge of the ink. When the terminal 353, to which the ground signal GND that is a signal of the reference potential is input, is located between the terminals 353 to which the important signals are input, it is possible to reduce a problem in that the print data signal SI1, the change signal CH, the latch signal LAT, and the clock signal SCK interfere in each other.

As illustrated in FIG. 16, the driving signals COM-1 to COM-6 and the reference voltage signals CGND-1 to CGND-6 are input to the terminals 363-1 to 363-12 in order to drive the piezoelectric elements 60. In addition, the high voltage signal VHV, which is the signal of the high voltage, is input to the terminal 363-14. In addition, the print data signals SI2 to SI6, the low voltage signal VDD which is the signal of the low voltage, and the plurality of ground signals GND are input to the terminals 363-15 to 363-24 in order to control the discharge of the ink. That is, the control signal of the low voltage and a signal, which indicates the reference potential of the control signal, are input to the plurality of terminals 363 provided on the side of the side 326 of the second connector 360, and the driving signal of the high voltage and a signal, which indicates the reference potential of the driving signal, are input to the plurality of terminals 363 provided on the side of the side 325 of the second connector 360. As above, when the terminals, to which the signal of the high voltage is input, and the terminals, to which the signal of the low voltage is input, are separately provided in the second connector 360, it is possible to reduce a problem in that the high voltage signal interferes in the signal of the low voltage.

Figure 17:
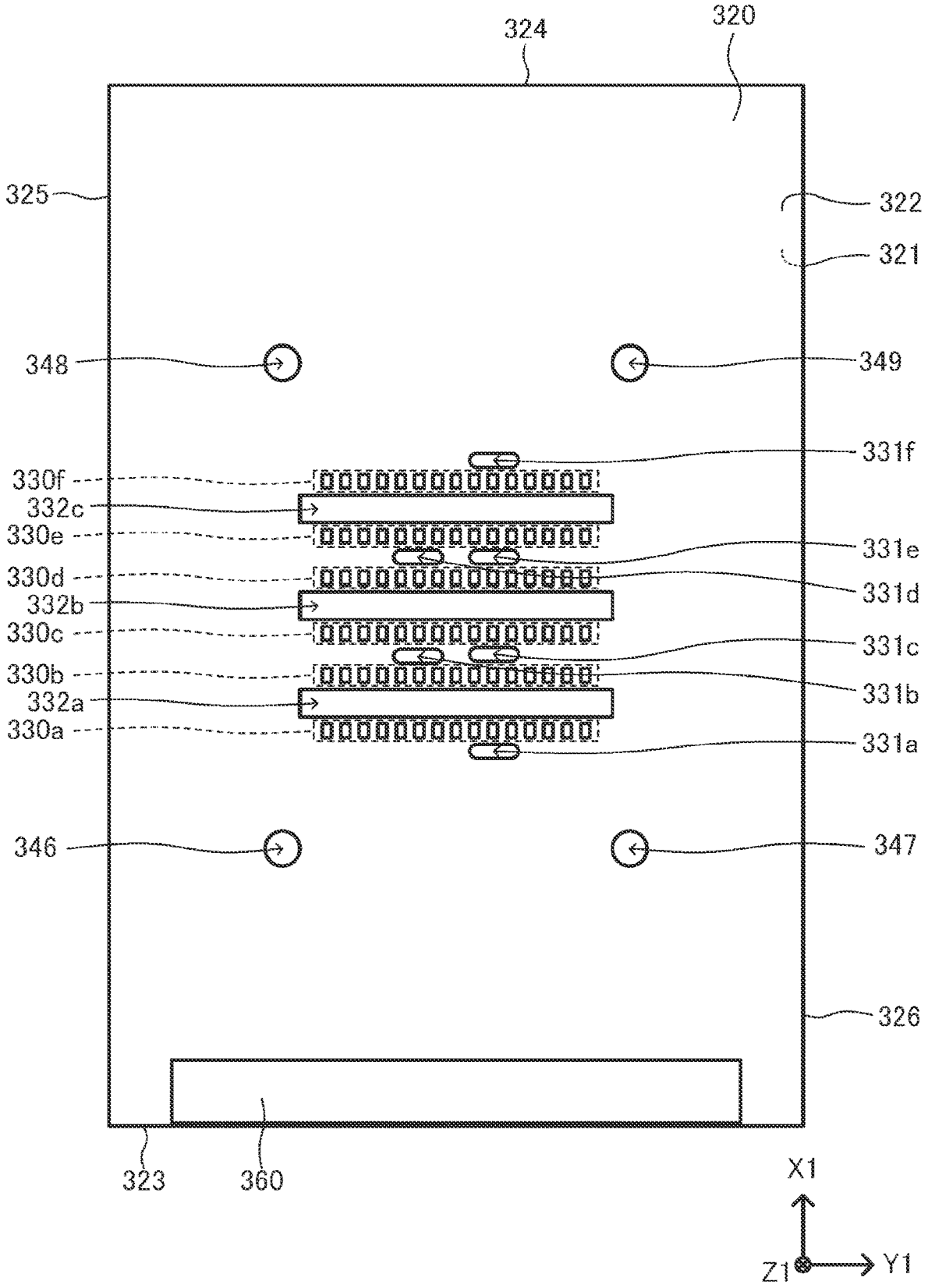
FIG. 17 is a plan diagram illustrating a case where a substrate is viewed from a surface.
Figure 18:
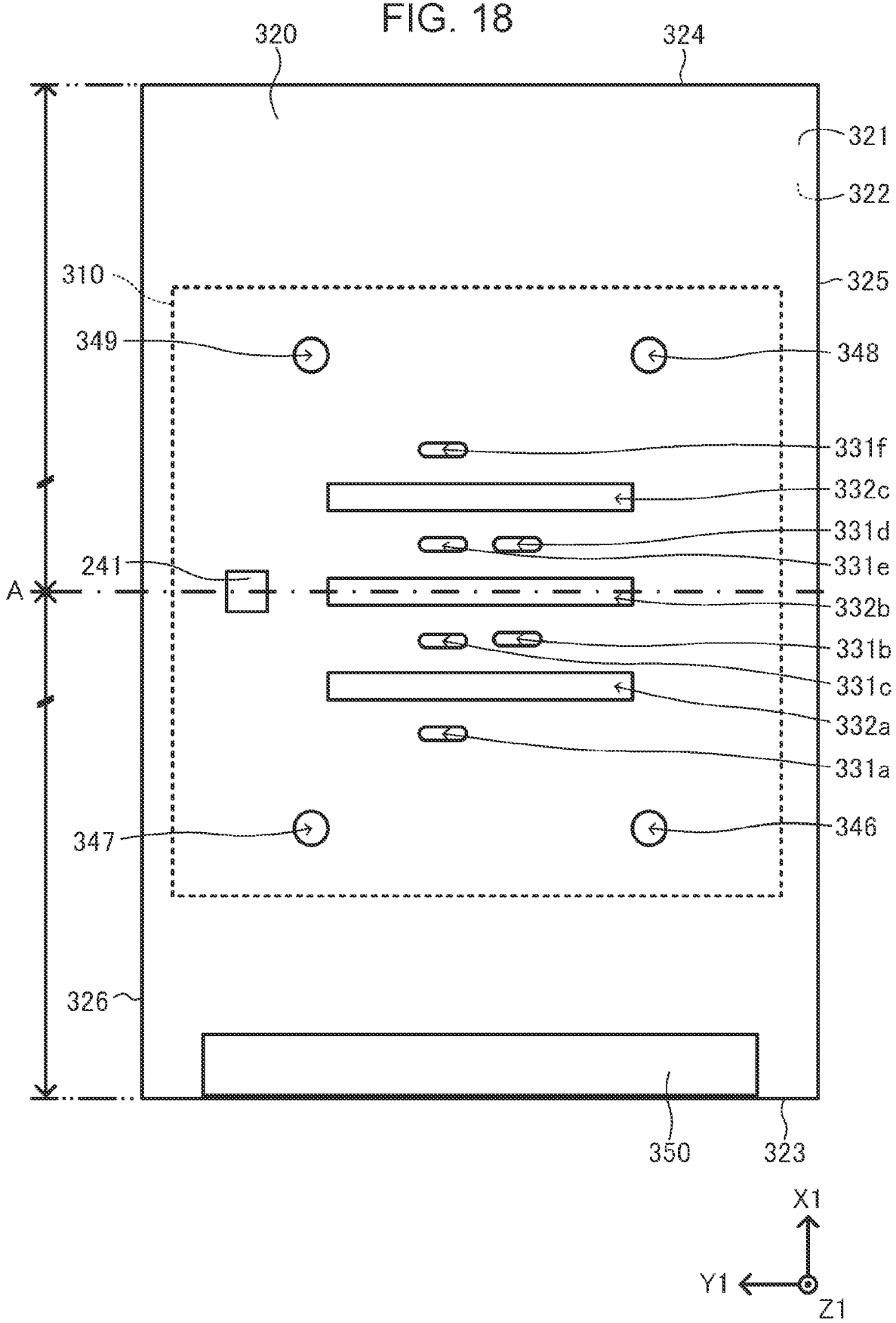
FIG. 18 is a plan diagram illustrating a case where the substrate is viewed from a surface.

Next, a configuration of the substrate 320 included in the print head 23 will be described. As illustrated in FIGS. 17 to 18, the substrate 320 is provided so that the side 323 and the side 324 are located along the Y1 direction, and the side 325 and the side 326 are located along the X1 direction. Here, a length of the side 323 of the substrate 320 is shorter than a length of the side 326. That is, the substrate 320 is a substantially rectangular shape having the side 323 as a short side and the side 326 as a long side.

FIG. 17 is a plan diagram illustrating a case where the substrate 320 is viewed from the surface 322. In addition, FIG. 18 is a plan diagram illustrating a case where the substrate 320 is viewed from the surface 321. Note that, in FIG. 18, a location of the head 310 provided on the side of the surface 321 of the substrate 320 is illustrated using broken lines.

As illustrated in FIGS. 17 and 18, the surface 322 of the substrate 320 includes ink supply path insertion holes 331*a* to 331*f*, into which the ink supply ports 661 for introducing the ink to the discharge sections 600 corresponding to the respective nozzle rows L1 to L6 are inserted, electrode groups 330*a* to 330*f* to which a flexible wiring substrates (Flexible Printed Circuits (FPC)) 335, which will be described later, is electrically coupled, and FPC insertion holes 332*a* to 332*c* into which the flexible wiring substrates 335 are inserted. Here, the ink supply path insertion holes 331*a* to 331*f* and the FPC insertion holes 332*a* to 332*c* are through holes which pass through the surface 321 and the surface 322 of the substrate 320.

Each of the electrode groups 330*a* to 330*f* includes a plurality of electrodes disposed in line to be parallel to the side 323 along the Y1 direction, and is disposed to be parallel to the side 325 along the X1 direction. Specifically, the electrode group 330*a* includes the plurality of electrodes provided in parallel along the Y1 direction. In addition, the electrode group 330*b* is located on a side of the side 324 of the electrode group 330*a*, and includes a plurality of electrodes provided in parallel along the Y1 direction. In addition, the electrode group 330*c* is located on the side of the side 324 of the electrode group 330*b*, and includes a plurality of electrodes provided in parallel along the Y1 direction. In addition, the electrode group 330*d* is located on the side of the side 324 of the electrode group 330*c*, and includes a plurality of electrodes provided in parallel along the Y1 direction. In addition, the electrode group 330*e* is located on the side of the side 324 of the electrode group 330*d*, and includes a plurality of electrodes provided in parallel along the Y1 direction. In addition, the electrode group 330*f* is located on the side of the side 324 of the electrode group 330*e*, and includes a plurality of electrodes provided in parallel along the Y1 direction.

Further, the flexible wiring substrates 335 which will be described later are electrically coupled to the respective electrode groups 330*a* to 330*f*. That is, the print head 23 includes the plurality of flexible wiring substrates 335 electrically coupled to the substrate 320, and each of the plurality of flexible wiring substrates 335 is electrically coupled to each of the electrode groups 330*a* to 330*f* provided in the surface 322 of the substrate 320. In other words, the flexible wiring substrates 335 are electrically coupled to the surface 322 of the substrate 320.

Here, each of the FPC insertion holes 332*a* to 332*c* is an insertion hole into which the substrate 320 is inserted, and a width of each of the FPC insertion holes 332*a* to 332*c* in a direction parallel to the side 323 which is the Y1 direction is larger than a width in a direction parallel to the side 326 which is the X1 direction. Further, the respective FPC insertion holes 332*a* to 332*c* are located in line to be parallel to the side 325 which is the X1 direction. That is, the substrate 320 includes the FPC insertion hole 332*a* through which the flexible wiring substrate 335 is inserted and the FPC insertion hole 332*b* through which the flexible wiring substrate 335 is inserted. A width in a direction along the side 323 of the FPC insertion hole 332*a* is larger than a width in a direction along the side 326, and the FPC insertion hole 332*a* and the FPC insertion hole 332*b* are located so that at least portions thereof overlap in the direction along the side 326.

The flexible wiring substrates 335 are inserted into the respective FPC insertion holes 332*a* to 332*c* which are located as above. Specifically, the FPC insertion hole 332*a* is located between the electrode group 330*a* and the electrode group 330*b* in the X1 direction. Further, the flexible wiring substrate 335 electrically coupled to the electrode group 330*a* and the flexible wiring substrate 335 electrically coupled to the electrode group 330*b* are inserted into the FPC insertion hole 332*a*. In addition, the FPC insertion hole 332*b* is located between the electrode group 330*c* and the electrode group 330*d* in the X1 direction. Further, the flexible wiring substrate 335 electrically coupled to the electrode group 330*c* and the flexible wiring substrate 335 electrically coupled to the electrode group 330*d* are inserted into the FPC insertion hole 332*b*. In addition, the FPC insertion hole 332*c* is located between the electrode group 330*e* and the electrode group 330*f* in the X1 direction. Further, the flexible wiring substrate 335 electrically coupled to the electrode group 330*e* and the flexible wiring substrate 335 electrically coupled to the electrode group 330*f* are inserted into the FPC insertion hole 332*c*.

Here, the FPC insertion hole 332*a* is an example of a first FPC insertion hole, and the FPC insertion hole 332*b* is an example of a second FPC insertion hole. Further, the flexible wiring substrate 335 electrically coupled to the substrate 320 and inserted into the FPC insertion hole 332*a* is an example of a first flexible wiring substrate, and the flexible wiring substrate 335 electrically coupled to the substrate 320 and inserted into the FPC insertion hole 332*b* is an example of a second flexible wiring substrate.

The ink supply path insertion hole 331*a* is located on a side of the side 323 of the electrode group 330*a* in the X1 direction. In addition, the ink supply path insertion holes 331*b* and 331*c* are located between the electrode group 330*b* and the electrode group 330*c* in the X1 direction, and are located in line along the Y1 direction such that the ink supply path insertion hole 331*b* is on the side of the side 325 and the ink supply path insertion hole 331*c* is on the side of the side 326. The ink supply path insertion holes 331*d* and 331*e* are located between the electrode group 330*d* and the electrode group 330*e* in the X1 direction, and are located in line along the Y1 direction such that the ink supply path insertion hole 331*d* is on the side of the side 325 and the ink supply path insertion hole 331*e* is on the side of the side 326. The ink supply path insertion hole 331*f* is located on the side of the side 324 of the electrode group 330*f* in the X1 direction.

The ink supply ports 661, which introduce the ink to the discharge sections 600 corresponding to the respective nozzle rows L1 to L6, are inserted into the respective ink supply path insertion holes 331*a* to 331*f* which are provided as above.

Figure 19:
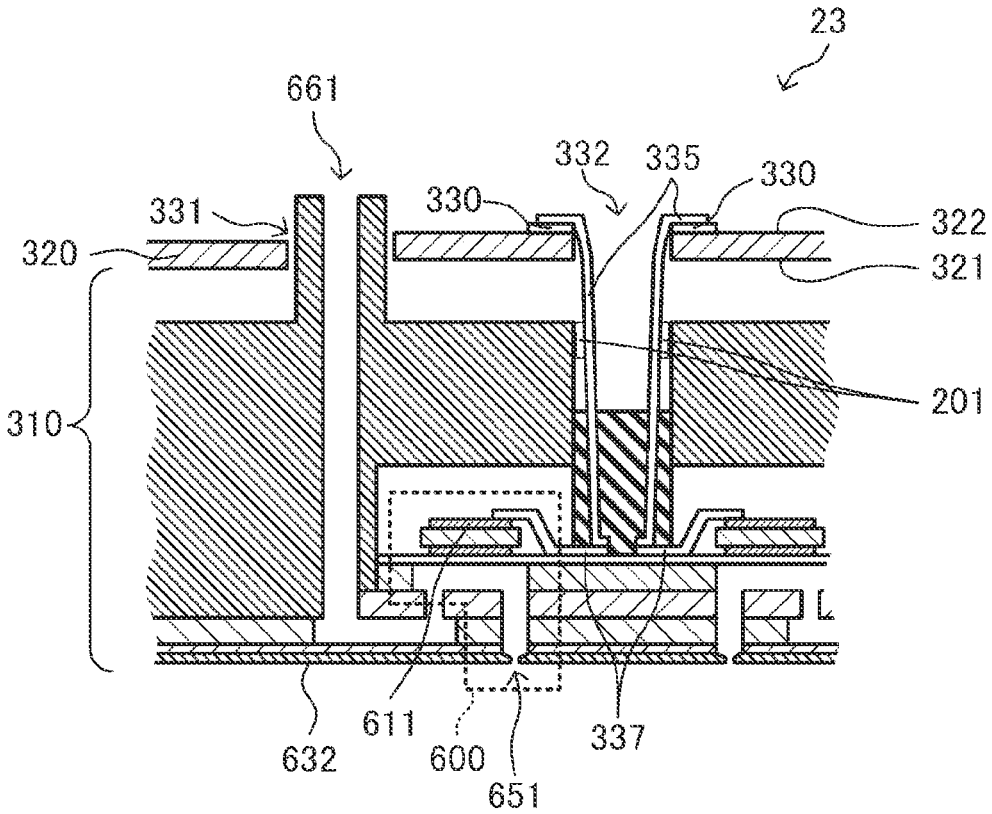
FIG. 19 is a diagram illustrating a cross section of the print head when the print head is cut so as to include an FPC insertion hole and an ink supply path insertion hole.

Here, a relationship between the flexible wiring substrates 335, which are inserted into the FPC insertion holes 332*a* to 332*c*, the ink supply ports 661, which are inserted into the ink supply path insertion holes 331*a* to 331*f*, and the substrate 320 will be described with reference to FIG. 19. FIG. 19 is a diagram illustrating a cross section of the print head 23 when cutting is performed such that the print head 23 includes at least any of the FPC insertion holes 332*a* to 332*c* or at least any of the ink supply path insertion holes 331*a* to 331*f*. Note that, in description with reference to FIG. 19, the FPC insertion holes 332*a* to 332*c* are simply referred to as the FPC insertion hole 332, the ink supply path insertion holes 331*a* to 331*f* are simply referred to as the ink supply path insertion hole 331, and the electrode groups 330*a* to 330*f* are simply referred to as the electrode group 330.

As illustrated in FIG. 19, the flexible wiring substrate 335 is inserted into the FPC insertion hole 332. The flexible wiring substrate 335 has one end coupled to the electrode group 330 provided in the surface 322 of the substrate 320 and another end coupled to one end of the electrode wiring 337. Further, another end of the electrode wiring 337 is coupled to the electrode 611 of the piezoelectric element 60. In addition, an integrated circuit device 201 is mounted on the flexible wiring substrate 335 in a Chip On Film (COF) manner. That is, the integrated circuit device 201 is located between the nozzle plate 632 and the substrate 320. The integrated circuit device 201 includes the driving signal selection circuit 200 and the temperature abnormality detection circuit 250. Further, when the print data signal SI1, the change signal CH, the latch signal LAT, the clock signal SCK, and the driving signal COM are input to the integrated circuit device 201 through the electrode group 330, the driving signal selection circuit 200 included in the integrated circuit device 201 generates and outputs the driving signal VOUT.

Further, the integrated circuit device 201 supplies the generated driving signal VOUT to the electrode 611 of the piezoelectric element 60 through the electrode wiring 337. Here, although not illustrated in FIG. 19, an integrated circuit device 241 including the diagnostic circuit 240 which will be described later is provided in the surface 321 of the substrate 320 in a space formed between the substrate 320 and the head 310. That is, the integrated circuit device 241 is located between the nozzle plate 632 and the substrate 320. For example, the space in which the integrated circuit device 241 is located is formed in such a way that the head 310 has a recess in a part of the surface fixed to the substrate 320. Here, the integrated circuit device 201, which includes the driving signal selection circuit 200 and is provided on the flexible wiring substrate 335, is an example of a second integrated circuit.

In addition, the ink supply port 661 that supplies the ink to the print head 23 is inserted through the ink supply path insertion hole 331 of the substrate 320. That is, the ink supply port 661 is located on the side of the surface 322 of the substrate 320, and the discharge section 600 is located on the side of the surface 321 of the substrate 320. Further, the substrate 320 is located between the nozzle plate 632, on which the nozzles 651 are formed, and the ink supply port 661. In other words, the substrate 320 includes the ink supply path insertion hole 331 through which the ink supply port 661 is inserted, and the print head 23 includes the ink supply port 661 through which the ink is supplied. Further, the substrate 320 is provided in a location where the shortest distance between the ink supply port 661 and the surface 321 is longer than the shortest distance between the ink supply port 661 and the surface 322. That is, the ink supply port 661 is located on the side of the surface 322 of the substrate 320 and on the −Z1 side corresponding to the upper side than the substrate 320 in a direction along the Z1 direction. Here, the ink supply port 661 is an example of a liquid supply port, and the ink supply path insertion hole 331 is an example of a liquid supply port insertion hole.

Returning to FIGS. 17 and 18, the substrate 320 includes fixing holes 346 to 349 for fixing the substrate 320 included in the print head 23. The fixing holes 346 to 349 are through holes which pass through the surface 321 and the surface 322 of the substrate 320. Further, not-shown fixing members are inserted into the fixing holes 346 to 349. That is, the print head 23 includes the fixing members for fixing the substrate 320, and the substrate 320 includes the fixing holes 346 to 349 into which the fixing members are inserted. Further, when the substrate 320 is fixed by the fixing members, the print head 23 is incorporated in the head unit 20.

Here, for example, screws can be used as the fixing members that fix the substrate 320. Specifically, when the screws are inserted through the fixing holes 346 to 349 and the screws are tightened, the print head 23 including the substrate 320 is fixed to the head unit 20. In addition, when the head unit 20 has protrusions serving as the fixing members that fix the substrate 320, and the protrusions are inserted through the fixing holes 346 to 349 and fitted to each other, the print head 23 including the substrate 320 may be fixed to the head unit 20. Further, the print head 23 including the substrate 320 may be incorporated in the head unit 20 by using the above-mentioned screw and the protrusion as the fixing member. Here, any of the fixing holes 346 to 349 is an example of a fixing member insertion hole. Note that, in the following description, description will be performed while it is assumed that the fixing hole 347 in the fixing holes 346 to 349 corresponds to the fixing member insertion hole of the present embodiment.

The fixing holes 346 and 347 are located on the side of the side 323 of the ink supply path insertion hole 331*a* in the X1 direction, and are provided in line along the Y1 direction such that the fixing hole 346 is on the side of the side 325 and the fixing hole 347 is on the side of the side 326. In addition, the fixing holes 348 and 349 are located on the side of the side 324 of the ink supply path insertion hole 331*f* in the X1 direction, and are provided in line along the Y1 direction such that the fixing hole 348 is on the side of the side 325 and the fixing hole 349 is on the side of the side 326.

In addition, as illustrated in FIG. 18, the integrated circuit device 241, the first connector 350, and the head 310 are provided in the surface 321 of the substrate 320. The integrated circuit device 241 includes the diagnostic circuit 240 illustrated in FIG. 2. Further, the integrated circuit device 241 diagnoses whether or not it is possible to normally discharge the ink from the nozzles 651 based on the latch signal LAT, the change signal CH, the print data signal SI1, and the clock signal SCK. In other words, the integrated circuit device 241 diagnoses the presence or absence of the operation abnormality of the print head 23 based on the latch signal LAT, the change signal CH, the print data signal SI1, and the clock signal SCK, which are the digital signals input from the first connector 350. In addition, the abnormality signal cXHOT is input to the integrated circuit device 241 from the temperature abnormality detection circuits 250-1 to **250-*m*. Further, the integrated circuit device 241 determines the presence or absence of the temperature abnormality of the print head 23 based on the abnormality signal cXHOT. Further, the integrated circuit device 241 outputs the abnormality signal XHOT indicating presence or absence of the abnormality of the print head 23 based on at least any one of whether or not it is possible to normally discharge the ink from the nozzle 651 and whether or not temperature abnormality exists in the print head 23**.

That is, the integrated circuit device 241 is provided in the surface 321 of the substrate 320, and is electrically coupled to the first connector 350 through the first connector 350 so that the digital signals, such as the latch signal LAT, the change signal CH, the print data signal SI1, and the clock signal SCK, are input and the abnormality signal XHOT indicating the presence or absence of the abnormality of the print head 23 is output. The integrated circuit device 241 is an example of a first integrated circuit.

In addition, the integrated circuit device 241 includes a plurality of electrodes to which the digital signals, such as the latch signal LAT, the change signal CH, the print data signal SI1, and the clock signal SCK, are input. Further, the integrated circuit device 241 is electrically coupled to the substrate 320 via the plurality of electrodes. That is, the integrated circuit device 241 includes the plurality of electrodes electrically coupled to the substrate 320. In this case, it is preferable that the integrated circuit device 241 is a surface mount component mounted on the surface 321 of the substrate 320. In this case, it is preferable that the integrated circuit device 241 and the substrate 320 are electrically coupled via bump electrodes. That is, it is preferable that the plurality of electrodes included in the integrated circuit device 241 are not inserted into the surface 322 of the substrate 320. Therefore, it possible to effectively utilize the mounting area on the side of the surface 322 of the substrate 320, and, as a result, it is possible to reduce a size of the substrate 320 and the print head 23 including the substrate 320.

As above, in the print head 23, the integrated circuit device 241 including the diagnostic circuit 240 is provided in the surface 321 of the substrate 320, similarly to the head 310. That is, the shortest distance between the surface 321 of the substrate 320, on which the integrated circuit device 241 including the diagnostic circuit 240 is provided, the head 310, and the nozzle plate 632 included in the head 310 is shorter than the shortest distance between the surface 322 of the substrate 320, the head 310, and the nozzle plate 632 included in the head 310. In other words, in the print head 23, the substrate 320 is provided so that the surface 322 is located on the −Z1 side, which is upstream in the ink discharge direction, along the Z1 direction that is the discharge direction in which ink is discharged, and the surface 321 is located on the +Z1 side which is downstream in the ink discharge direction. Further, the integrated circuit device 241, which includes the diagnostic circuit 240, and the head 310 are provided in the surface 321 of the substrate 320 provided downstream the discharge direction.

In addition, as illustrated in FIG. 18, the integrated circuit device 241 is provided on the side of the surface 321 of the substrate 320 at a place which is not adjacent to the first connector 350, and on the side of the side 326 rather than any of areas of the FPC insertion holes **332*a* to 332*c*. That is, the shortest distance between the integrated circuit device 241 and the side 326 is shorter than the shortest distance between the FPC insertion hole 332*a* and the side 326, and the shortest distance between the integrated circuit device 241 and the side 326 is shorter than the shortest distance between the FPC insertion hole 332*b* and the side 326. In other words, the integrated circuit device 241 is located in an area other than between the FPC insertion holes 332*a* to 332*c* of the substrate 320** in the Y1 direction.

Further, the integrated circuit device 241 is located in an area in which the shortest distance between a virtual line A, which has an equal distance from the side 323 and the side 324, and the integrated circuit device 241 is shorter than the shortest distance between the side 323 and the integrated circuit device 241 and the shortest distance between the virtual line A and the integrated circuit device 241 is shorter than the shortest distance between the side 324 and the integrated circuit device 241. That is, the integrated circuit device 241 is located in a vicinity of a center of the substrate 320.

Further, the integrated circuit device 241 is located between the substrate 320 and the head 310. Specifically, as illustrated in FIG. 18, when the print head 23 is viewed from the +Z1 side, the integrated circuit device 241 is provided in a location which overlaps the head 310 and is, for example, as illustrated in FIG. 19, a space formed by the substrate 320 and the head 310. Note that, the space formed by the substrate 320 and the head 310 is not limited to the space formed by only the substrate 320 and the head 310, and may be, for example, a space formed to include the substrate 320, the head 310, and an adhesive for fixing the head 310 to the substrate 320.

Figure 20:
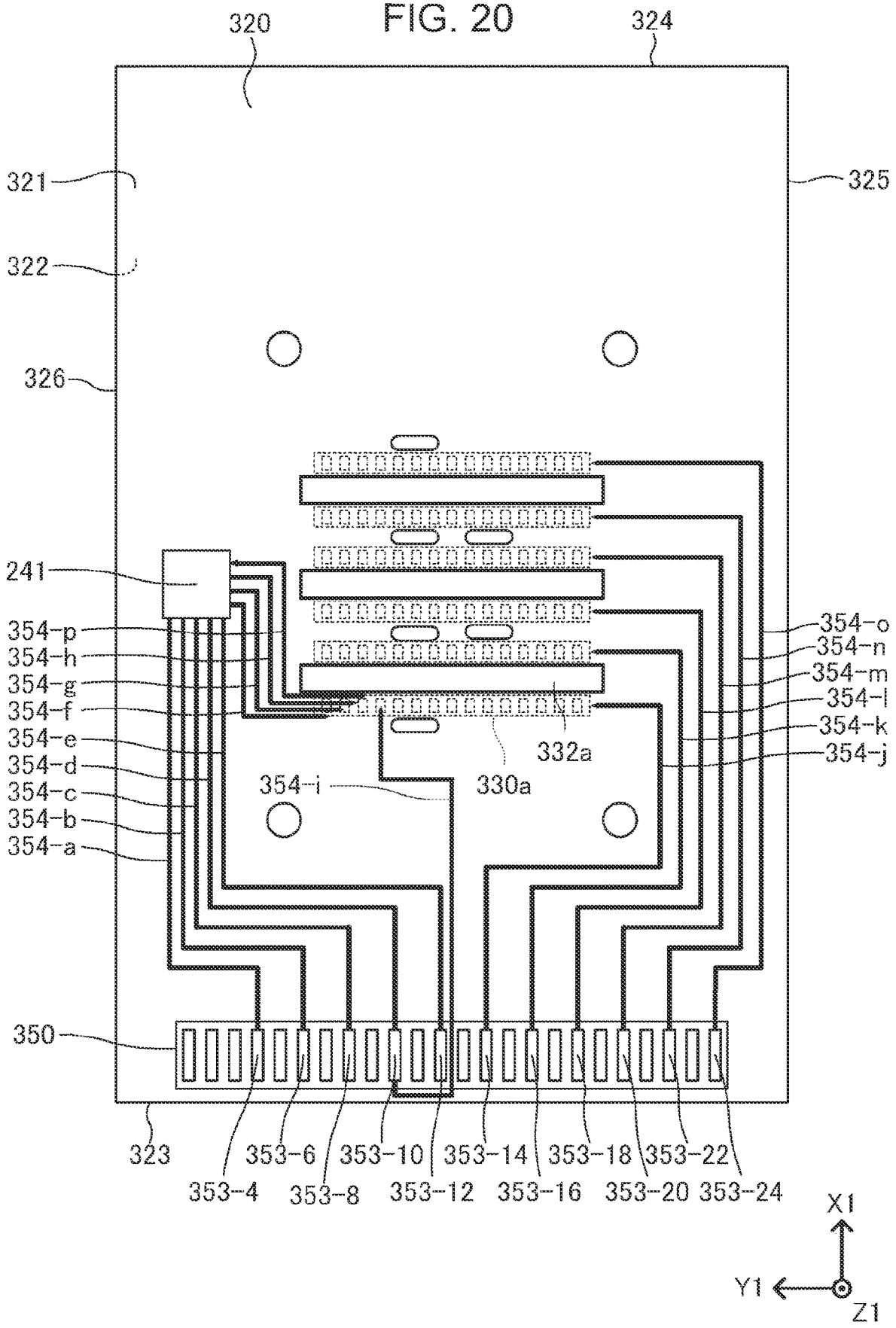
FIG. 20 is a diagram illustrating an example of wiring formed on a surface of the substrate.

Next, an example of a wiring pattern, which is provided in the surface 321 of the substrate 320 and which propagates the latch signal LAT, the change signal CH, the print data signal SI1, the clock signal SCK, and the abnormality signal XHOT, will be described with reference to FIG. 20. FIG. 20 is a diagram illustrating an example of wiring formed in the surface 321 of the substrate 320. Note that, in FIG. 20, a part of the wiring pattern formed in the substrate 320 is not illustrated. In addition, in FIG. 20, the electrode groups **330*a* to 330*f* formed in the surface 322 of the substrate 320** are illustrated using broken lines.

As illustrated in FIG. 20, wirings **354-*a* to 354-*p* are provided in the surface 321 of the substrate 320**.

The terminal 353-4 is electrically coupled to the wiring **354-*a*. After the latch signal LAT, which is input from the terminal 353-4, is propagated through the wiring 354-*a*, the latch signal LAT is input to the integrated circuit device 241. That is, the wiring 354-*a* electrically couples the terminal 353-4 to the electrodes of the integrated circuit device 241**, and the latch signal LAT is propagated therethrough.

The terminal 353-6 is electrically coupled to the wiring **354-*b*. After the clock signal SCK, which is input from the terminal 353-6, is propagated through the wiring 354-*b*, the clock signal SCK is input to the integrated circuit device 241. That is, the wiring 354-*b* electrically couples the terminal 353-6 to the electrodes of the integrated circuit device 241**, and the clock signal SCK is propagated therethrough.

The terminal 353-8 is electrically coupled to the wiring **354-*c*. After the change signal CH, which is input from the terminal 353-8, is propagated through the wiring 354**-*c*, the change signal CH is input to the integrated circuit device 241. That is, the wiring 354-*c* electrically couples the terminal 353-8 to the electrodes of the integrated circuit device 241, and the change signal CH is propagated therethrough.

The terminal 353-10 is electrically coupled to the wiring 354-*d*. The print data signal SI1, which is input from the terminal 353-10, is propagated through the wiring 354-*d*, and, thereafter, is input to the integrated circuit device 241. That is, the wiring 354-*d* electrically couples the terminal 353-10 to the electrodes of the integrated circuit device 241, and the print data signal SI1 is propagated therethrough.

The integrated circuit device 241 diagnoses whether or not it is possible to normally discharge the ink in the print head 23 based on the latch signal LAT, the change signal CH, the print data signal SI1, and the clock signal SCK which are input. In other words, the integrated circuit device 241 diagnoses the presence or absence of the abnormality of the print head 23. Further, when the integrated circuit device 241 diagnoses that it is possible to normally discharge the ink in the print head 23, the integrated circuit device 241 outputs the latch signal LAT, the clock signal SCK, and the change signal CH, which are input, as the latch signal cLAT, the clock signal cSCK, and the change signal cCH, to the electrode groups 330*a* to 330*f*, respectively.

Specifically, the electrodes of the integrated circuit device 241 are electrically coupled to the respective wirings 354-*f* to 354-*h*. After the latch signal cLAT, the clock signal cSCK, and the change signal cCH, which are output from the integrated circuit device 241, are respectively propagated through the respective wirings 354-*f* to 354-*h*, the latch signal cLAT, the clock signal cSCK, and the change signal cCH are input to any of the electrodes included in the electrode group 330*a* through not-shown via or the like. Note that, FIG. 20 illustrates only the wirings 354-*f* to 354-*h*, through which the latch signal cLAT, the clock signal cSCK, and the change signal cCH that are input to the electrode group 330*a* are propagated, and does not illustrate a wiring pattern through which the latch signal cLAT, the clock signal cSCK, and the change signal cCH that are output from the integrated circuit device 241 and are input to the respective electrode groups 330*b* to 330*f* are propagated.

In addition, any of the electrodes included in the electrode group 330*a* is electrically coupled to the electrodes of the integrated circuit device 241 through the wiring 354-*p*. The abnormality signal cXHOT, which is output from the temperature abnormality detection circuit 250, is propagated through the wiring 354-*p*. Further, the abnormality signal cXHOT is input to the integrated circuit device 241. The integrated circuit device 241 generates the abnormality signal XHOT according to at least one of the presence or absence of the temperature abnormality of the print head 23 based on the abnormality signal cXHOT and the presence or absence of the abnormality of the print head 23 based on the latch signal LAT, the change signal CH, the print data signal SI1, and the clock signal SCK. The abnormality signal XHOT, which is output from the integrated circuit device 241, is propagated through the wiring 354-*e* which is electrically coupled to the terminal 353-12. Further, after the abnormality signal XHOT is propagated through the wiring 354-*d*, the abnormality signal XHOT is input to the terminal 353-12. That is, the wiring 354-*e* electrically couples the terminal 353-12 to the electrodes of the integrated circuit device 241, and the abnormality signal XHOT is propagated therethrough.

Further, as illustrated in FIG. 20, the terminal 353-10 is also electrically coupled to the wiring 354-*i*. The print data signal SI1, which is input from the terminal 353-10, is propagated through the wiring 354-*i*, and, thereafter, is input to any of the electrodes included in the electrode group 330*a* through the not-shown via or the like.

The terminal 353-14, to which the driving signal COM-1 is input, is electrically coupled to the wiring 354-*j*. The driving signal COM-1, which is input from the terminal 353-14, is propagated through the wiring 354-*j*, and, thereafter, input to any of the electrodes included in the electrode group 330*a* through the not-shown via or the like. Similarly, the respective terminals 353-16, 353-18, 353-20, 353-22, and 353-24, to which the driving signals COM-2 to COM-6 are input, are electrically coupled to the respective wirings 354-*k* to 354-*o*. Further, the respective driving signals COM-2 to COM-6 are propagated through the wirings 354-*k* to 354-*o*, and, thereafter, input to any of the electrodes included in each of the electrode groups 330*b* to 330*f* through not-shown via or the like.

In the print head 23 configured as above, a plurality of signals including the driving signals COM-1 to COM-6, the reference voltage signals CGND-1 to CGND-6, the print data signals SI1 to SI6, the latch signal LAT, the change signal CH, and the clock signal SCK, which are output from the control mechanism 10, are input to the print head 23 through the first connector 350. Further, the driving signals COM-1 to COM-6 and the reference voltage signals CGND-1 to CGND-6, which are input to the first connector 350, are input to the respective electrode groups 330*a* to 330*f* through the wirings 354-*j* to 354-*o*.

In addition, the latch signal LAT, the change signal CH, and the clock signal SCK, which are input to the first connector 350, are input to the integrated circuit device 241 through the wirings 354-*a* to 354-*c*. In this case, the wirings 354-*a* to 354-*c*, through which the latch signal LAT, the change signal CH, and the clock signal SCK are respectively propagated, are formed only in the surface 321 which is a surface on a side of the ink discharge surface 311 of the substrate 320. In other words, a via wiring, which electrically couples the surface 321 to the surface 322, is not formed in the wiring pattern through which the latch signal LAT, the change signal CH, and the clock signal SCK are respectively propagated.

In addition, the print data signal SI1, which is input to the first connector 350, branches off in the surface 321 of the substrate 320. Further, one signal of the branching print data signal SI1 is input to the integrated circuit device 241 through the wiring 354-*d* formed in the surface 321, and another signal of the branching print data signal SI1 is input to the electrode group 330*a* through the wiring 354-*i* which is formed in the surface 321 and the surface 322 of the substrate 320.

The integrated circuit device 241 performs the self-diagnosis of the print head 23 based on the latch signal LAT, the change signal CH, the clock signal SCK, and the print data signal SI1 which are input. Further, the integrated circuit device 241 detects voltages, timings, and the like of the print data signal SI1, the change signal CH, the latch signal LAT, and the clock signal SCK. When it is diagnosed that a result of the detection is in a normal range, the integrated circuit device 241 outputs the change signal cCH, the latch signal cLAT, and the clock signal cSCK. The change signal cCH, the latch signal cLAT, and the clock signal cSCK, which are output from the integrated circuit device 241, are respectively input to the electrode groups 330*a* to 330*f* through the wirings 354-*f* to 354-*h* formed in the surface 321 and the surface 322 of the substrate 320.

In addition, the temperature signal TH is input to the first connector 350 from the temperature detection circuit 210 illustrated in FIG. 2 through a not-shown wiring pattern formed in the surface 321 and the surface 322 of the substrate 320. Note that, the temperature detection circuit 210 which outputs the temperature signal TH may be provided on any of the surface 321 and the surface 322 of the substrate 320, and may be provided on the inside of the head 310.

The driving signals COM-1 to COM-6, the reference voltage signals CGND-1 to CGND-6, the high voltage signal VHV, and the low voltage signal VDD, which are input to the second connector 360, are input to the respective electrode groups 330*a* to 330*f* through the not-shown wiring pattern formed in the surface 321 and the surface 322 of the substrate 320.

In addition, the respective print data signals SI2 to SI6 which are input to the second connector 360 are input to the respective electrode groups 330*b* to 330*f* through the not-shown wiring pattern formed in the surface 321 and the surface 322 of the substrate 320.

The various signals which are input to the respective electrode groups 330*a* to 330*f* are input to the driving signal selection circuits 200-1 to 200-6 corresponding to the respective nozzle rows L1 to L6 through the flexible wiring substrate 335 electrically coupled to each of the electrode groups 330*a* to 330*f*. Further, the driving signal selection circuits 200-1 to 200-6 generate the driving signals VOUT-1 to VOUT-6 based on the input signals, and supply the driving signals VOUT-1 to VOUT-6 to the piezoelectric elements 60 included in the respective relevant nozzle rows L1 to L6. Therefore, the driving signals VOUT are supplied to the piezoelectric elements 60 included in the plurality of discharge sections 600 based on the various signals which are input to the first connector 350 and the second connector 360.

As described above, when the wiring, through which the latch signal LAT, the change signal CH, the print data signal SI1, the clock signal SCK, and the abnormality signal XHOT are propagated, is located in the surface 321 of the substrate 320, a problem is reduced in that noise or the like is superimposed on the latch signal LAT, the change signal CH, the print data signal SI1, the clock signal SCK, and the abnormality signal XHOT. As a result, accuracy of diagnosis of presence or absence of the operation abnormality of the print head 23 is improved.

1.4 Configuration of Head Unit

Figure 21:
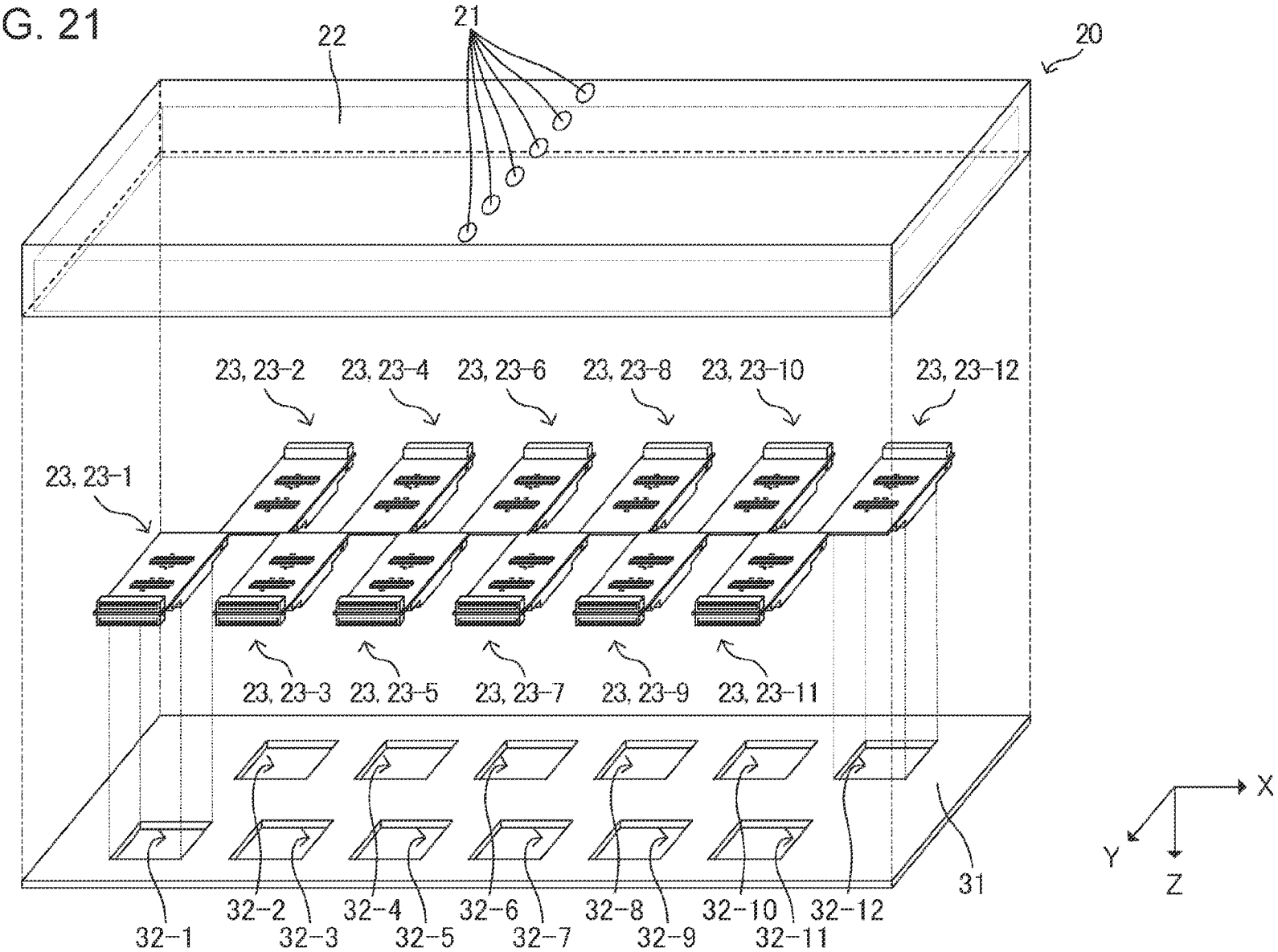
FIG. 21 is an exploded perspective diagram illustrating a configuration of the head unit.

Next, a configuration of the head unit 20 including the plurality of print heads 23 will be described. FIG. 21 is an exploded perspective diagram illustrating the configuration of the head unit 20. As illustrated in FIG. 21, the head unit 20 includes a supply unit 22, a head fixing plate 31, and a plurality of print heads 23. Here, in FIG. 21, description will be performed while it is assumed that the head unit 20 includes 12 number of print heads 23. Further, in the following description, there is a case where the 12 number of print heads 23 included in the head unit 20 is referred to as print heads 23-1 to 23-12. Note that, the number of print heads 23 included in the head unit 20 is not limited to 12.

The supply unit 22 has a plurality of ink supply ports 21. The plurality of ink supply ports 21 are opening sections provided on the −Z side of the supply unit 22. Further, each of the plurality of ink supply ports 21 is inserted into an ink channel provided inside the supply unit 22. In addition, each of the plurality of ink supply ports 21 is coupled to the liquid container 2 illustrated in FIG. 1 by a not-shown ink supply pipe or the like. The not-shown ink supply pipe is configured with, for example, a tube through which ink flows. As a result, the ink stored in the liquid container 2 is supplied to the ink channel formed inside the supply unit 22.

In addition, after the ink channel provided inside the supply unit 22 branches off inside the supply unit 22, the ink channel is coupled to the plurality of ink supply ports 661 included in each of the print heads 23-1 to 23-12. That is, the ink supplied from the liquid container 2 to the supply unit 22 via the ink supply ports 661 branches off to correspond to each of the print heads 23-1 to 23-12 in the ink channel provided inside the supply unit 22, and is supplied to each of the print heads 23-1 to 23-12 via the plurality of ink supply ports 661 included in each of the print heads 23-1 to 23-12. As described above, the head unit 20 includes the supply unit 22 that supplies the ink to each of the print heads 23-1 to 23-12.

In each of the print heads 23-1 to 23-12, the side 323 of the substrate 320 is located along the X direction orthogonal to the Z direction on the +Z side of the supply unit 22, and the side 326 is located along the Y direction orthogonal to the Z direction. That is, the substrate 320 included in each of the print heads 23-1 to 23-12 is provided so that the side 323 is orthogonal to the vertical direction and the side 326 is orthogonal to the vertical direction.

Further, the print heads 23-1 to 23-12 are disposed in the zigzag pattern along the X direction. Specifically, the print heads 23-1, 23-3, 23-5, 23-7, 23-9, and 23-11 face the +X side from the −X side and are located in line along the X direction in order of the print heads 23-1, 23-3, 23-5, 23-7, 23-9, and 23-11. In addition, the print heads 23-2, 23-4, 23-6, 23-8, 23-10, 23-12 ace the +X side from the −X side and are located in line along the X direction in order of the print heads 23-2, 23-4, 23-6, 23-8, 23-10, and 23-12 on the −Y side of the print heads 23-1, 23-3, 23-5, 23-7, 23-9, 23-11 which are located in line along the X direction. In other words, in the X direction which is a direction along the side 323 of the substrate 320 included in the print head 23-1, at least portions of the print heads 23-1, 23-3, 23-5, 23-7, 23-9, and 23-11 overlap, and, in the X direction which is a direction along the side 323 of the substrate 320 included in the print head 23-2, at least portions of the print heads 23-2, 23-4, 23-6, 23-8, 23-10 and 23-12 overlap.

In addition, when the print heads 23-1 to 23-12 disposed along the X direction are viewed from the +Y side, the print head 23-2 is located between the print heads 23-1 and 23-3, the print head 23-4 is located between the print head 23-3 and the print head 23-5, the print head 23-6 is located between the print head 23-5 and the print head 23-7, the print head 23-8 is located between the print heads 23-7 and 23-9, the print head 23-10 is located between the print heads 23-9 and 23-11, and the print head 23-12 is located on the +X side of the print head 23-11.

Here, FIG. 21 illustrates that, for each of the print heads 23-1, 23-3, 23-5, 23-7, 23-9, and 23-11 disposed along the X direction, the side 323 of the substrate 320 included in each of the print heads 23-1, 23-3, 23-5, 23-7, 23-9, and 23-11 is located on the +Y side of the head unit 20, and, for each of the print heads 23-2, 23-4, 23-6, 23-8, 23-10, and 23-12 disposed along the X direction, the side 323 of the substrate 320 included in each of the print heads 23-2, 23-4, 23-6, 23-8, 23-10, and 23-12 is located on the −Y side of the head unit 20. That is, in FIG. 21, each of the print heads 23-1, 23-3, 23-5, 23-7, 23-9, and 23-11 and each of the print heads 23-2, 23-4, 23-6, 23-8, 23-10, and 23-12 are assembled in the head fixing plate 31 in a state of being rotated by 180 degrees. Note that, in the head unit 20, the print heads 23-1 to 23-12 disposed along the X direction may be assembled in the head unit 20 in the same direction without being rotated by 180 degrees.

The head fixing plate 31 is provided on the +Z side of the print heads 23-1 to 23-12 disposed in the zigzag pattern as described above. The head fixing plate 31 includes discharge surface insertion holes 32-1 to 32-12. The ink discharge surface 311 of the head 310 included in each of the print heads 23-1 to 23-12 is inserted into each of the discharge surface insertion holes 32-1 to 32-12. In other words, each of the print heads 23-1 to 23-12 is fixed in a state in which the ink discharge surface 311 of the head 310 is inserted into each of the discharge surface insertion holes 32-1 to 32-12.

Specifically, the ink discharge surface 311 of the head 310 included in the print head 23-1 is inserted into the discharge surface insertion hole 32-1 included in the head fixing plate 31. Similarly, the ink discharge surface 311 of the head 310 of each of the print heads 23-2 to 23-12 is inserted into each of the discharge surface insertion holes 32-2 to 32-12 of the head fixing plate 31. Further, each of the print heads 23-1 to 23-12 is fixed to the head fixing plate 31 by a fixing member which is inserted through the fixing holes 346 to 349 included in the substrate 320.

In addition, the supply unit 22 is fixed to the head fixing plate 31 using a screw, an adhesive, or the like. As a result, the print heads 23-1 to 23-12 are housed in a space formed by the head fixing plate 31 and the supply unit 22. That is, the head unit 20 includes a case configured with the print heads 23-1 to 23-12 that discharges the ink, the head fixing plate 31 that houses the print heads 23-1 to 23-12, and the supply unit 22. Here, the case configured with the head fixing plate 31 and the supply unit 22 is an example of a housing.

As described above, in the head unit 20, each of the print heads 23-1 to 23-12 is provided so that the ink discharge surface 311 of the head 310 faces the head fixing plate 31 located on the +Z side of the print heads 23-1 to 23-12. That is, the surface 321 of the substrate 320 included in each of the print heads 23-1 to 23-12 faces downward in the direction along the Z direction, and the surface 322 of the substrate 320 faces upward in the direction along the Z direction. In other words, the substrate 320 included in each of the print heads 23-1 to 23-12 is provided so that the surface 321 faces downward and the surface 322 faces upward in the direction along the vertical direction.

The integrated circuit device 201, which includes the driving signal selection circuit 200 and the temperature abnormality detection circuit 250, generates the driving signal VOUT to be supplied to the plurality of piezoelectric elements 60, and thus the amount of generated heat is larger than that of the integrated circuit device 241 including the diagnostic circuit 240. In the print head 23 included in the head unit 20 included in the liquid discharge apparatus 1 according to the embodiment, the heat generated in the integrated circuit device 201 is transferred to the flexible wiring substrate 335 and the substrate 320 and is emitted from the substrate 320. In this case, the surface 321 of the substrate 320, on which the integrated circuit device 241 including the diagnostic circuit 240 is provided, faces downward in the direction along the vertical direction, and the surface 322 different from the surface 321 faces upward in the direction along the vertical direction, and thus the heat emitted from the substrate 320 is emitted in a direction different from that of the surface 321 of the substrate 320. Therefore, a problem is reduced in that the integrated circuit device 241 provided in the surface 321 of the substrate 320 is affected by the heat generated by the integrated circuit device 201. As a result, temperature rise of the integrated circuit device 241, which includes the diagnostic circuit 240, is reduced.

Further, in this case, it is preferable that the substrate 320 of each of the print heads 23-1 to 23-12 included in the head unit 20 is provided so that the side 323 is orthogonal to the Z direction which is the vertical direction and the side 326 is orthogonal to the Z direction which is the vertical direction. In other words, it is preferable that a normal direction of the surface 321 of the substrate 320 is a direction along the Z direction which is the vertical direction.

In a case where the substrate 320 is located so that the surface 321 of the substrate 320 is orthogonal to the vertical direction, a problem is further reduced in that the heat emitted from the substrate 320 affects the surface 321 of the substrate 320. As a result, the problem is further reduced in that the heat generated in the integrated circuit device 201 affects the integrated circuit device 241 provided in the surface 321 of the substrate 320, and the temperature rise of the integrated circuit device 241 including the diagnostic circuit 240 is further reduced.

Here, disposition of the nozzle rows L1 to L6 included in each of the print heads 23-1 to 23-12 in the head unit 20 will be described.

Figure 22:
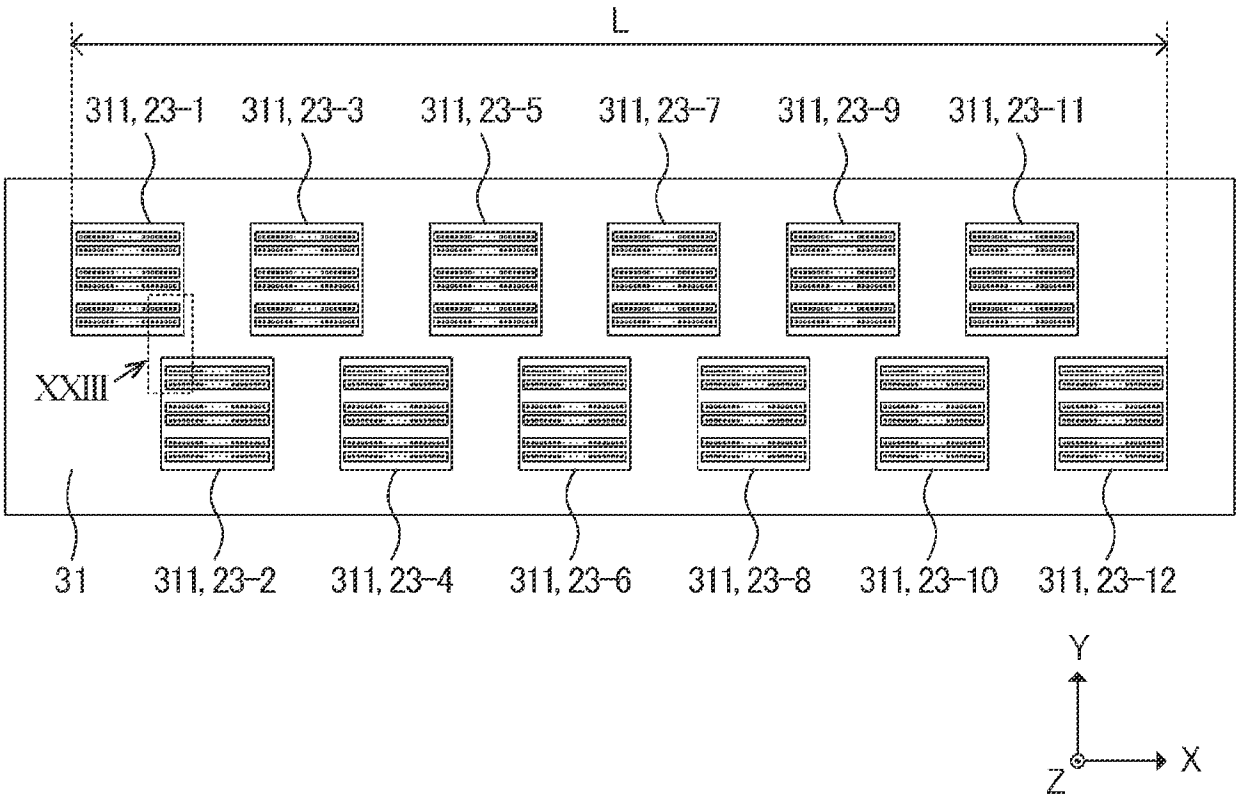
FIG. 22 is a diagram illustrating the configuration of the head unit when the head unit is viewed from a +Z side.

FIG. 22 is a diagram illustrating the configuration of the head unit 20 when the head unit 20 is viewed from the +Z side. As illustrated in FIG. 22, all the nozzle rows L1 to L6 included in each of the print heads 23-1 to 23-12 in the head unit 20 extend along the X direction. Specifically, the plurality of nozzles 651 configuring each of the nozzle rows L1 to L6 included in the print head 23-1 are located in line in a direction along the X direction. Similarly, the plurality of nozzles 651 configuring each of the nozzle rows L1 to L6 included in each of the print heads 23-2 to 23-12 are also located in line in the direction along the X direction.

Here, as described above, each of the print heads 23-1 to 23-12 includes the nozzle rows L1 to L6 in which the plurality of nozzles 651 are provided in line in the direction along the side 323 of the substrate 320. Further, in each of the print heads 23-1 to 23-12 of the head unit 20, the side 323 of the substrate 320 is located along the X direction orthogonal to the Z direction. That is, the plurality of nozzles 651 configuring each of the nozzle rows L1 to L6 included in each of the print heads 23-1 to 23-12 are provided to be disposed in the direction along the side 323 of the substrate 320 included in the print head 23-1.

In this case, when the print heads 23-1 to 23-12 disposed in the zigzag pattern along the X direction are viewed from the +Y side, the nozzle rows L1 to L6 included in each of the print heads 23-1 to 23-12 are provided t so that at least portions thereof overlap.

Specifically, when the print heads 23-1 to 23-12 disposed in the zigzag pattern along the X direction are viewed from the +Y side, the print heads 23-1 and 23-2 are located so that at least portions of the nozzle rows L1 to L6 included in the print head 23-1 and the nozzle rows L1 to L6 included in the print head 23-2 overlap. Similarly, the print heads 23-2 and 23-3 are located so that at least portions of the nozzle rows L1 to L6 included in each of the print heads 23-2 and 23-3 overlap. Similarly, the print heads 23-3 and 23-4 are located so that at least portions of the nozzle rows L1 to L6 included in each of the print heads 23-3 and 23-4 overlap. Similarly, the print heads 23-4 and 23-5 are located so that at least portions of the nozzle rows L1 to L6 included in each of the print heads 23-4 and 23-5 overlap. Similarly, the print heads 23-5 and 23-6 are located so that at least portions of the nozzle rows L1 to L6 of the print heads 23-5 and 23-6 overlap. Similarly, the print heads 23-6 and 23-7 are located so that at least portions of the nozzle rows L1 to L6 included in each of the print heads 23-6 and 23-7 overlap. Similarly, the print heads 23-7 and 23-8 are located so that at least portions of the nozzle rows L1 to L6 included in each of the print heads 23-7 and 23-8 overlap. Similarly, the print heads 23-8 and 23-9 are located so that at least portions of the nozzle rows L1 to L6 included in each of the print heads 23-8 and 23-9 overlap. Similarly, the print heads 23-9 and 23-10 are located so that at least portions of the nozzle rows L1 to L6 included in each of the print heads 23-9 and 23-10 overlap. Similarly, the print heads 23-10 and 23-11 are located so that at least portions of the nozzle rows L1 to L6 included in each of the print heads 23-10 and 23-11 overlap. Similarly, the print heads 23-11, 23-12 are located so that at least portions of the nozzle rows L1 to L6 of the print heads 23-11 and 23-12 overlap.

Figure 23:
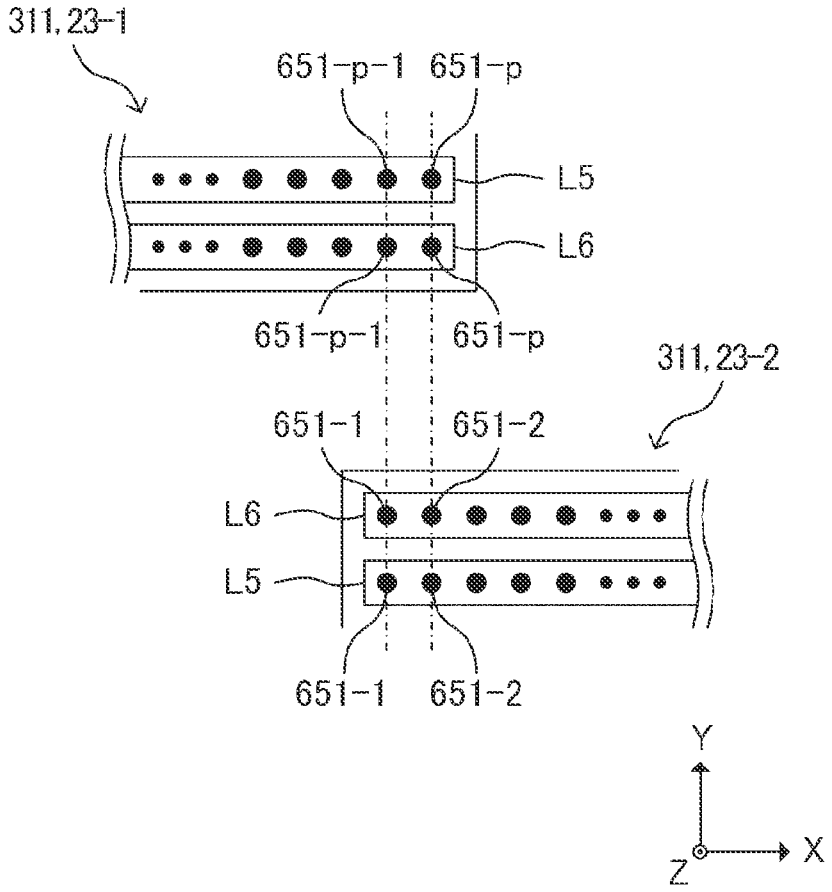
FIG. 23 is an enlarged view of a portion XXIII in FIG. 22.

Here, details of overlapping portions where at least portions of the nozzle rows L1 to L6 included in each of the print heads 23-1 to 23-12 overlap will be described with reference to FIG. 23. FIG. 23 is an enlarged view of a portion XXIII in FIG. 22. All the overlapping portions where at least portions of the nozzle rows L1 to L6 included in each of the print heads 23-1 to 23-12 overlap have the same configuration. Therefore, in FIG. 22, only the portion XXIII in which at least portions of the nozzle rows L5 and L6 included in the print head 23-1 and the nozzle rows L5 and L6 included in the print head 23-2 overlap will be described, and other portions will not be described. In addition, in the description with reference to FIG. 22, description will be performed while it is assumed that each of the nozzle rows L1 to L6 is configured to include p number of nozzles 651. Therefore, the p number of nozzles 651 are referred to as nozzles 651-1, 651-2, . . . , **651-*p*-1, and 651-*p***.

As illustrated in FIG. 22, in the portion XXIII, the nozzle **651-*p*-1 of the plurality of nozzles 651 included in the nozzle row L5 included in the print head 23-1 is located to overlap the nozzle 651-1 of the plurality of included nozzles 651 included in the nozzle row L5 included in the print head 23-2 in the Y direction. In addition, the nozzle 651-*p* of the plurality of nozzles 651 included in the nozzle row L5 included in the print head 23-1 is located to overlap the nozzle 651-2 of the plurality of nozzles 651 included in the nozzle row L5 included in the print head 23-2 in the Y direction. Similarly, the nozzle 651-*p*-1 of the plurality of nozzles 651 included in the nozzle row L6 included in the print head 23-1 is located to overlap the nozzle 651-1 of the plurality of nozzles 651 included in the nozzle row L6 included in the print head 23-2 in the Y direction. In addition, the nozzle 651-*p* of the plurality of nozzles 651 included in the nozzle row L6 included in the print head 23-1 is located to overlap the nozzle 651-2 of the plurality of nozzles 651 included in the nozzle row L6 included in the print head 23-2** in the Y direction.

That is, in the overlapping portions where at least portions of the nozzle rows L1 to L6 included in each of the print heads 23-1 to 23-12 overlap, some of the plurality of nozzles 651 configuring each of the nozzle rows L1 to L6 included in each of the print heads 23-1 to 23-12 are located to overlap in the Y direction. As a result, the nozzle rows L1 to L6 included in each of the print heads 23-1 to 23-12 form nozzle rows which are continuous in pseudo manner in a width L in the X direction. Further, in a case where the width L of the nozzle row formed in the pseudo manner is set to be equal to or larger than the width of the medium M, the head unit 20 can discharge the ink continuously in the width L.

Here, the print head 23-1 in the print heads 23-1 to **23-*n* included in the head unit 20 is an example of a first print head, the plurality of nozzles 651 included in the print head 23-1 is an example of a plurality of first nozzles, any of the nozzle rows L1 to L6 formed by the plurality of nozzles 651 included in the print head 23-1 is an example of a first nozzle row, and the nozzle plate 632 included in the print head 23-1 is an example of a first nozzle plate. In addition, the print head 23-3 in the print heads 23-1 to 23-*n* included in the head unit 20 is an example of a second print head, the plurality of nozzles 651 included in the print head 23-3 is an example of a plurality of second nozzles, any of the nozzle rows L1 to L6 formed by the plurality of nozzles 651 included in the print head 23-3 is an example of a second nozzle row, and the nozzle plate 632 included in the print head 23-3** is an example of a second nozzle plate.

1.5 Effects

In the liquid discharge apparatus 1 and the head unit 20, which are configured as described above, according to the first embodiment, the print head 23 included in the head unit 20 is provided with the integrated circuit device 201 that includes the driving signal selection circuit 200 is provided in the flexible wiring substrate 335, and the integrated circuit device 241 that includes the diagnostic circuit 240 which outputs the abnormality signal XHOT indicating presence or absence of the abnormality of the print head 23 is provided in the surface 321 of the substrate 320. Further, the substrate 320 included in the print head 23 is provided so that the surface 321 faces downward in the vertical direction and the surface 322 faces upward in the vertical direction.

In the head unit 20 configured as described above and the liquid discharge apparatus 1 including the head unit 20, the heat generated in the integrated circuit device 201 is transferred to the flexible wiring substrate 335 and the substrate 300. Further, the heat, which is generated in the integrated circuit device 201 and reaches the substrate 300, is emitted from the side of the surface 322 which is upward the substrate 300 in the vertical direction. Therefore, a problem is reduced in that the heat generated in the integrated circuit device 201 affects the integrated circuit device 241 provided in the surface 321 of the substrate 320. As a result, a problem is reduced in that the integrated circuit device 241 for executing the self-diagnosis function of the print head 23 does not operate normally.

In addition, in the liquid discharge apparatus 1 and the head unit 20 according to the first embodiment, the substrate 320 is provided so that the side 323 is orthogonal to the vertical direction and the side 326 is orthogonal to the vertical direction in the print head 23 included in the head unit 20. That is, the normal direction of the surface 321 of the substrate 320 is a direction along the vertical direction. In other words, the substrate 320 is provided so that the surface 321 and the surface 322 are orthogonal to the vertical direction. As a result, the heat, which is generated in the integrated circuit device 201 and reaches the substrate 300, is more efficiently emitted from the side of the surface 322 of the substrate 320. As a result, the problem is further reduced in that the heat, which is generated in the integrated circuit device 201 affects the integrated circuit device 241 provided in the surface 321 of the substrate 320, and the problem is further reduced in that the integrated circuit device 241 for executing the self-diagnosis function of the print head 23 does not operate normally.

In addition, in the liquid discharge apparatus 1 and the head unit 20 according to the first embodiment, the flexible wiring substrate 335 provided with the integrated circuit device 201 is electrically coupled to the surface 322 of the substrate 320. Therefore, a problem is further reduced in that the heat, which is generated in the integrated circuit device 201 and reaches the substrate 300, is given to the side of the surface 321 of the substrate 320. As a result, the problem is further reduced in that the heat, which is generated in the integrated circuit device 201 affects the integrated circuit device 241 provided in the surface 321 of the substrate 320, and the problem is further reduced in that the integrated circuit device 241 for executing the self-diagnosis function of the print head 23 does not operate normally.

In addition, in the liquid discharge apparatus 1 and the head unit 20 according to the first embodiment, the flexible wiring substrate 335 provided with the integrated circuit device 201 is inserted through the FPC insertion holes 332*a* to 332*c* included in the substrate 320, and is electrically coupled to the surface 322 of the substrate 320. That is, the substrate 320 includes the through holes which pass through the surface 321 and the surface 322 in the vicinity of the flexible wiring substrate 335. Therefore, radiant heat generated in the integrated circuit device 201 is emitted to the side of the surface 322 of the substrate 320 via the FPC insertion holes 332*a* to 332*c*. As a result, the problem is further reduced in that the heat, which is generated in the integrated circuit device 201 affects the integrated circuit device 241 provided in the surface 321 of the substrate 320, and the problem is further reduced in that the integrated circuit device 241 for executing the self-diagnosis function of the print head 23 does not operate normally.

In the liquid discharge apparatus 1 and the head unit 20, which are configured as described above, according to the first embodiment, even in the head unit 20 used for the so-called line head type liquid discharge apparatus 1 in which the print heads 23-1 to 23-12 are housed in the case and the print heads 23-1 to 23-12 are provided in line in the head unit 20 so that the nozzle rows L1 to L6 included in each of the print heads 23-1 to 23-12 are disposed to be equal to or larger than the width of the medium M, the problem is further reduced in that the heat generated in the integrated circuit device 201 affects the integrated circuit device 241, and, as a result, the problem is further reduced in that the integrated circuit device 241 for executing the self-diagnosis function of the print head 23 does not operate normally.

2. Second Embodiment

Next, a liquid discharge apparatus 1 and a head unit 20 according to a second embodiment will be described. Note that, when the liquid discharge apparatus 1 and the head unit 20 according to the second embodiment are described, the same reference symbols are attached to the components which are the same as in the first embodiment, and description thereof will not be repeated or simplified. In addition, the liquid discharge apparatus 1 and the head unit 20 according to the second embodiment is different from those of the first embodiment in a fact that disposition of the integrated circuit device 241 provided in the substrate 320 of the print head 23 included in the head unit 20.

Figure 24:
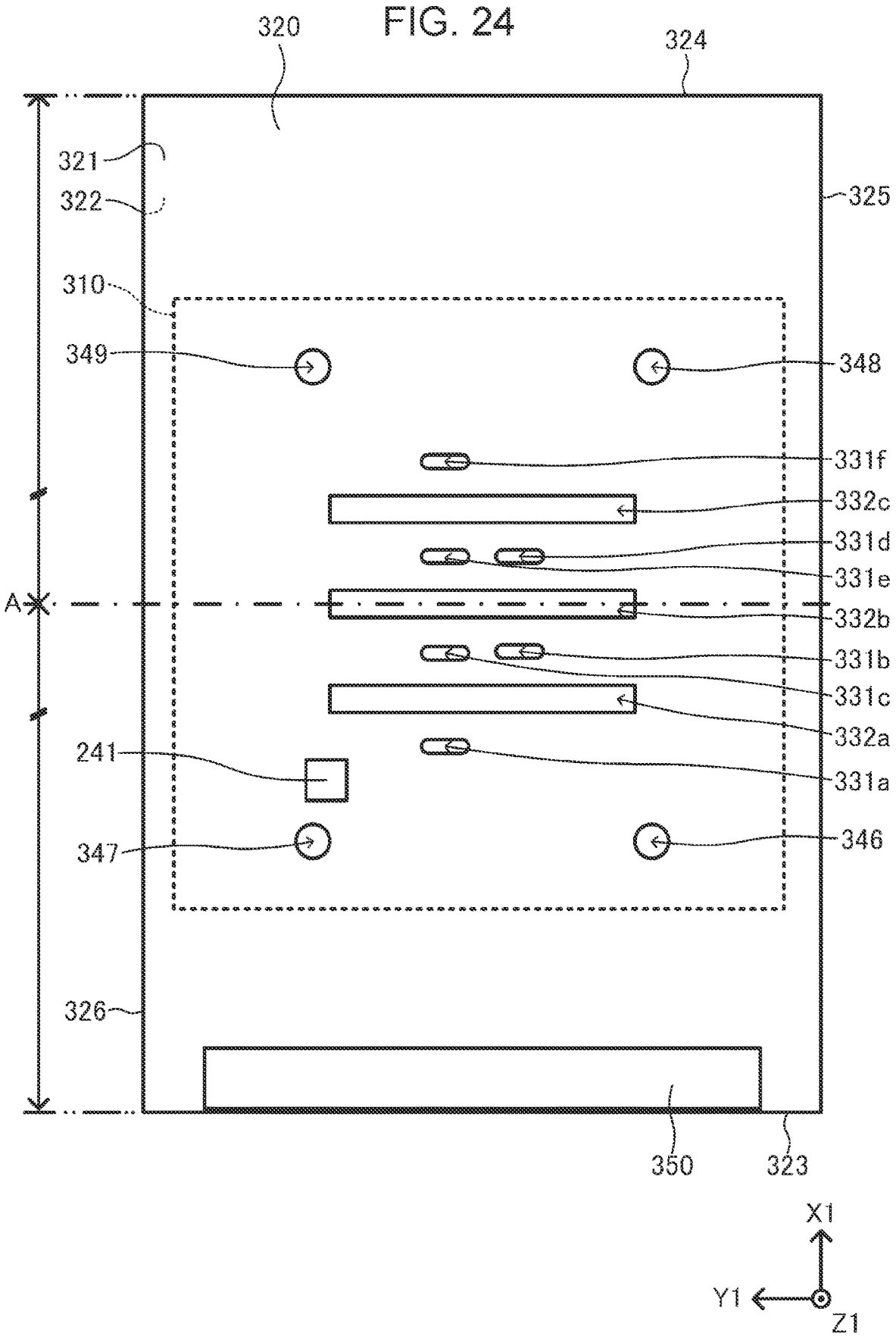
FIG. 24 is a plan diagram illustrating a case where the substrate is viewed from a surface according to a second embodiment.

FIG. 24 is a plan diagram illustrating a case where the substrate 320 included in the print head 23 included in the head unit 20 is viewed from the surface 321 according to the second embodiment. As illustrated in FIG. 24, in the print head 23 according to the second embodiment, at least a part of the integrated circuit device 241 is provided in a location overlapping the fixing hole 347, to which the fixing member is inserted, in the X1 direction along the side 325 or the side 326. That is, in the print head 23 included in the head unit 20 according to the second embodiment, at least a part of the integrated circuit device 241 overlaps the fixing member in the X1 direction.

More specifically, in the substrate 320, the first connector 350, the fixing hole 347, and the integrated circuit device 241 are located in order of the first connector 350, the fixing hole 347, and the integrated circuit device 241 in the X1 direction along the side 325 or the side 326, and at least a part of the integrated circuit device 241 overlaps the fixing member which is inserted into the fixing hole 347. Further, the fixing hole 347 is located between the first connector 350 and at least a part of the integrated circuit device 241. That is, the location of the integrated circuit device 241 is a location which is not adjacent to the first connector 350.

That is, in the liquid discharge apparatus 1 and the print head 23, which is included in the head unit 20, according to the second embodiment, the integrated circuit device 241 including the diagnostic circuit 240 is provided so that the shortest distance between the virtual line A, in which a distance from the side 323 and the side 324 of the substrate 320 is equal, and the integrated circuit device 241 is shorter than the shortest distance between the side 323 and the integrated circuit device 241 and the shortest distance between the virtual line A and the integrated circuit device 241 is shorter than the shortest distance between the side 324 and the integrated circuit device 241. Further, the integrated circuit device 241 is provided so that the shortest distance between the side 323 and the integrated circuit device 241 is shorter than the shortest distance between the side 324 and the integrated circuit device 241.

Even in the head unit 20, which includes the print head 23 configured as described above, and the liquid discharge apparatus 1, which includes the head unit 20, the substrate 320 included in the print head 23 is provided so that the surface 321 faces downward and the surface 322 faces upward in the direction along the vertical direction, and thus it is possible to exhibit the same effects as in the liquid discharge apparatus 1 and the head unit 20 according to the first embodiment.

Note that, in FIG. 24, the integrated circuit device 241 is located in a vicinity of the fixing hole 347. However, at least a part of the integrated circuit device 241 may be provided in a location overlapping the fixing member which is inserted into the fixing hole 347 in the direction along the side 325 or the side 326 and may be provided, for example, at a center of the substrate 320.

3. Third Embodiment

Next, a liquid discharge apparatus 1 and a head unit 20 according to a third embodiment will be described. Note that, when the liquid discharge apparatus 1 and the head unit 20 according to the third embodiment are described, the same reference symbols are attached to the components which are the same as in the first embodiment and the second embodiment, and description thereof will not be repeated or simplified. In addition, the liquid discharge apparatus 1 and the head unit 20 according to the third embodiment is different from those of the first embodiment and the second embodiment in a fact that a print head 23 included in the head unit 20 includes four connectors electrically coupled to the control mechanism 10.

Figure 25A:
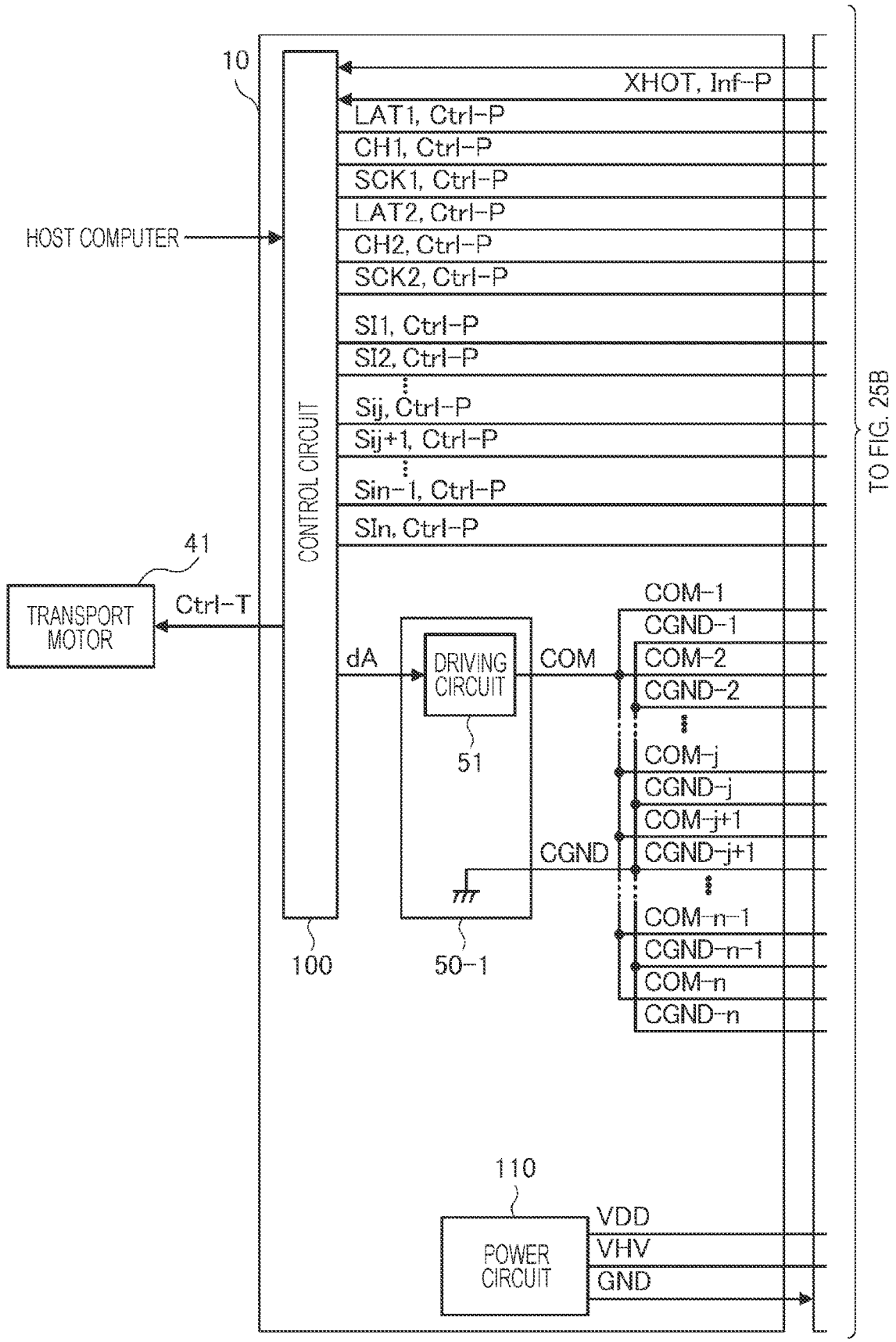
FIG. 25A is a first half of a block diagram illustrating an electrical configuration of a print head according to a third embodiment.
Figure 25B:
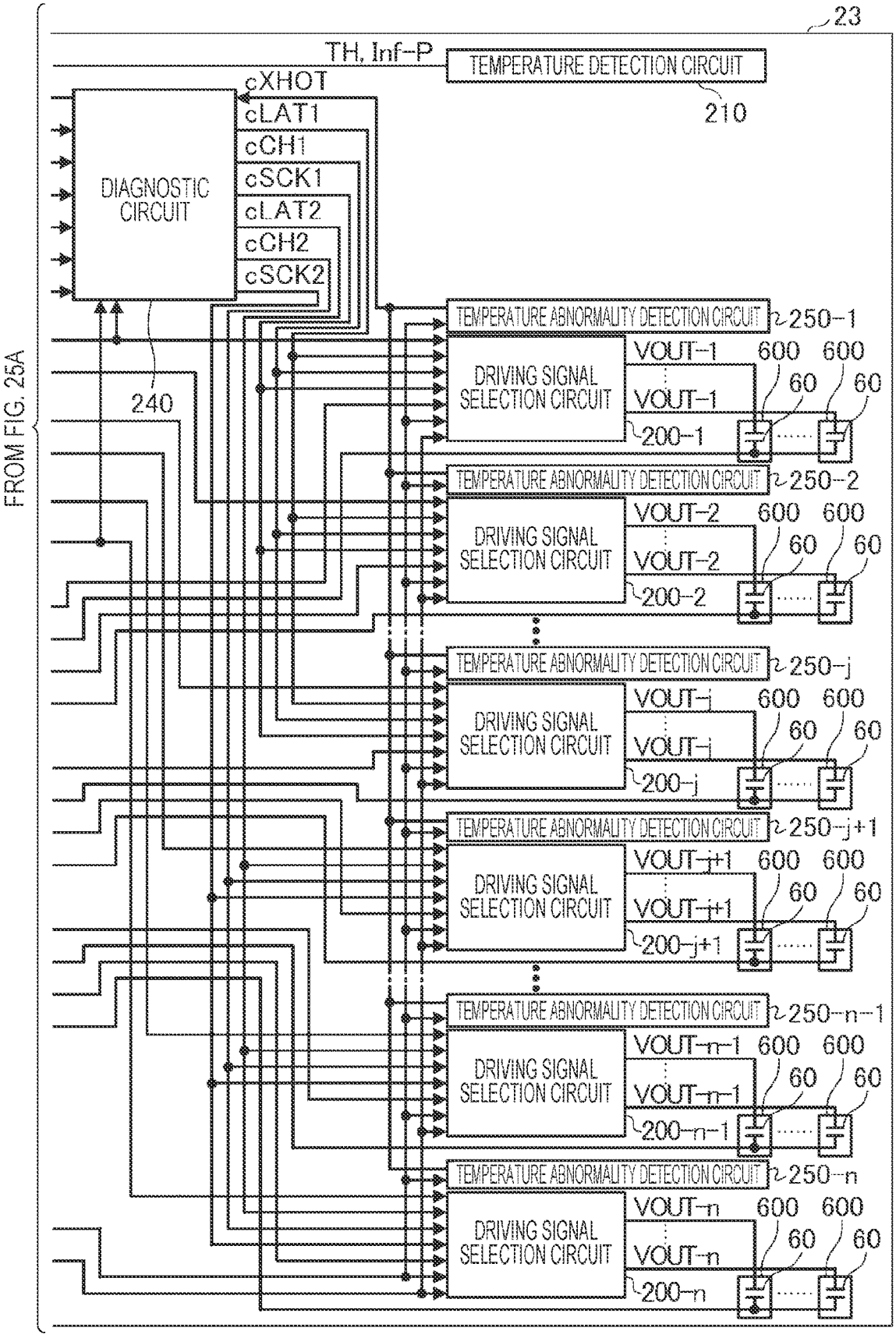
FIG. 25B is a second half of the block diagram illustrating the electrical configuration of the print head according to the third embodiment.

FIGS. 25A and 25B are block diagrams illustrating an electrical configuration of the print head 23 according to the third embodiment in a block diagram illustrating an electrical configuration of the liquid discharge apparatus 1 according to the third embodiment. Note that, the electrical configurations of the control mechanism 10 and the head unit 20 according to the third embodiment are the same as those of the liquid discharge apparatus 1 according to the first embodiment illustrated in FIG. 2, and the description thereof will not be repeated.

As illustrated in FIGS. 25A and 25B, a control circuit 100 according to the third embodiment generates, as a control signal Ctrl-P for controlling the print head 23 based on various signals, such as image data, which are input from a host computer, two latch signals LATa and LATb for prescribing ink discharge timing, two change signals CHa and CHb for prescribing timing at which a waveform of a driving signal COM is switched, two clock signals SCKa and SCKb for inputting a print data signal SI, and outputs the generated signals to the print head 23. Here, the two latch signals LATa and LATb, the two change signals CHa and CHb, and the two clock signals SCKa and SCKb respectively serve as the signals for performing the self-diagnosis of the print head 23.

The latch signals LATa and LATb, the change signals CHa and CHb, the clock signals SCKa and SCKb, and print data signals SI1 and Sin are input to a diagnostic circuit 240 included in the print head 23. Further, the diagnostic circuit 240 diagnoses whether or not it is possible for the print head 23 to normally discharge the ink based on the latch signals LATa and LATb, the change signals CHa and CHb, the clock signals SCKa and SCKb, and the print data signals SI1 and Sin.

Specifically, the diagnostic circuit 240 performs the diagnosis of whether or not it is possible for the print head 23 to normally discharge the ink based on the print data signal SI1, the change signal CHa, the latch signal LATa, and the clock signal SCKa. Further, when it is determined that it is possible for the print head 23 to normally discharge the ink, the diagnostic circuit 240 outputs a change signal cCHa, a latch signal cLATa, and a clock signal cSCKa. In addition, the diagnostic circuit 240 performs the diagnosis of whether or not it is possible for the print head 23 to normally discharge the ink based on the print data signal SIn, the change signal CHb, the latch signal LATb, and the clock signal SCKb. Further, when it is determined that it is possible for the print head 23 to normally discharge the ink, the diagnostic circuit 240 outputs the change signal cCHb, the latch signal cLATb, and the clock signal cSCKb. The change signal cCHa, the latch signal cLATa, and the clock signal cSCKa, which are output from the diagnostic circuit 240, are input to any of n number of driving signal selection circuits 200, and the change signal cCHb, the latch signal cLATb, and the clock signal cSCKb are input to any of another n number of driving signal selection circuits 200.

In addition, the diagnostic circuit 240 generates an abnormality signal XHOT based on a result of the diagnosis of whether or not it is possible for the print head 23 to normally discharge the ink, and outputs the abnormality signal XHOT to the control circuit 100.

The driving signal selection circuit 200 generates driving signals VOUT-1 to VOUT-n based on any of the print data signals SI1 to SIn, one of the change signals cCHa and cCHb, one of the latch signals cLATa and cLATb, and one of the clock signals cSCKa and cSCKb, which are output from the diagnostic circuit 240.

Next, a configuration of the print head 23 according to the third embodiment will be described. Note that, description will be performed while it is assumed that the print head 23 according to the third embodiment includes 10 number of driving signal selection circuits 200-1 to 200-10. Therefore, the 10 number of print data signals SI1 to SI10, the 10 number of driving signals COM-1 to COM-10, and the 10 number of reference voltage signals CGND-1 to CGND-10, which correspond to the 10 number of driving signal selection circuits 200-1 to 200-10 are input to the print head 23 according to the third embodiment.

Figure 26:
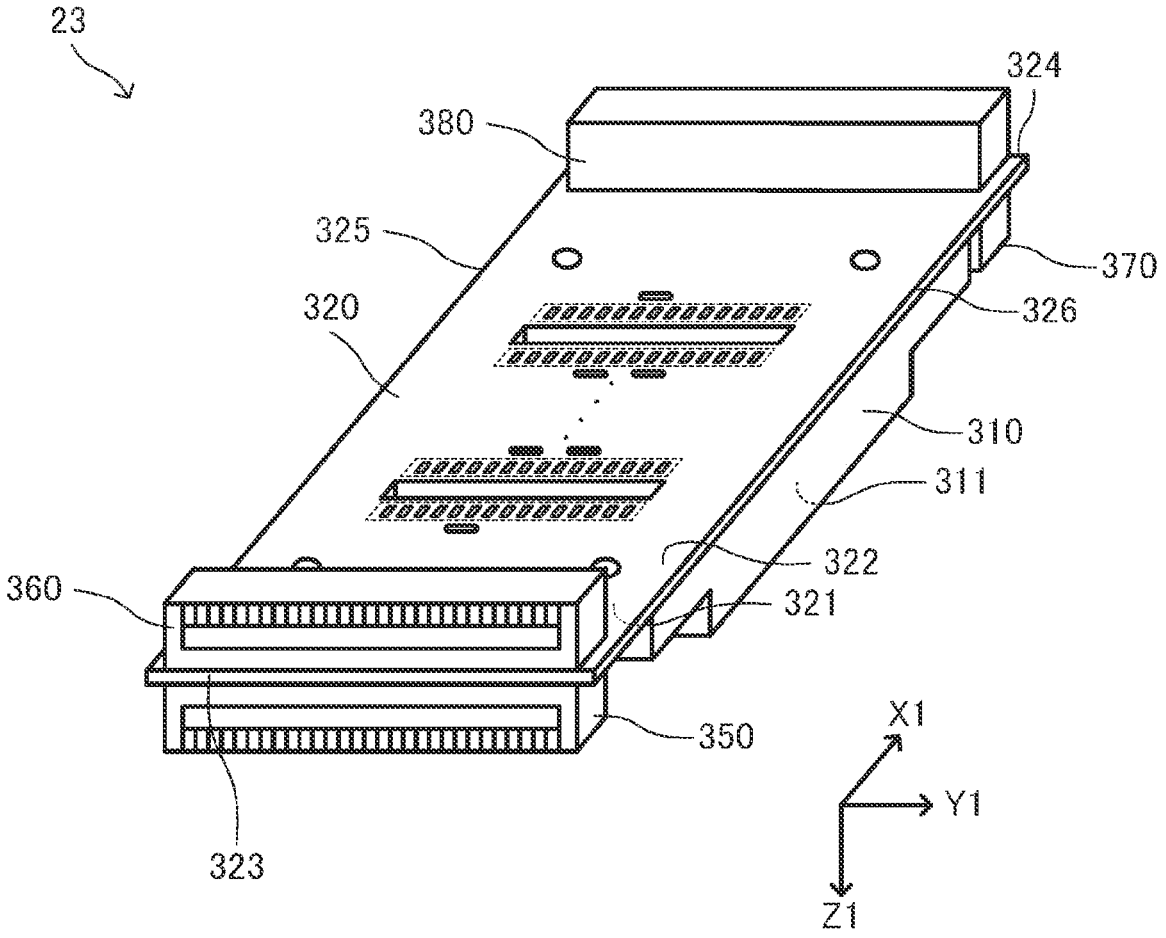
FIG. 26 is a perspective diagram illustrating a configuration of the print head according to the third embodiment.
Figure 27:
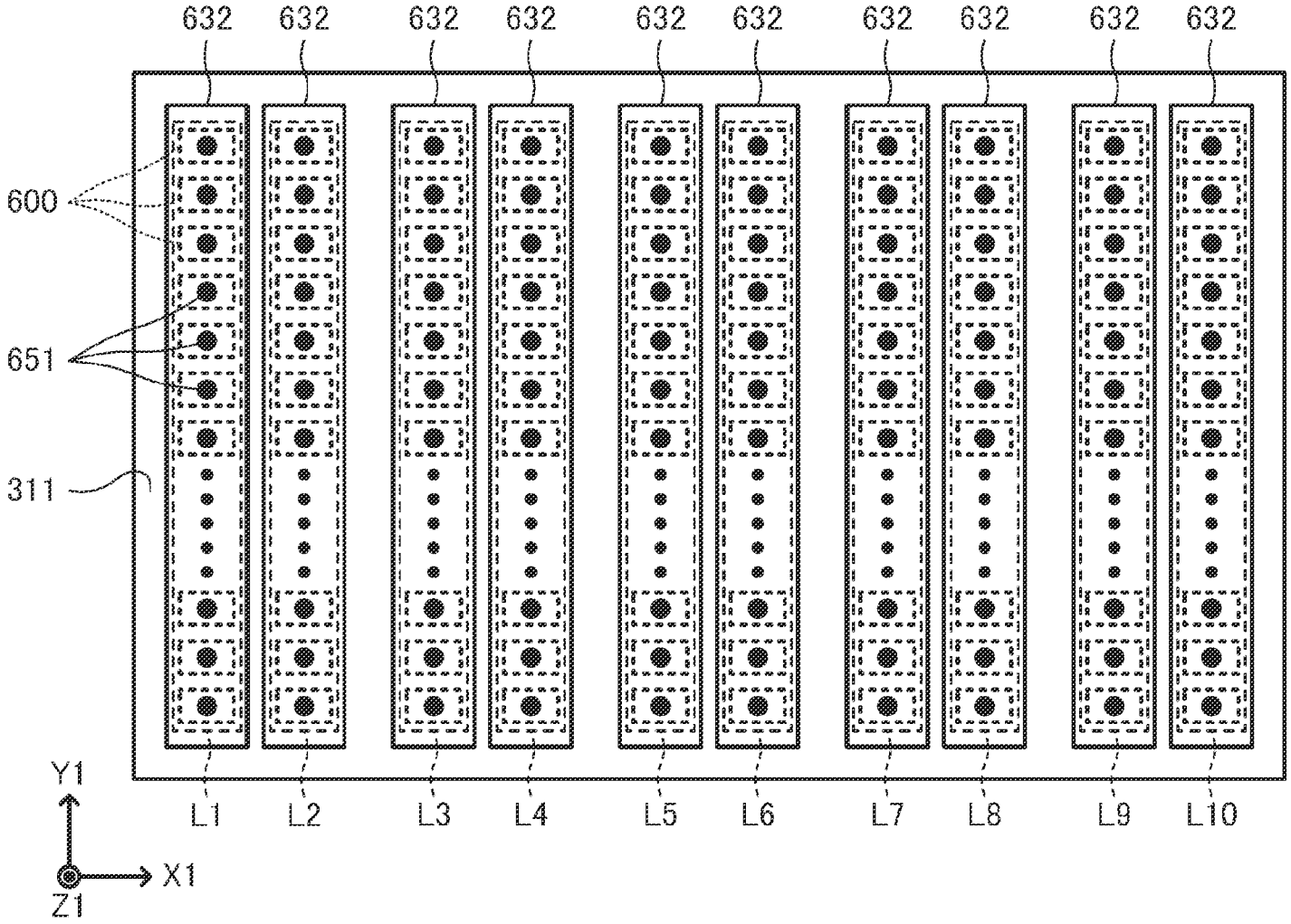
FIG. 27 is a plan diagram illustrating an ink discharge surface according to the third embodiment.

FIG. 26 is a perspective diagram illustrating the configuration of the print head 23 according to the third embodiment. As illustrated in FIG. 26, the print head 23 includes a head 310 and a substrate 320. In addition, FIG. 27 is a plan diagram illustrating an ink discharge surface 311 of the head 310 according to the third embodiment. As illustrated in FIG. 27, in the ink discharge surface 311 according to the third embodiment, ten number of nozzle plates 632, which each are formed with a plurality of nozzles 651, are provided in line along the X1 direction. In addition, nozzle rows L1 to L10, which are provided in line along the X1 direction, are formed in the respective nozzle plates 632. The respective nozzle rows L1 to L10 are provided to correspond to the respective driving signal selection circuits 200-1 to 200-10.

Returning to FIG. 26, the substrate 320 has a substantially rectangular shape formed with a surface 321 and a surface 322 which faces the surface 321, a side 323, a side 324 which faces the side 323 in the X1 direction, a side 325, and a side 326 which faces the side 325 in the Y1 direction. In other words, the substrate 320 includes the side 323, the side 324 which is different from the side 323, the side 325 which is orthogonal to the side 323 and the side 324, and the side 326 which is different from the side 325 that is orthogonal to the side 323 and the side 324.

A first connector 350, a second connector 360, a third connector 370, and a fourth connector 380 are provided in the substrate 320. The first connector 350 is provided on a side of the surface 321 of the substrate 320 along the side 323. In addition, the second connector 360 is provided on a side of the surface 322 of the substrate 320 along the side 323. Note that, the first connector 350 and the second connector 360 according to the third embodiment are different from those of the first embodiment in a fact that the number of a plurality of terminals included in each of the first connector 350 and the second connector 360 is 20, and the other configurations are the same as in the first embodiment. Therefore, detailed description of the first connector 350 and the second connector 360 according to the third embodiment will not be repeated. Note that, there is a case where 20 number of terminals 353, which are provided in parallel to the first connector 350 according to the third embodiment, are sequentially referred to as terminals 353-1, 353-2, . . . , 353-20 toward the side 325 from the side 326 in the direction along the side 323. Similarly, there is a case where 20 number of terminals 363, which are provided in parallel to the second connector 360 according to the third embodiment, are sequentially referred to as terminals 363-1, 363-2, . . . , 363-20 toward the side 326 from the side 325 in the direction along the side 323.

The third connector 370 is provided on the side of the surface 321 of the substrate 320 along the side 324. In addition, the fourth connector 380 is provided on the side of the surface 322 of the substrate 320 along the side 324.

Figure 28:
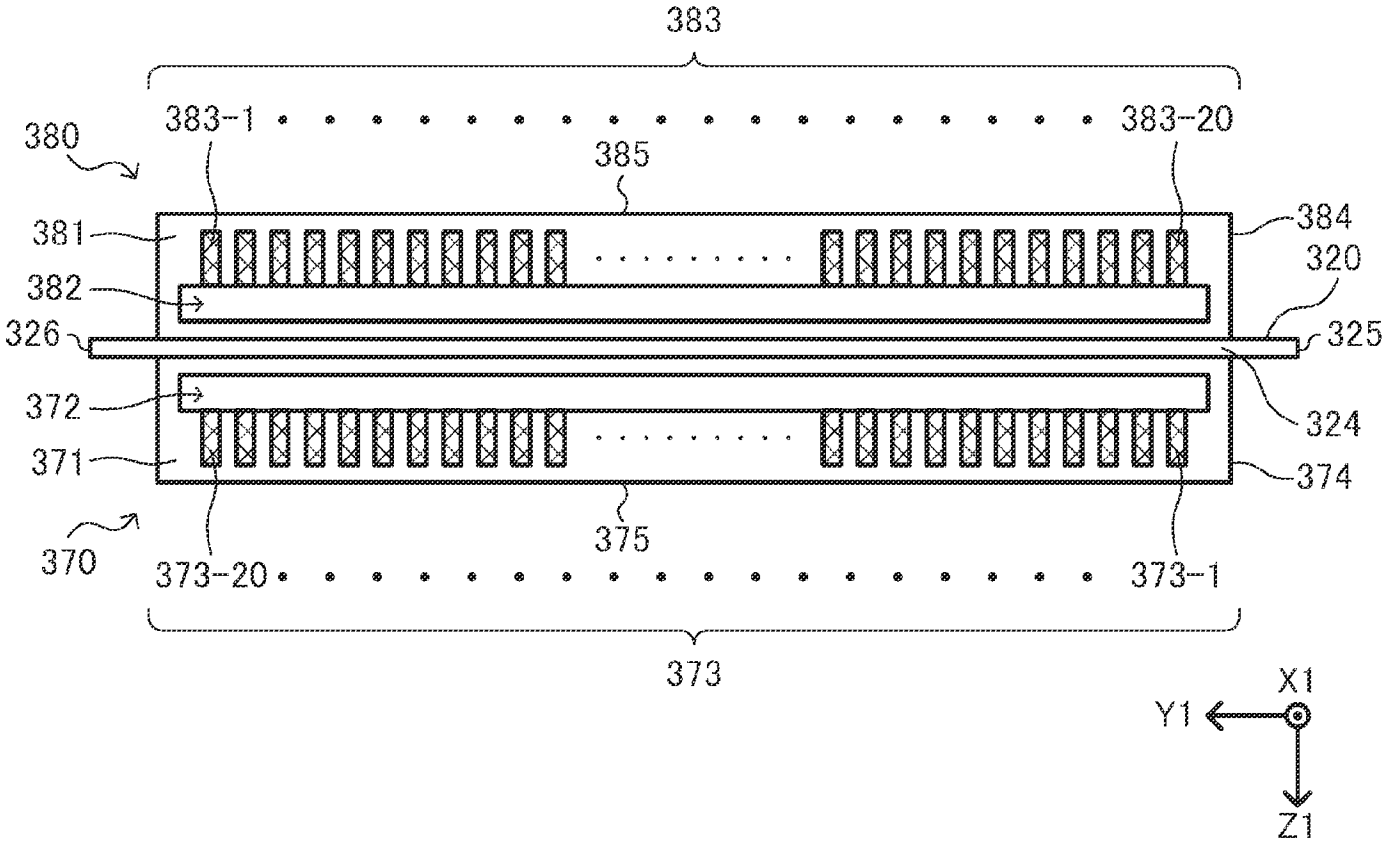
FIG. 28 is a diagram illustrating configurations of a third connector and a fourth connector.

Configurations of the third connector 370 and the fourth connector 380 will be described with reference to FIG. 28. FIG. 28 is a diagram illustrating the configurations of the third connector 370 and the fourth connector 380. The third connector 370 has a substantially rectangular parallelepiped shape including a plurality of sides having a side 374 and a side 375, which is orthogonal to the side 374 and is longer than the side 374, and a plurality of surfaces which are formed by the plurality of sides. Further, the third connector 370 is provided in the substrate 320 such that the side 375 of the third connector 370 is parallel to the side 324 of the substrate 320. The third connector 370 includes a housing 371, a cable attachment section 372, and a plurality of terminals 373. A not-shown cable, which electrically couples the control mechanism 10 to the print head 23, is attached to the cable attachment section 372. In addition, the plurality of terminals 373 are provided in parallel along the side 324. Further, when the cable is attached to the cable attachment section 372, the plurality of respective terminals included in the cable are electrically coupled to the plurality of respective terminals 373 included in the third connector 370. Therefore, the various signals output by the control mechanism 10 are input to the print head 23. Note that, in the embodiment, description will be performed while it is assumed that 20 number of terminals 373 are provided in parallel along the side 324 in the third connector 370. In addition, there is a case where the 20 number of terminals 373 provided in parallel are sequentially referred to as terminals 373-1, 373-2, . . . , 373-20 toward as side of the side 326 from a side of the side 325 in a direction along the side 324.

The fourth connector 380 has a substantially rectangular parallelepiped shape including a plurality of sides having a side 384 and a side 385, which is orthogonal to the side 384 and is longer than the side 384, and a plurality of surfaces which are formed by the plurality of sides. Further, the fourth connector 380 is provided in the substrate 320 such that the side 385 of the fourth connector 380 is parallel to the side 324 of the substrate 320. The fourth connector 380 includes a housing 381, a cable attachment section 382, and a plurality of terminals 383. A not-shown cable, which electrically couples the control mechanism 10 to the print head 23, is attached to the cable attachment section 382. In addition, the plurality of terminals 383 are provided in parallel along the side 324. Further, when the cable is attached to the cable attachment section 382, the plurality of respective terminals included in the cable are electrically coupled to the plurality of respective terminals 383 included in the fourth connector 380. Therefore, the various signals output by the control mechanism 10 are input to the print head 23. Note that, in the embodiment, description will be performed while it is assumed that 20 number of terminals 383 are provided in parallel along the side 324 in the fourth connector 380. In addition, there is a case where 20 number of terminals 383 provided in parallel are sequentially referred to as terminals 383-1, 383-2, . . . , 383-20 toward the side of the side 326 from the side of the side 325 in the direction along the side 324.

Next, examples of the signals respectively input to the first connector 350, the second connector 360, the third connector 370, and the fourth connector 380 will be described with reference to FIGS. 29 to 32. In addition, FIG. 29 is a diagram illustrating examples of signals respectively input to the plurality of terminals 353 according to the third embodiment. In addition, FIG. 30 is a diagram illustrating examples of signals respectively input to the plurality of terminals 363 according to the third embodiment. In addition, FIG. 31 is a diagram illustrating examples of signals respectively input to the plurality of terminals 373 according to the third embodiment. In addition, FIG. 32 is a diagram illustrating examples of signals respectively input to the plurality of terminals 383 according to the third embodiment.

As illustrated in FIG. 29, the print data signal SI1 for controlling discharge of the ink, the change signal CHa, the latch signal LATa, the clock signal SCKa, the temperature signal TH, and a plurality of ground signals GND are input to the terminals 353-1 to 353-10 in order to control the discharge of the ink. In addition, in order to drive the piezoelectric elements 60, the driving signals COM-1 to COM-5 and the reference voltage signals CGND-1 to CGND-5 are input to the terminals 353-11 to 353-20. That is, a control signal of a low voltage and a signal, which indicates a reference potential of the control signal, are input to the plurality of terminals 353 provided on the side of the side 326 of the first connector 350, and a driving signal of the high voltage and a signal, which indicates a reference potential of the driving signal, are input to the plurality of terminals 353 provided on the side of the side 325 of the first connector 350.

Further, the terminals, to which the ground signal GND is input, are located between the terminals 353 to which the print data signal SI1, the change signal CHa, the latch signal LATa, the clock signal SCKa, and the temperature signal TH are respectively input in order to control the discharge of the ink. Specifically, the terminal 353-3, to which the ground signal GND is input, is located between the terminal 353-2, to which the temperature signal TH is input, and the terminal 353-4 to which the latch signal LATa is input. In addition, the terminal 353-5, to which the ground signal GND is input, is located between the terminal 353-4, to which the latch signal LATa is input, and the terminal 353-6 to which the clock signal SCKa is input. In addition, the terminal 353-7, to which the ground signal GND is input, is located between the terminal 353-6, to which the clock signal SCKa is input, and the terminal 353-8 to which the change signal CHa is input. In addition, the terminal 353-9, to which the ground signal GND is input, is located between the terminal 353-8, to which the change signal CHa is input, and the terminal 353-10 to which the print data signal SI1 is input.

As illustrated in FIG. 30, in order to drive the piezoelectric elements 60, the driving signals COM-1 to COM-5 and the reference voltage signals CGND-1 to CGND-5 are input to the terminals 363-1 to 363-10. In addition, the print data signals SI2 to SIS, a low voltage signal VDD which is a signal of the low voltage, and the plurality of ground signals GND are input to the terminals 363-11 to 363-20 of the second connector 360 in order to control the discharge of the ink. That is, the control signal of the low voltage and a signal, which indicates the reference potential of the control signal, are input to the plurality of terminals 363 provided on the side of the side 326 of the second connector 360, and the driving signal of the high voltage and a signal, which indicates the reference potential of the driving signal, are input to the plurality of terminals 363 provided on the side of the side 325 of the second connector 360.

As illustrated in FIG. 31, the driving signals COM-6 to COM-10 and the reference voltage signals CGND-6 to CGND-10 are input to the terminals 373-1 to 373-10 in order to drive the piezoelectric elements 60. In addition, the print data signal SI10, the change signal CHb, the latch signal LATb, the clock signal SCKb, the abnormality signal XHOT, and the plurality of ground signals GND are input to the terminals 353-11 to 353-20 in order to control the discharge of the ink. That is, the control signal of the low voltage and the signal, which indicates the reference potential of the control signal, are input to the plurality of terminals 373 provided on the side of the side 326 of the third connector 370, and the driving signal of the high voltage and the signal, which indicates the reference potential of the driving signal, are input to the plurality of terminals 373 provided on the side of the side 325 of the third connector 370.

Further, the terminals, to which the ground signal GND is input, are located between terminals 373 to which the print data signal SI10, the change signal CHb, the latch signal LATb, the clock signal SCKb, and the abnormality signal XHOT are respectively input in order to control the discharge of the ink. Specifically, the terminal 373-13, to which the ground signal GND is input, is located between the terminal 373-12, to which the abnormality signal XHOT is input, and the terminal 373-14 to which the latch signal LATb is input. In addition, the terminal 373-15, to which the ground signal GND is input, is located between the terminal 373-14, to which the latch signal LATb is input, and the terminal 373-16 to which the clock signal SCKb is input. In addition, the terminal 373-17, to which the ground signal GND is input, is located between the terminal 373-16, to which the clock signal SCKb is input, and the terminal 373-18 to which the change signal CHb is input. In addition, the terminal 373-19, to which the ground signal GND is input, is located between the terminal 373-18, to which the change signal CHb is input, and the terminal 373-20 to which the print data signal SI10 is input.

As illustrated in FIG. 32, the print data signals SI6 to SI9 and the plurality of ground signals GND are input to the terminals 383-1 to 383-9 in order to control the discharge of the ink. In addition, a high voltage signal VHV, which is the signal of the high voltage, is input to the terminal 383-10. In addition, in order to drive the piezoelectric elements 60, the driving signals COM-6 to COM-10 and the reference voltage signals CGND-6 to CGND-10 are input to the terminals 383-11 to 383-20. That is, the control signal of the low voltage and the signal, which indicates the reference potential of the control signal, are input to the plurality of terminals 383 provided on the side of the side 326 of the fourth connector 380, and the driving signal of the high voltage and the signal, which indicates the reference potential of the driving signal, are input to the plurality of terminals 383 provided on the side of the side 325 of the fourth connector 380.

Figure 33:
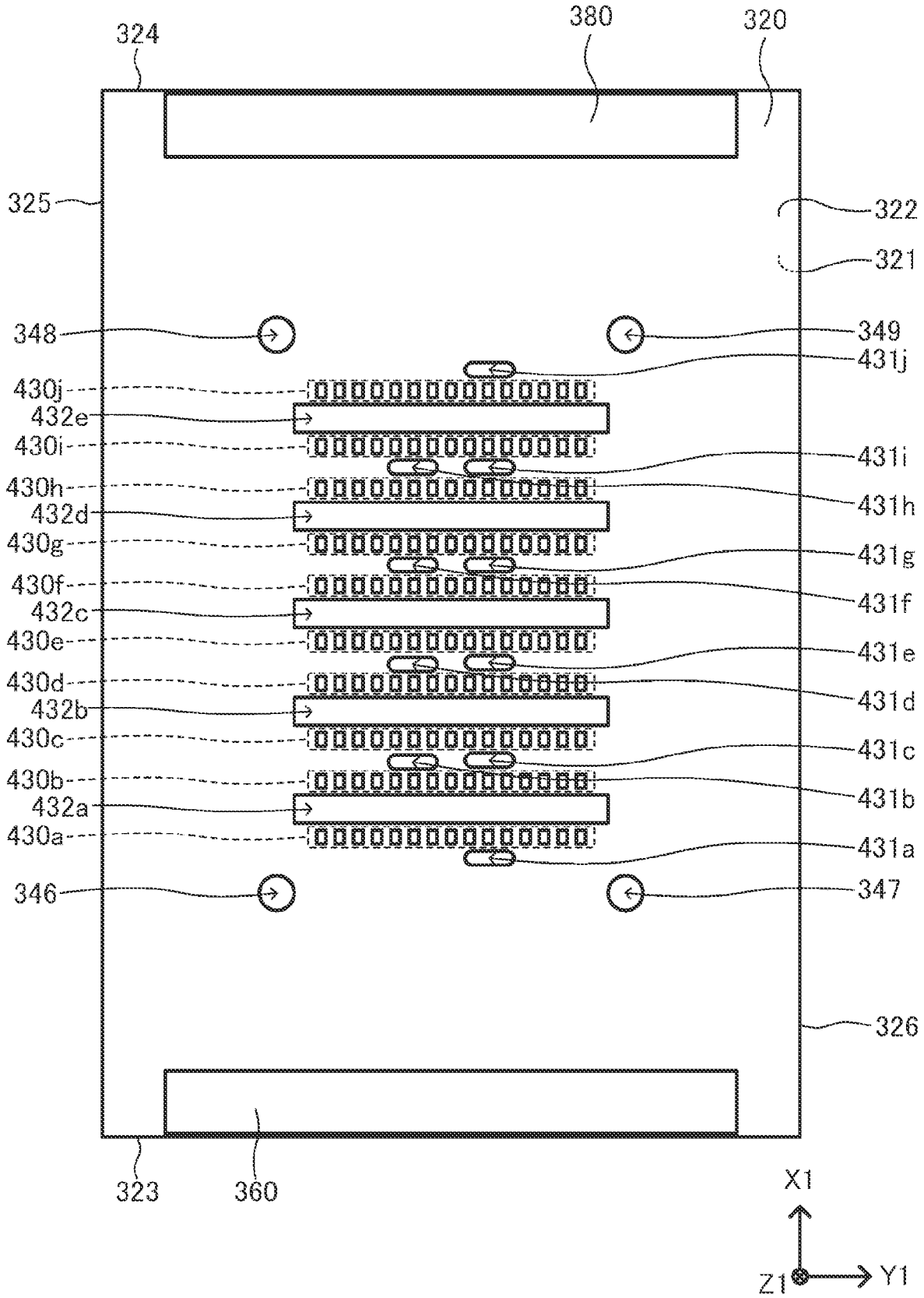
FIG. 33 is a plan diagram illustrating a case where a substrate is viewed from a surface according to the third embodiment.
Figure 34:
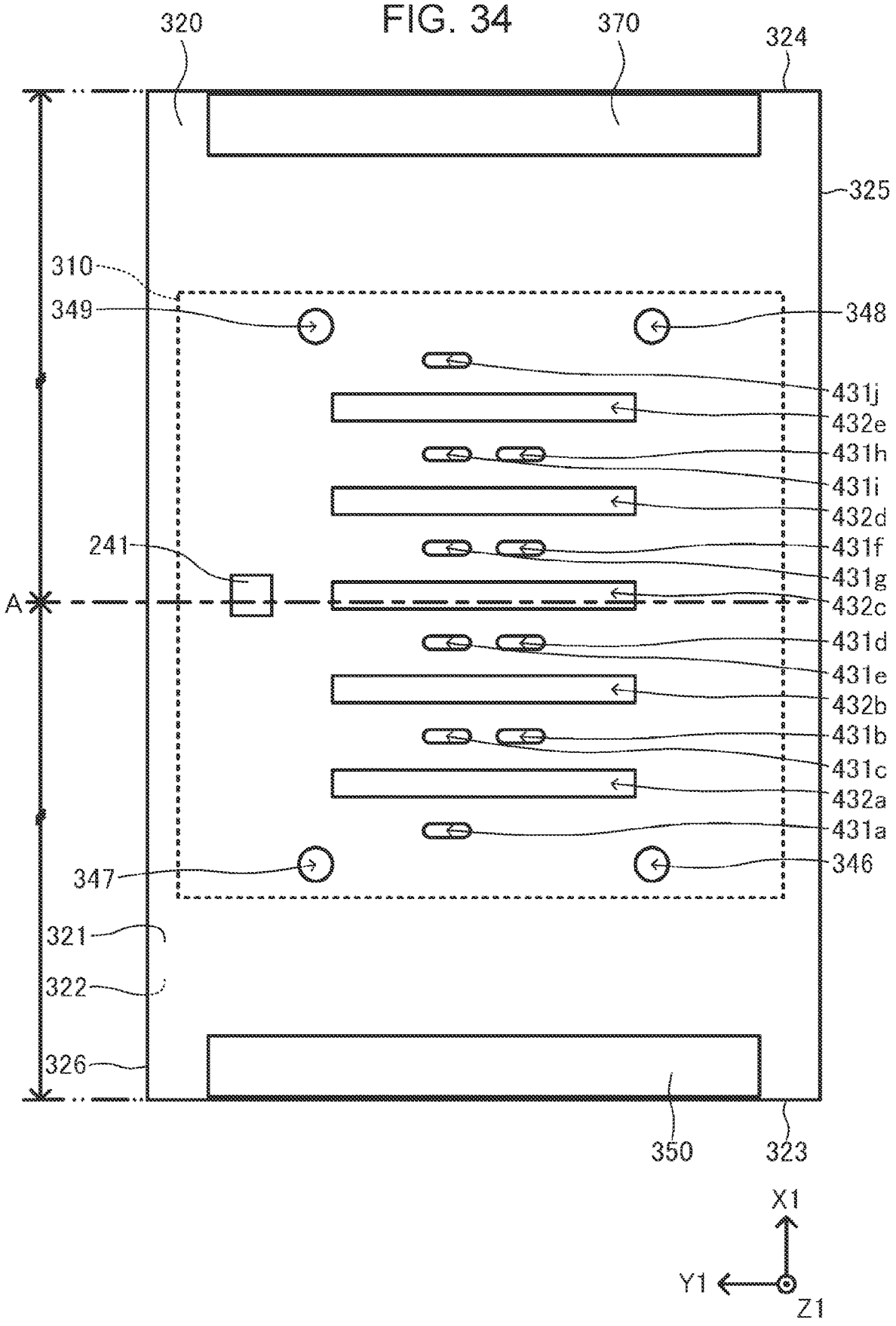
FIG. 34 is a plan diagram illustrating a case where the substrate is viewed from a surface according to the third embodiment.

Next, the configuration of the substrate 320 included in the print head 23 will be described with reference to FIGS. 33 and 34. FIG. 33 is a plan diagram illustrating a case where the substrate 320 according to the third embodiment is viewed from the surface 322. In addition, FIG. 34 is a plan diagram illustrating a case where the substrate 320 according to the third embodiment is viewed from the surface 321. Note that, in FIG. 33, a location of the head 310 provided on the side of the surface 321 of the substrate 320 is illustrated using broken lines.

As illustrated in FIGS. 33 and 34, electrode groups 430*a* to 430*j* are provided in the surface 322 of the substrate 320. In addition, the substrate 320 is formed with ink supply path insertion holes 431*a* to 431*j* and FPC insertion holes 432*a* to 432*e*. The ink supply path insertion holes 431*a* to 431*j* and the FPC insertion holes 432*a* to 432*e* are through holes which pass through the surface 321 the surface 322 of the substrate 320. Note that, configurations of the electrode groups 430*a* to 430*j*, the ink supply path insertion holes 431*a* to 431*j*, and the FPC insertion holes 432*a* to 432*e* are the same as those of the electrode groups 330*a* to 330*c*, the ink supply path insertion holes 331*a* to 331*f*, and the FPC insertion holes 332*a* to 332*c* according to the first embodiment, only other than the numbers thereof provided in the substrate 320.

Each of the electrode groups 430*a* to 430*j* includes a plurality of electrodes provided in parallel along the Y1 direction. Further, the electrode groups 430*a* to 430*j* face a side of the side 324 from a side of the side 323 along the X1 direction, and are located in order of the electrode groups 430*a*, 430*b*, 430*c*, 430*d*, 430*e*, 430*f*, 430*g*, 430*h*, 430*i*, and 430*j*. A flexible wiring substrate 335 is coupled to each of the electrode groups 430*a* to 430*j*.

The FPC insertion hole 432*a* is located between the electrode group 430*a* and the electrode group 430*b* in the X1 direction. Further, the flexible wiring substrate 335 electrically coupled to each of the electrode groups 430*a* and 430*b* is inserted into the FPC insertion hole 432*a*. The FPC insertion hole 432*b* is located between the electrode group 430*c* and the electrode group 430*d* in the X1 direction. Further, the flexible wiring substrate 335 electrically coupled to each of the electrode groups 430*c* and 430*d* is inserted into the FPC insertion hole 432*b*. The FPC insertion hole 432*c* is located between the electrode group 430*e* and the electrode group 430*f* in the X1 direction. Further, the flexible wiring substrate 335 electrically coupled to each of the electrode groups 430*e* and 430*f* is inserted into the FPC insertion hole 432*c*. The FPC insertion hole 432*d* is located between the electrode group 430*g* and the electrode group 430*h* in the X1 direction. Further, the flexible wiring substrate 335 electrically coupled to each of the electrode groups 430*g* and 430*h* is inserted into the FPC insertion hole 432*d*. The FPC insertion hole 432*e* is located between the electrode group 430*i* and the electrode group 430*j* in the X1 direction. Further, the flexible wiring substrate 335 electrically coupled to each of the electrode groups 430*i* and 430*j* is inserted into the FPC insertion hole 432*e*.

The ink supply path insertion hole 431*a* is located on a side of the side 323 of the electrode group 430*a* in the X1 direction. The ink supply path insertion holes 431*b* and 431*c* are located between the electrode group 430*b* and the electrode group 430*c* in the X1 direction, and are located in line along the Y1 direction such that the ink supply path insertion hole 431*b* is on the side of the side 325 and the ink supply path insertion hole 431*c* is on the side of the side 326. The ink supply path insertion holes 431*d* and 431*e* are located between the electrode group 430*d* and the electrode group 430*e* in the X1 direction, and are located in line along the Y1 direction such that the ink supply path insertion hole 431*d* is on the side of the side 325 and the ink supply path insertion hole 431*e* is on the side of the side 326. The ink supply path insertion holes 431*f* and 431*g* are located between the electrode group 430*f* and the electrode group 430*g* in the X1 direction, and are located in line along the Y1 direction such that the ink supply path insertion hole 431*f* is on the side of the side 325 and the ink supply path insertion hole 431*g* is on the side of the side 326. The ink supply path insertion holes 431*h* and 431*i* are located between the electrode group 430*h* and the electrode group 430*i* in the X1 direction, and are located in line along the Y1 direction such that the ink supply path insertion hole 431*h* is on the side of the side 325 and the ink supply path insertion hole 431*i* is on the side of the side 326. The ink supply path insertion hole 431*j* is located on the side of the side 324 of the electrode group 430*j* in the X1 direction.

The ink supply ports 661, which introduce the ink to the discharge sections 600 corresponding to the respective nozzle rows L1 to L10, are inserted into the respective ink supply path insertion holes 431*a* to 431*j* which are provided as above.

In addition, as illustrated in FIG. 34, the integrated circuit device 241 is provided on the side of the surface 321 of the substrate 320. The integrated circuit device 241 is the integrated circuit device included in the diagnostic circuit 240 illustrated in FIG. 2, performs diagnosis of whether or not it is possible to normally discharge the ink from the nozzles 651 based on the latch signal LATa, the change signal CHa, the print data signal SI1, and the clock signal SCKa, which are input from the first connector 350, and performs diagnosis of whether or not it is possible to normally discharge the ink from the nozzles 651 based on the latch signal LATb, the change signal CHb, the print data signal SI10, and the clock signal SCKb, which are input from the third connector 370.

The integrated circuit device 241 is provided on the side of the side 326 of the FPC insertion holes 432*a* to 432*f* between the side 323 and the side 324 on the side of the surface 321 of the substrate 320. In this case, it is preferable that the integrated circuit device 241 is provided at a center between the side 323 and the side 324. Here, the center between the side 323 and the side 324 is not limited to a spot at which a distance from the side 323 is equal to a distance from the side 324. Specifically, when it is assumed that a line acquired by connecting dots at which the distance from the side 323 is equal to the distance from the side 324 is the virtual line A, the integrated circuit device 241 may be located on a side of the virtual line A rather than the side 323, and may be located on the side of the virtual line A rather than the side 324. In other words, the shortest distance between the virtual line A and the integrated circuit device 241 is shorter than the shortest distance between the side 323 and the integrated circuit device 241, and the shortest distance between the virtual line A and the integrated circuit device 241 is shorter than the shortest distance between the side 324 and the integrated circuit device 241.

In the head unit 20 including the print head 23 and the liquid discharge apparatus 1 including the head unit 20, which are configured as described above, according to the third embodiment, the number of nozzles 651 included in the head unit 20 is increased. Therefore, even though the number of signals propagated from the control mechanism 10 to the head unit 20 increases, it is possible to diagnose the presence or absence of an operation abnormality of the print head 23.

Further, in the head unit 20, which includes the print head 23 configured as described above, and the liquid discharge apparatus 1 which includes the head unit 20, the substrate 320 included in the print head 23 is provided so that the surface 321 faces downward and the surface 322 faces upward in the direction along the vertical direction, and thus it is possible to exhibit the same effects as in the liquid discharge apparatuses 1 and the head units 20 according to the first embodiment and the second embodiment.

4. Fourth Embodiment

Next, a liquid discharge apparatus 1 and a head unit 20 according to a fourth embodiment will be described. Note that, when the liquid discharge apparatus 1 and the head unit 20 according to the fourth embodiment are described, the same reference symbols are attached to the components which are the same as in the first embodiment, the second embodiment, and the third embodiment, and description thereof will not be repeated or simplified. The liquid discharge apparatus 1 and the head unit 20 according to the fourth embodiment are different from those according to the third embodiment in a fact that the diagnostic circuit 240 is configured to include two integrated circuit devices with respect to the print head 23 included in the head unit 20 according to the third embodiment.

Figure 35:
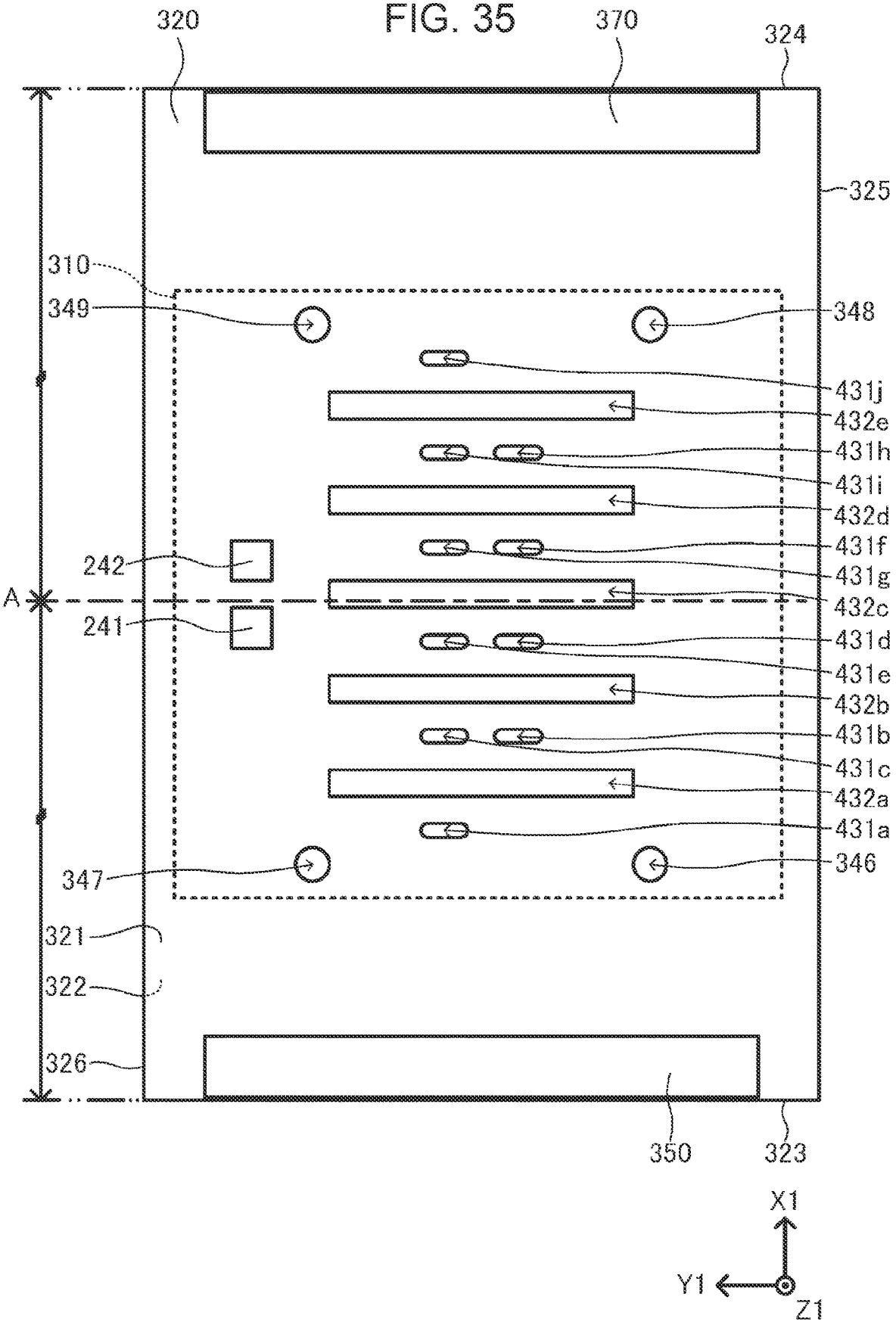
FIG. 35 is a plan diagram illustrating a case where a substrate is viewed from a surface according to a fourth embodiment.

FIG. 35 is a plan diagram illustrating a case where the substrate 320 included in the print head 23 is viewed from the surface 321 according to the fourth embodiment. Two integrated circuit devices 241 and 242 are provided in line along the X1 direction in the surface 321 of the substrate 320 according to the fourth embodiment.

A print data signal SI1, a change signal CHa, a latch signal LATa, and a clock signal SCKa are input from a first connector 350 to the integrated circuit device 241. Further, the integrated circuit device 241 diagnoses whether or not it is possible for the print head 23 to normally discharge ink based on the print data signal SI1, the change signal CHa, the latch signal LATa, and the clock signal SCKa.

In addition, a print data signal SI10, a change signal CHb, a latch signal LATb, and a clock signal SCKb are input from a third connector 370 to the integrated circuit device 242. Further, the integrated circuit device 242 diagnoses whether or not it is possible for the print head 23 to normally discharge the ink based on the print data signal SI10, the change signal CHb, the latch signal LATb, and the clock signal SCKb.

On a side of the surface 321 of the substrate 320, the integrated circuit devices 241 and 242 are located on a side of a side 326 of FPC insertion holes 432*a* to 432*e* between a side 323 and a side 324, and are provided in line such that the integrated circuit device 241 is on a side of the side 323 and the integrated circuit device 242 is on a side of the side 324. Further, the integrated circuit devices 241 and 242 are located on the side of the side 326 of the FPC insertion holes 432*a* to 432*e* between the first connector 350 and the third connector 370, and the integrated circuit devices 241 and 242 are provided in line such that the integrated circuit device 241 is on the side of side 323 and the integrated circuit device 242 is on the side of the side 324. In other words, the integrated circuit device 241, which performs diagnosis of whether or not it is possible for the print head 23 to normally discharge ink based on various signals input from the first connector 350 provided along the side 323, is provided on the side of the side 323, and the integrated circuit device 242, which performs the diagnosis of whether or not it is possible for the print head 23 to normally discharge ink based on various signals input from the third connector 370 provided along the side 324, is provided on the side of the side 324.

Here, it is preferable that the integrated circuit devices 241 and 242 are provided at the center between the side 323 and the side 324. Note that, the center between the side 323 and the side 324 is not limited to a spot at which a distance from the side 323 is equal to a distance from the side 324. Specifically, when it is assumed that a line acquired by connecting dots at which the distance from the side 323 is equal to the distance from the side 324 is a virtual line A, the integrated circuit device 241 may be located on a side of the virtual line A rather than the side 323 and may be located on the side of the virtual line A rather than the side 324. Further, the integrated circuit device 242 may be located on the side of the virtual line A rather than the side 323 and may be located on the side of the virtual line A rather than the side 324. In other words, the shortest distance between the virtual line A and the integrated circuit device 241 is shorter than the shortest distance between the side 323 and the integrated circuit device 241, and the shortest distance between the virtual line A and the integrated circuit device 241 is shorter than the shortest distance between the side 324 and the integrated circuit device 241. Further, the shortest distance between the virtual line A and the integrated circuit device 242 is shorter than the shortest distance between the side 323 and the integrated circuit device 242, and the shortest distance between the virtual line A and the integrated circuit device 242 is shorter than the shortest distance between the side 324 and the integrated circuit device 242.

The liquid discharge apparatus 1 and the head unit 20, which are configured as above, according to the fourth embodiment includes the two integrated circuit devices 241 and 242 in the print head 23. Further, the integrated circuit device 241 performs the diagnosis of whether or not it is possible for the print head 23 to normally discharge the ink based on the print data signal SI1, the change signal CHa, the latch signal LATa, and the clock signal SCKa, which are input from the first connector 350, and the integrated circuit device 242 performs the diagnosis of whether or not it is possible for the print head 23 to normally discharge the ink based on the print data signal SI10, the change signal CHb, the latch signal LATb, and the clock signal SCKb which are input from the third connector 370. In this manner, even in a configuration in which the signals input from the first connector 350 and the third connector 370 are detected by using the two integrated circuit devices 241 and 242 and it is diagnosed whether or not the print head 23 can perform normal discharge, in the head unit 20 including the print head 23 and the liquid discharge apparatus 1 including the head unit 20, the substrate 320 included in the print head 23 is provided so that the surface 321 faces downward and the surface 322 faces upward in the direction along the vertical direction, and thus it is possible to exhibit the same effects as in the liquid discharge apparatus 1 and the head unit 20 according to the first embodiment, the second embodiment, and the third embodiment.

5. Modified Example

In the above-described liquid discharge apparatus 1, the driving signal output circuit 50 may include two driving circuits 51*a* and 51*b* which generate and output driving signals COMA and COMB having different waveforms.

For example, the driving signal COMA may be a waveform acquired by succeeding two trapezoid waveforms which cause an intermediate amount of ink to be discharged from the nozzle 651, and the driving signal COMB may be a waveform acquired by succeeding a trapezoid waveform which causes a small amount of ink to be discharged from the nozzle 651 and a trapezoid waveform which causes a vicinity of an opening section of the nozzle 651 to slightly vibrate. In this case, a driving signal selection circuit 200 may select any of the trapezoid waveforms included in the driving signal COMA and at least any of the trapezoid waveforms included in the driving signal COMB at a cycle Ta, and may output the selected trapezoid waveform as a driving signal VOUT.

That is, when the driving signal selection circuit 200 selects and combines the plurality of trapezoid waveforms included in each of the two driving signals COMA and COMB, the driving signal selection circuit 200 may generate and output the driving signal VOUT. Therefore, the number of combinations of the trapezoid waveforms, which can be output as the driving signal VOUT, increases without making the cycle Ta long. Therefore, it is possible to increase a range of selection of a dot size of the ink which is discharged to a medium M. Accordingly, the liquid discharge apparatus 1 can increase grayscale of the dots formed on the medium M. That is, it is possible to improve printing quality of the liquid discharge apparatus 1.

In addition, when the driving signal output circuit 50 includes the two driving circuits 51*a* and 51*b* which generate and output the driving signals COMA and COMB of different trapezoid waveforms, for example, the driving signal COMA may be a waveform acquired by succeeding a trapezoid waveform which causes an intermediate amount of ink to be discharged from the nozzle 651, a trapezoid waveform which causes a small amount of ink to be discharged from the nozzle 651, and a trapezoid waveform which causes the vicinity of the opening section of the nozzle 651 to slightly vibrate, and the driving signal COMB may be acquired by succeeding a trapezoid waveform, which is different from the trapezoid waveform included in the driving signal COMA and causes an intermediate amount of ink to be discharged from the nozzle 651, the trapezoid waveform which causes a small amount of ink to be discharged from the nozzle 651, and the trapezoid waveform which causes the vicinity of the opening section of the nozzle 651 to slightly vibrate. Further, the driving signal COMA and the driving signal COMB are input to the driving signal selection circuits 200 which respectively correspond to different nozzle rows. Therefore, in a case where the ink of different characteristics is supplied to each nozzle row formed in the print head 23, it is possible to supply the optimal driving signal VOUT to each individual nozzle row with respect to a difference in a shape of the channel to which the ink is supplied. Therefore, it is possible to reduce dispersion of the dot size for each nozzle row, and it is possible to improve the printing quality of the liquid discharge apparatus 1.

Hereinabove, the embodiments and the modified example are described. The present disclosure is not limited to the embodiments and the modified example, and various forms are possible in a scope without departing from the gist of the present disclosure. For example, it is possible to appropriately combine the above-described embodiments.

In addition, the present disclosure includes a configuration (for example, a configuration in which a function, a method, and a result are the same or a configuration in which an object and effects are the same) which is substantially the same as the configuration described in the embodiments and the modified example. In addition, the present disclosure includes a configuration in which a non-essential part of the configuration described in the embodiments and the modified example is replaced. In addition, the present disclosure includes a configuration which accomplishes the same effects as the configuration described in the embodiments and the modified example, or a configuration in which it is possible to accomplish the same object. In addition, the present disclosure includes a configuration in which a well-known technology is added to the configuration described in the embodiments and the modified example.

The following contents are derived from the above-described embodiments and the modified example.

According to an aspect, there is provided a liquid discharge apparatus including a head unit that discharges liquid, and a digital signal output circuit that outputs a digital signal to the head unit, in which the head unit includes a plurality of print heads that discharge the liquid, and a housing that houses the plurality of print heads, a first print head in the plurality of print heads includes a substrate that includes a first side, a second side which intersects with the first side, a first surface which has the first side and the second side, and a second surface which is different from the first surface, a first nozzle plate that includes a first nozzle row in which a plurality of first nozzles for discharging the liquid are provided in line in a direction along the first side, a connector that is provided in the first surface and to which the digital signal is input, a first integrated circuit that is provided in the first surface, that is electrically coupled to the connector, to which the digital signal is input via the connector, and that outputs an abnormality signal indicating presence or absence of abnormality of the first print head, a first flexible wiring substrate that is electrically coupled to the substrate, and a second integrated circuit that is provided on the first flexible wiring substrate, the second integrated circuit is located between the first nozzle plate and the substrate, and the substrate is provided so that the first surface faces downward and the second surface faces upward in a direction along a vertical direction.

According to the liquid discharge apparatus, heat generated in the second integrated circuit provided on the first flexible wiring substrate electrically coupled to the substrate is transferred to the first flexible wiring substrate and the substrate. Further, the heat transferred to the substrate is emitted upward in the direction along the vertical direction. In this case, the first integrated circuit that outputs the abnormality signal indicating the presence or absence of the abnormality of the first print head is provided in the first surface that faces downward in the direction along the vertical direction. Therefore, a problem is reduced in that the heat generated in the second integrated circuit affects the first integrated circuit that outputs the abnormality signal indicating presence or absence of the abnormality of the first print head. As a result, it is possible to reduce temperature rise of the first integrated circuit that outputs the abnormality signal indicating presence or absence of the abnormality of the first print head, and thus it is possible to reduce a problem in that the integrated circuit for executing a self-diagnosis function of the print head does not operate normally.

In the liquid discharge apparatus, the substrate may be provided so that the first side is orthogonal to the vertical direction and the second side is orthogonal to the vertical direction.

According to the liquid discharge apparatus, in the substrate included in the print head, the first side and the second side are orthogonal to the vertical direction in a state in which the first surface faces downward in a direction along the vertical direction and the second surface faces upward in the direction along the vertical direction. That is, in the substrate, a normal direction of the first surface is the direction along the vertical direction. As a result, the heat transferred to the substrate is efficiently emitted from the second surface which faces upward in the vertical direction. Therefore, a problem is further reduced in that the heat generated in the second integrated circuit affects the first integrated circuit that outputs the abnormality signal indicating presence or absence of the abnormality of the first print head. As a result, it is possible to further reduce the temperature rise of the first integrated circuit that outputs the abnormality signal indicating presence or absence of the abnormality of the first print head, and thus it is possible to further reduce the problem in that the integrated circuit for executing the self-diagnosis function of the print head does not operate normally.

In the liquid discharge apparatus, the substrate may include a third side provided to be parallel to the first side, and a fourth side provided to be parallel to the second side, and the first surface may have a rectangular shape that includes the first side, the second side, the third side, and the fourth side.

In the liquid discharge apparatus, the first integrated circuit may be provided so that a shortest distance between a virtual line, which has an equal distance from the first side and the third side, and the first integrated circuit is shorter than a shortest distance between the first side and the first integrated circuit, and the shortest distance between the virtual line and the first integrated circuit is shorter than a shortest distance between the third side and the first integrated circuit.

In the liquid discharge apparatus, the first integrated circuit may be provided so that a shortest distance between the first side and the first integrated circuit is shorter than the shortest distance between the third side and the first integrated circuit.

In the liquid discharge apparatus, a length of the first side may be shorter than a length of the second side.

In the liquid discharge apparatus, the first flexible wiring substrate may be electrically coupled to the second surface of the substrate.

According to the liquid discharge apparatus, the first flexible wiring substrate is electrically coupled to the second surface which faces upward in the vertical direction, and thus a problem is reduced in that the heat generated in the second integrated circuit transferred by the first flexible wiring substrate affects the first surface of the substrate. Therefore, the problem is further reduced in that the heat generated in the second integrated circuit affects the first integrated circuit provided in the first surface. As a result, it is possible to further reduce the temperature rise of the first integrated circuit that outputs the abnormality signal indicating presence or absence of the abnormality of the first print head, and thus it is possible to further reduce the problem in that the integrated circuit for executing the self-diagnosis function of the print head does not operate normally.

In the liquid discharge apparatus, the first print head may include a second flexible wiring substrate that is electrically coupled to the substrate, the substrate may include a first FPC insertion hole through which the first flexible wiring substrate is inserted, and a second FPC insertion hole through which the second flexible wiring substrate is inserted, a width of the first FPC insertion hole in the direction along the first side may be larger than a width of the first FPC insertion hole in a direction along the second side, and the first FPC insertion hole and the second FPC insertion hole may be located so that at least portions thereof overlap in the direction along the second side.

According to the liquid discharge apparatus, the radiant heat generated in the second integrated circuit provided on the first flexible wiring substrate is emitted to the side of the second surface of the substrate which faces upward in the vertical direction via the first FPC insertion hole through which the first flexible wiring substrate is inserted. Therefore, the problem is further reduced in that the radiant heat generated in the second integrated circuit affects the first integrated circuit provided in the first surface. As a result, it is possible to further reduce the temperature rise of the first integrated circuit that outputs the abnormality signal indicating presence or absence of the abnormality of the first print head, and thus it is possible to further reduce the problem in that the integrated circuit for executing the self-diagnosis function of the print head does not operate normally.

In the liquid discharge apparatus, a shortest distance between the first integrated circuit and the second side may be shorter than a shortest distance between the first FPC insertion hole and the second side, and the shortest distance between the first integrated circuit and the second side may be shorter than shortest distance between the second FPC insertion hole and the second side.

In the liquid discharge apparatus, a second print head in the plurality of print heads may include a second nozzle plate that includes a second nozzle row in which a plurality of second nozzles which discharge the liquid are provided in line, and the second print head may be provided so that the plurality of second nozzles included in the second nozzle row are disposed in the direction along the first side.

Even in a line head type liquid discharge apparatus, in which the nozzle rows included in the plurality of print heads are provided in line, as in the liquid discharge apparatus, a problem is reduced in that the heat generated in the second integrated circuit affects the first integrated circuit provided in the first surface, and thus it is possible to reduce temperature rise of the first integrated circuit that outputs the abnormality signal indicating the presence or absence of the abnormality of the first print head, and it is possible to reduce a problem in that the integrated circuit for executing a self-diagnosis function of the print head does not operate normally.

In the liquid discharge apparatus, the first print head and the second print head may be provided so that at least portions thereof overlap in the direction along the first side.

Even in the line head type liquid discharge apparatus, which is provided in such a way that the plurality of print heads are disposed in line, as the liquid discharge apparatus, the problem is reduced in that the heat generated in the second integrated circuit affects the first integrated circuit provided in the first surface, and thus it is possible to reduce the temperature rise of the first integrated circuit that outputs the abnormality signal indicating the presence or absence of the abnormality of the first print head, and it is possible to reduce the problem in that the integrated circuit for executing the self-diagnosis function of the print head does not operate normally.

In the liquid discharge apparatus, the first print head may include a liquid supply port through which the liquid is supplied, and a shortest distance between the liquid supply port and the first surface may be longer than a shortest distance between the liquid supply port and the second surface.

In the liquid discharge apparatus, the liquid supply port may be located above the substrate in the direction along the vertical direction.

In the liquid discharge apparatus, the substrate may include a liquid supply port insertion hole through which the liquid supply port is inserted.

In the liquid discharge apparatus, the first print head may include a fixing member that fixes the substrate, the substrate may include a fixing member insertion hole through which the fixing member is inserted, the first integrated circuit may be located to overlap at least a part of the fixing member in a direction along the second side, and the fixing member may be located between the connector and the first integrated circuit in the direction along the second side.

In the liquid discharge apparatus, the connector may include a plurality of terminals.

In the liquid discharge apparatus, the plurality of terminals may be provided in line in the direction along the first side.

In the liquid discharge apparatus, the connector may include a fifth side and a sixth side which is longer than the fifth side, and the plurality of terminals may be provided in line in a direction along the sixth side.

In the liquid discharge apparatus, the connector may be provided so that the sixth side is parallel to the first side.

In the liquid discharge apparatus, the first print head may include a discharge module having the first nozzle plate, and the discharge module and the substrate may be fixed using an adhesive.

In the liquid discharge apparatus, the first integrated circuit may be located between the substrate and the discharge module.

Even in a case where the first integrated circuit is provided in an area surrounded by the discharge module and the substrate as in the liquid discharge apparatus, the problem is reduced in that the heat generated in the second integrated circuit affects the first integrated circuit provided in the first surface, and thus it is possible to reduce the temperature rise of the first integrated circuit that outputs the abnormality signal indicating the presence or absence of the abnormality of the first print head, and it is possible to reduce the problem in that the integrated circuit for executing the self-diagnosis function of the print head does not operate normally.

In the liquid discharge apparatus, the head unit may include a supply unit that supplies the liquid to the plurality of print heads.

In the liquid discharge apparatus, the first integrated circuit may include a plurality of electrodes electrically coupled to the substrate.

In the liquid discharge apparatus, the first integrated circuit may be a surface mount component.

In the liquid discharge apparatus, the first integrated circuit may be electrically coupled to the substrate via a bump electrode.

In the liquid discharge apparatus, the first integrated circuit may output an abnormality signal at a high level when an abnormality occurs in the first print head.

In the liquid discharge apparatus, the first integrated circuit may output an abnormality signal at a low level when the abnormality occurs in the first print head.

The liquid discharge apparatus may further include a liquid storage that stores the liquid.

In the liquid discharge apparatus, the liquid storage may store ink to be supplied to the head unit.

According to another aspect, there is provided a head unit including a plurality of print heads that discharge liquid, and a housing that houses the plurality of print heads, in which a first print head in the plurality of print heads includes a substrate that includes a first side, a second side which intersects with the first side, a first surface which has the first side and the second side, and a second surface which is different from the first surface, a first nozzle plate that includes a first nozzle row in which a plurality of first nozzles for discharging the liquid are provided in line in a direction along the first side, a connector that is provided in the first surface and to which a digital signal is input, a first integrated circuit that is provided in the first surface, that is electrically coupled to the connector, to which the digital signal is input via the connector, and that outputs an abnormality signal indicating presence or absence of abnormality of the first print head, a first flexible wiring substrate that is electrically coupled to the substrate, and a second integrated circuit that is provided on the first flexible wiring substrate, the second integrated circuit is located between the first nozzle plate and the substrate, and the substrate is provided so that the first surface faces downward and the second surface faces upward in a direction along a vertical direction.

According to the head unit, heat generated in the second integrated circuit provided on the first flexible wiring substrate electrically coupled to the substrate is transferred to the first flexible wiring substrate and the substrate. Further, the heat transferred to the substrate is emitted upward in the direction along the vertical direction. In this case, the first integrated circuit that outputs the abnormality signal indicating the presence or absence of the abnormality of the first print head is provided in the first surface that faces downward in the direction along the vertical direction. Therefore, a problem is reduced in that the heat generated in the second integrated circuit affects the first integrated circuit that outputs the abnormality signal indicating presence or absence of the abnormality of the first print head. As a result, it is possible to reduce temperature rise of the first integrated circuit that outputs the abnormality signal indicating presence or absence of the abnormality of the first print head, and thus it is possible to reduce a problem in that the integrated circuit for executing a self-diagnosis function of the print head does not operate normally.

In the head unit, the substrate may be provided so that the first side is orthogonal to the vertical direction and the second side is orthogonal to the vertical direction.

According to the head unit, in the substrate included in the print head, the first side and the second side are orthogonal to the vertical direction in a state in which the first side faces downward in the direction along the vertical direction and the second side faces upward in the direction along the vertical direction. That is, in the substrate, a normal direction of the first surface is the direction along the vertical direction. As a result, the heat transferred to the substrate is efficiently emitted from the second surface which faces upward in the vertical direction. Therefore, a problem is further reduced in that the heat generated in the second integrated circuit affects the first integrated circuit that outputs the abnormality signal indicating presence or absence of the abnormality of the first print head. As a result, it is possible to further reduce the temperature rise of the first integrated circuit that outputs the abnormality signal indicating presence or absence of the abnormality of the first print head, and thus it is possible to further reduce the problem in that the integrated circuit for executing the self-diagnosis function of the print head does not operate normally.

In the head unit, the substrate may include a third side provided to be parallel to the first side, and a fourth side provided to be parallel to the second side, and the first surface may have a rectangular shape that includes the first side, the second side, the third side, and the fourth side.

In the head unit, the first integrated circuit may be provided so that a shortest distance between a virtual line, which has an equal distance from the first side and the third side, and the first integrated circuit is shorter than a shortest distance between the first side and the first integrated circuit, and the shortest distance between the virtual line and the first integrated circuit is shorter than a shortest distance between the third side and the first integrated circuit.

In the head unit, the first integrated circuit may be provided so that a shortest distance between the first side and the first integrated circuit is shorter than the shortest distance between the third side and the first integrated circuit.

In the head unit, a length of the first side may be shorter than a length of the second side.

In the head unit, the first flexible wiring substrate may be electrically coupled to the second surface of the substrate.

According to the head unit, the first flexible wiring substrate is electrically coupled to the second surface which faces upward in the vertical direction, and thus a problem is reduced in that the heat generated in the second integrated circuit transferred by the first flexible wiring substrate affects the first surface of the substrate. Therefore, the problem is further reduced in that the heat generated in the second integrated circuit affects the first integrated circuit provided in the first surface. As a result, it is possible to further reduce the temperature rise of the first integrated circuit that outputs the abnormality signal indicating presence or absence of the abnormality of the first print head, and thus it is possible to further reduce the problem in that the integrated circuit for executing the self-diagnosis function of the print head does not operate normally.

In the head unit, the first print head may include a second flexible wiring substrate that is electrically coupled to the substrate, the substrate may include a first FPC insertion hole through which the first flexible wiring substrate is inserted, and a second FPC insertion hole through which the second flexible wiring substrate is inserted, a width of the first FPC insertion hole in the direction along the first side may be larger than a width of the first FPC insertion hole in a direction along the second side, and the first FPC insertion hole and the second FPC insertion hole may be located so that at least portions thereof overlap in the direction along the second side.

According to the head unit, the radiant heat generated in the second integrated circuit provided on the first flexible wiring substrate is emitted to the side of the second surface of the substrate which faces upward in the vertical direction via the first FPC insertion hole through which the first flexible wiring substrate is inserted. Therefore, the problem is further reduced in that the radiant heat generated in the second integrated circuit affects the first integrated circuit provided in the first surface. As a result, it is possible to further reduce the temperature rise of the first integrated circuit that outputs the abnormality signal indicating presence or absence of the abnormality of the first print head, and thus it is possible to further reduce the problem in that the integrated circuit for executing the self-diagnosis function of the print head does not operate normally.

In the head unit, a shortest distance between the first integrated circuit and the second side may be shorter than a shortest distance between the first FPC insertion hole and the second side, and the shortest distance between the first integrated circuit and the second side may be shorter than shortest distance between the second FPC insertion hole and the second side.

In the head unit, a second print head in the plurality of print heads may include a second nozzle plate that includes a second nozzle row in which a plurality of second nozzles which discharge the liquid are provided in line, and the second print head may be provided so that the plurality of second nozzles included in the second nozzle row are disposed in the direction along the first side.

Even in a head unit, which can be used for the line head type liquid discharge apparatus in which the nozzle rows included in a plurality of print heads are disposed in line, as the head unit, the problem is reduced in that the heat generated in the second integrated circuit affects the first integrated circuit provided in the first surface, and thus it is possible to reduce the temperature rise of the first integrated circuit that outputs the abnormality signal indicating the presence or absence of the abnormality of the first print head, and it is possible to reduce the problem in that the integrated circuit for executing the self-diagnosis function of the print head does not operate normally.

In the head unit, the first print head and the second print head may be provided so that at least portions thereof overlap in the direction along the first side.

Even in a head unit, which is used for the line head type liquid discharge apparatus in which a plurality of print heads are disposed in line, as the head unit, the problem is reduced in that the heat generated in the second integrated circuit affects the first integrated circuit provided in the first surface, and thus it is possible to reduce the temperature rise of the first integrated circuit that outputs the abnormality signal indicating the presence or absence of the abnormality of the first print head, and it is possible to reduce the problem in that the integrated circuit for executing the self-diagnosis function of the print head does not operate normally.

In the head unit, the first print head may include a liquid supply port through which the liquid is supplied, and a shortest distance between the liquid supply port and the first surface may be longer than a shortest distance between the liquid supply port and the second surface.

In the head unit, the liquid supply port may be located above the substrate in the direction along the vertical direction.

In the head unit, the substrate may include a liquid supply port insertion hole through which the liquid supply port is inserted.

In the head unit, the first print head may include a fixing member that fixes the substrate, the substrate may include a fixing member insertion hole through which the fixing member is inserted, the first integrated circuit may be located to overlap at least a part of the fixing member in a direction along the second side, and the fixing member may be located between the connector and the first integrated circuit in the direction along the second side.

In the head unit, the connector may include a plurality of terminals.

In the head unit, the plurality of terminals may be provided in line in the direction along the first side.

In the head unit, the connector may include a fifth side and a sixth side which is longer than the fifth side, and the plurality of terminals may be provided in line in a direction along the sixth side.

In the head unit, the connector may be provided so that the sixth side is parallel to the first side.

In the head unit, the first print head may include a discharge module having the first nozzle plate, and the discharge module and the substrate may be fixed using an adhesive.

In the head unit, the first integrated circuit may be located between the substrate and the discharge module.

The head unit may further include a supply unit that supplies the liquid to the plurality of print heads.

In the head unit, the first integrated circuit may include a plurality of electrodes electrically coupled to the substrate.

In the head unit, the first integrated circuit may be a surface mount component.

In the head unit, the first integrated circuit may be electrically coupled to the substrate via a bump electrode.

In the head unit, the first integrated circuit may output an abnormality signal at a high level when an abnormality occurs in the first print head.

In the head unit, the first integrated circuit may output an abnormality signal at a low level when the abnormality occurs in the first print head.

What is claimed is:

1. A liquid discharge apparatus comprising:

a head unit that discharges liquid; and a digital signal output circuit that outputs a digital signal to the head unit, wherein the head unit includes a plurality of print heads that discharge liquid, and a housing that houses the plurality of print heads, a first print head in the plurality of print heads includes a substrate that includes a first side, a second side which intersects with the first side, a first surface which has the first side and the second side, and a second surface which is different from the first surface, a first nozzle plate that includes a first nozzle row in which a plurality of first nozzles for discharging the liquid are provided in line in a direction along the first side, a connector that is provided in the first surface and to which the digital signal is input, a first integrated circuit that is provided on the first surface, that is electrically coupled to the connector, to which the digital signal is input via the connector, and that outputs an abnormality signal indicating presence or absence of abnormality of the first print head, a first flexible wiring substrate that is electrically coupled to the substrate, and a second integrated circuit that is provided on the first flexible wiring substrate, the second integrated circuit is located between the first nozzle plate and the substrate, and the substrate is provided so that the first surface faces downward and the second surface faces upward in a direction along a vertical direction.

2. The liquid discharge apparatus according to claim 1, wherein the substrate is provided so that the first side is orthogonal to the vertical direction and the second side is orthogonal to the vertical direction.

3. The liquid discharge apparatus according to claim 1, wherein the substrate includes a third side provided to be parallel to the first side, and a fourth side provided to be parallel to the second side, and the first surface has a rectangular shape including the first side, the second side, the third side, and the fourth side.

4. The liquid discharge apparatus according to claim 3, wherein the first integrated circuit is provided so that a shortest distance between a virtual line, which has an equal distance from the first side and the third side, and the first integrated circuit is shorter than a shortest distance between the first side and the first integrated circuit, and the shortest distance between the virtual line and the first integrated circuit is shorter than a shortest distance between the third side and the first integrated circuit.

5. The liquid discharge apparatus according to claim 3, wherein the first integrated circuit is provided so that a shortest distance between the first side and the first integrated circuit is shorter than a shortest distance between the third side and the first integrated circuit.

6. The liquid discharge apparatus according to claim 1, wherein a length of the first side is shorter than a length of the second side.

7. The liquid discharge apparatus according to claim 1, wherein the first flexible wiring substrate is electrically coupled to the second surface of the substrate.

8. The liquid discharge apparatus according to claim 1, wherein the first print head includes a second flexible wiring substrate that is electrically coupled to the substrate, the substrate includes a first FPC insertion hole through which the first flexible wiring substrate is inserted, and a second FPC insertion hole through which the second flexible wiring substrate is inserted, a width of the first FPC insertion hole in the direction along the first side is larger than a width of the first FPC insertion hole in a direction along the second side, and the first FPC insertion hole and the second FPC insertion hole are located so that at least portions thereof overlap in the direction along the second side.

9. The liquid discharge apparatus according to claim 8, wherein a shortest distance between the first integrated circuit and the second side is shorter than a shortest distance between the first FPC insertion hole and the second side, and the shortest distance between the first integrated circuit and the second side is shorter than a shortest distance between the second FPC insertion hole and the second side.

10. The liquid discharge apparatus according to claim 1, wherein a second print head in the plurality of print heads includes a second nozzle plate that includes a second nozzle row in which a plurality of second nozzles which discharge the liquid are provided in line, and the second print head is provided so that the plurality of second nozzles included in the second nozzle row are disposed in the direction along the first side.

11. The liquid discharge apparatus according to claim 10, wherein the first print head and the second print head are provided so that at least portions thereof overlap in the direction along the first side.

12. The liquid discharge apparatus according to claim 1, wherein the first print head includes a liquid supply port through which the liquid is supplied, and a shortest distance between the liquid supply port and the first surface is longer than a shortest distance between the liquid supply port and the second surface.

13. The liquid discharge apparatus according to claim 12, wherein the liquid supply port is located above the substrate in the direction along the vertical direction.

14. The liquid discharge apparatus according to claim 12, wherein the substrate includes a liquid supply port insertion hole through which the liquid supply port is inserted.

15. The liquid discharge apparatus according to claim 1, wherein the first print head includes a fixing member that fixes the substrate, the substrate includes a fixing member insertion hole through which the fixing member is inserted, the first integrated circuit is located to overlap at least a part of the fixing member in a direction along the second side, and the fixing member is located between the connector and the first integrated circuit in the direction along the second side.

16. The liquid discharge apparatus according to claim 1, wherein the connector includes a plurality of terminals.

17. The liquid discharge apparatus according to claim 16, wherein the plurality of terminals are provided in line in the direction along the first side.

18. The liquid discharge apparatus according to claim 16, wherein the connector includes a fifth side, and a sixth side which is longer than the fifth side, and the plurality of terminals are provided in line in a direction along the sixth side.

19. The liquid discharge apparatus according to claim 18, wherein the connector is provided so that the sixth side is parallel to the first side.

20. A head unit comprising:

a plurality of print heads that discharge liquid; and a housing that houses the plurality of print heads, wherein a first print head in the plurality of print heads includes a substrate that includes a first side, a second side which intersects with the first side, a first surface which has the first side and the second side, and a second surface which is different from the first surface, a first nozzle plate that includes a first nozzle row in which a plurality of first nozzles for discharging the liquid are provided in line in a direction along the first side, a connector that is provided in the first surface and to which a digital signal is input, a first integrated circuit that is provided in the first surface, that is electrically coupled to the connector, to which the digital signal is input via the connector, and that outputs an abnormality signal indicating presence or absence of abnormality of the first print head, a first flexible wiring substrate that is electrically coupled to the substrate, and a second integrated circuit that is provided on the first flexible wiring substrate, the second integrated circuit is located between the first nozzle plate and the substrate, and the substrate is provided so that the first surface faces downward and the second surface faces upward in a direction along a vertical direction.

* * * * *